US008741530B2

(12) United States Patent
Mitsumori et al.

(10) Patent No.: US 8,741,530 B2
(45) Date of Patent: Jun. 3, 2014

(54) IMAGE FORMING APPARATUS

(71) Applicant: Mitsubishi Chemical Corporation, Minato-ku (JP)

(72) Inventors: Teruyuki Mitsumori, Yokohama (JP); Kozo Ishio, Odawara (JP); Hiroaki Takamura, Odawara (JP); Masaya Oota, Joetsu (JP); Shiho Sano, Joetsu (JP); Takeshi Oowada, Joetsu (JP); Masakazu Sugihara, Joetsu (JP); Teruki Senokuchi, Joetsu (JP); Shiro Yasutomi, Joetsu (JP); Yumi Hirabaru, Joetsu (JP)

(73) Assignee: Mitsubishi Chemical Corporation, Minato-Ku (JP)

( * ) Notice: Subject to any disclaimer, the term of this patent is extended or adjusted under 35 U.S.C. 154(b) by 0 days.

(21) Appl. No.: 13/682,942

(22) Filed: Nov. 21, 2012

(65) Prior Publication Data

US 2013/0143156 A1 Jun. 6, 2013

Related U.S. Application Data

(62) Division of application No. 12/295,469, filed as application No. PCT/JP2007/057313 on Mar. 30, 2007, now abandoned.

(30) Foreign Application Priority Data

Mar. 30, 2006 (JP) ..... 2006-092751

(51) Int. Cl.
*G03G 13/20* (2006.01)

(52) U.S. Cl.
USPC ..... 430/124.1; 430/110.4

(58) Field of Classification Search
USPC ..... 430/124.1, 110.4
See application file for complete search history.

(56) References Cited

U.S. PATENT DOCUMENTS 4,985,327 A 1/1991 Sakashita et al.
5,009,973 A 4/1991 Yoshida et al.

(Continued)

FOREIGN PATENT DOCUMENTS

JP 1-134366 5/1989
JP 1 221755 9/1989

(Continued)

OTHER PUBLICATIONS

Japanese Office Action issued Nov. 1, 2011, in Patent Application No. 2007-092618 (with English-language translation).

(Continued)

*Primary Examiner* — Jonathan Jelsma
(74) *Attorney, Agent, or Firm* — Oblon, Spivak, McClelland, Maier & Neustadt, L.L.P.

(57) ABSTRACT

A method of forming an image on a substrate with an electrophotographic photoreceptor and a toner, a photosensitive layer of the electrophotographic photoreceptor contains a resin having a structural unit represented by the following formula (A)

(A)

the toner containing toner matrix particles formed in an aqueous medium; the toner has a volume median diameter (Dv50) of from 4.0 μm to 7.0 μm; and the relationship between the volume median diameter (Dv50) and the percentage in number (Dns) of toner particles having a particle diameter of from 2.00 μm to 3.56 μm satisfies following formula (1)

$$Dns \leq 0.233 \mathrm{EXP}(17.3/Dv50) \quad (1).$$

18 Claims, 4 Drawing Sheets

(56) References Cited

U.S. PATENT DOCUMENTS

| | | | |
|---|---|---|---|
| 5,037,714 | A | 8/1991 | Nozomi et al. |
| 5,137,796 | A | 8/1992 | Takiguchi et al. |
| 5,139,914 | A | 8/1992 | Tomiyama et al. |
| 5,210,617 | A | 5/1993 | Tomiyama et al. |
| 5,262,267 | A | 11/1993 | Takiguchi et al. |
| 5,508,395 | A | 4/1996 | Daimon et al. |
| 5,512,402 | A | 4/1996 | Okado et al. |
| 5,643,703 | A | 7/1997 | Daimon et al. |
| 5,670,288 | A | 9/1997 | Okado et al. |
| 5,932,384 | A | 8/1999 | Mitsumori et al. |
| 6,077,635 | A | 6/2000 | Okado et al. |
| 6,210,848 | B1 | 4/2001 | Nagai et al. |
| 8,064,796 | B2 | 11/2011 | Mitsumori et al. |
| 8,211,602 | B2 | 7/2012 | Mitsumori et al. |
| 8,221,950 | B2 | 7/2012 | Mitsumori et al. |
| 2003/0206226 | A1 | 11/2003 | Kurimoto et al. |
| 2005/0084787 | A1 | 4/2005 | Kobayashi et al. |
| 2005/0287457 | A1 | 12/2005 | Miyakawa et al. |
| 2006/0063090 | A1 | 3/2006 | Eida |
| 2006/0063094 | A1 | 3/2006 | Eida |
| 2006/0164496 | A1 | 7/2006 | Tokutake et al. |
| 2007/0003853 | A1 | 1/2007 | Inagaki et al. |
| 2009/0041500 | A1 | 2/2009 | Mitsumori et al. |
| 2010/0183330 | A1 | 7/2010 | Wada et al. |
| 2012/0039630 | A1 | 2/2012 | Mitsumori et al. |
| 2012/0045246 | A1 | 2/2012 | Mitsumori et al. |

FOREIGN PATENT DOCUMENTS

| | | |
|---|---|---|
| JP | 2 877 | 1/1990 |
| JP | 2 284158 | 11/1990 |
| JP | 3-48852 | 3/1991 |
| JP | 3 59563 | 3/1991 |
| JP | 3 59564 | 3/1991 |
| JP | 3 72365 | 3/1991 |
| JP | 3 113465 | 5/1991 |
| JP | 3-145678 | 6/1991 |
| JP | 4 143767 | 5/1992 |
| JP | 4 274250 | 9/1992 |
| JP | 5 27458 | 2/1993 |
| JP | 05 119530 | 5/1993 |
| JP | 6-279698 | 10/1994 |
| JP | 06 289648 | 10/1994 |
| JP | 7 98521 | 4/1995 |
| JP | 2518874 | 5/1996 |
| JP | 10 10778 | 1/1998 |
| JP | 10-239906 | 9/1998 |
| JP | 10 239906 | 9/1998 |
| JP | 11 174731 | 7/1999 |
| JP | 2000-267331 | 9/2000 |
| JP | 2001-13708 | 1/2001 |
| JP | 2001 134005 | 5/2001 |
| JP | 2001 175024 | 6/2001 |
| JP | 2001 265022 | 9/2001 |
| JP | 2001-272809 | 10/2001 |
| JP | 2002 006545 | 1/2002 |
| JP | 2002-31903 | 1/2002 |
| JP | 2002131957 | 5/2002 |
| JP | 2002-189307 | 7/2002 |
| JP | 2002-202624 | 7/2002 |
| JP | 2002-296829 | 10/2002 |
| JP | 2003-186235 | 7/2003 |
| JP | 2003 195713 | 7/2003 |
| JP | 2003-241406 | 8/2003 |
| JP | 2003 255567 | 9/2003 |
| JP | 2003-255585 | 9/2003 |
| JP | 2003 255585 | 9/2003 |
| JP | 2004-21045 | 1/2004 |
| JP | 2004 045948 | 2/2004 |
| JP | 2004-61560 | 2/2004 |
| JP | 2004-70142 | 3/2004 |
| JP | 2004-220005 | 8/2004 |
| JP | 2004-302462 | 10/2004 |
| JP | 2005-31120 | 2/2005 |
| JP | 2005-39535 | 2/2005 |
| JP | 2005-077461 | 3/2005 |
| JP | 2005 77461 | 3/2005 |
| JP | 2005-241974 | 9/2005 |
| JP | 2005-258147 | 9/2005 |
| JP | 2006-3885 | 1/2006 |
| JP | 2006-11137 | 1/2006 |
| JP | 2006-23780 | 1/2006 |
| JP | 2006-47631 | 2/2006 |
| JP | 2006 53262 | 2/2006 |
| JP | 2006-71665 | 3/2006 |
| JP | 2006-72093 | 3/2006 |
| JP | 2006-72386 | 3/2006 |
| JP | 2006 084938 | 3/2006 |
| JP | 2006 91175 | 4/2006 |
| JP | 2006 119616 | 5/2006 |
| WO | 2004 088431 | 10/2004 |

OTHER PUBLICATIONS

Japanese Office Action issued Nov. 8, 2011, in Patent Application No. 2007-091815 (with English-language translation).

Japanese Information Offer Form issued Jul. 5, 2011, in Patent Application No. 2007-092618 (with English-language translation).

Japanese Information Offer Form issued Jul. 5, 2011, in Patent Application No. 2007-091815 (with English-language translation).

Machine translation of JP 2002-131957 A.

Diamond, Aruther S & David Weiss (eds.) Handbook of Imaging Materials, 2nd ed., New York: Marcel-Dekker, Incl. (Nov. 2001), pp. 145-164.

U.S. Appl. No. 13/652,494, filed Oct. 16, 2012, Mitsumori, et al.

Office Action issued Oct. 6, 2011 in Japanese Application No. 2007-091366 (With English Translation).

Office Action issued Oct. 16, 2012 in Japanese Application No. 2007-091366 (With English Translation).

Office Action as received in the corresponding Japanese application No. 2012-274208 dated Jun. 18, 2013 (English Translation Only).

IMAGE FORMING APPARATUS

This application is a divisional application of U.S. Ser. No. 12/295,469 filed Sep. 30, 2008, now abandoned, which was a National Stage of PCT/JP2007/057313 filed Mar. 30, 2007 and claims the benefit of JP 2006-092751 filed Mar. 30, 2006.

TECHNICAL FIELD

The present invention relates to an image forming apparatus to be used for copying machines or printers.

BACKGROUND ART

In recent years, applications of image forming apparatus such as electrophotographic copying machines, etc. have been expanding, and there has been a demand in a market for a higher level of image quality. Particularly, with respect to office documents, etc., in addition to developments of the image copying techniques or latent image-forming techniques at the time of inputting, also at the time of outputting, the types of hieroglyphic characters have become richer and more refined, and due to dissemination and development of presentation software, reproducibility of latent images of extremely high quality is desired so that there will be little defects or unsharpness in printed images. Particularly, as a developer to be used in a case where latent images on a latent image substrate constituting an image forming apparatus are line images of at most 100 μm (at least about 300 dpi), a conventional toner is usually poor in reproducibility of such fine lines, whereby sharpness of line images has not yet been sufficient.

Particularly, in the case of an image forming apparatus such as an electrophotographic printer using digital image signals, a latent image is formed by a gathering of certain prescribed dot units, and a solid portion, a half-tone portion and a light portion are expressed by changing the dot density. However, if toner matrix particles are not accurately disposed at the dot units and mismatching occurs between the positions of dot units and the actually placed toner positions, there will be a problem such that no gradation of the toner image is obtainable which corresponds to the ratio in the dot density between a black portion and a white portion of a latent image. Further, if, in order to improve the image quality, the dot size is reduced to improve the resolution, the reproducibility of a latent image to be formed of such fine dots, tends to be further difficult, and it is unavoidable that the image tends to be poor in gradation with high resolution and poor in sharpness.

Therefore, it has been proposed to regulate the particle size distribution of a developer to improve the reproducibility of fine dots thereby to improve the image quality. Patent Document 1 proposes a toner having an average particle size of from 6 to 8 μm, and it has been attempted to form a latent image of fine dots with good reproducibility by making the particle size fine. Further, Patent Document 2 discloses a toner having a weight average particle size of from 4 and 8 μm and toner matrix particles containing from 17 to 60% in number of toner matrix particles having a particle size of at most 5 μm. Further, Patent Document 3 discloses a magnetic toner containing from 17 to 60% in number of magnetic toner matrix particles having a particle size of at most 5 μm. Patent Document 4 discloses toner matrix particles wherein, in the particle size distribution of the toner, the content of the toner matrix particles having a particle size of from 2.0 to 4.0 μm is from 15 to 40% in number. Further, Patent Document 5 discloses a toner containing from about 15 to 65% in number of particles of at most 5 μm. Further, Patent Document Nos. 6 and 7 disclose similar toners. Further, Patent Document 8 discloses a toner which contains from 17 to 60% in number of toner matrix particles having a particle size of at most 5 μm, contains from 1 to 30% in number of toner matrix particles having a particle size of from 8 to 12.7 μm and contains at most 2.0 vol % of toner matrix particles having a particle size of at least 16 μm and which has a volume average particle size of from 4 to 10 μm and has a specific particle size distribution with a toner of at most 5 μm.

However, each of these toners is one containing a large amount (i.e. % in number) of particles of at most 3.56 μm exceeding the upper limit of the right-hand side of the formula (1) of the present invention, which means that it is a toner wherein, in a relative relation between the particle size and fine powder, the proportion of fine powder remaining is relatively large as compared with a toner having a prescribed particle size. In such a toner wherein the proportion of fine powder is still large, there will be particles not sufficiently electrified by a developing method where a toner having a quick rising in electrification is required particularly in such a case where electrification is done instantaneously by friction as in a non-magnetic one component developing method, whereby there have been problems such that the toner is likely to fall off or be blown off from the developing roller, that the image density fluctuates to form ghosts by selectively picking up a print history of the first rotation of the developing roller in the second or subsequent rotation of the roller, that the drum cleaning tends to be inadequate and that soiling of printed images is likely to result due to failure to form a toner layer on the developing roller.

In recent years, enhanced life and high speed printing have been desired in addition to the demand in the market for high image quality. However, such demands also have not yet been fully satisfied by conventional toners. If a fine powder is contained in a substantial amount like in a conventional toner, there has been a problem such that the fine powder contaminates components in continuous printing, whereby the ability to charge the toner or the like tends to decrease to cause non-uniformity of the image, and when such a toner is introduced into a high speed printing machine, scattering of the toner tends to be remarkable. Further, it has been one of important objectives to prepare an electrophotographic photoreceptor which presents good matching with a toner having a small particle size.

Patent Document 1: JP-A-2-284158
Patent Document 2: JP-A-5-119530
Patent Document 3: JP-A-1-221755
Patent Document 4: JP-A-6-289648
Patent Document 5: JP-A-2001-134005
Patent Document 6: JP-A-11-174731
Patent Document 7: JP-A-11-362389
Patent Document 8: JP-A-2-000877

DISCLOSURE OF THE INVENTION

Object to be Accomplished by the Invention

The present invention has been made in view of the above prior art, and it is an object of the present invention to provide an image forming apparatus which is capable of suppressing soiling of image white parts, residual images (ghosts), blurring (blotted image follow-up properties), etc. attributable to the proportion of fine powder of toner having a certain particle diameter or less and which is able to improve image quality, provides good fixing properties and cleaning properties, presents little fogging, is free from dot missing till low image density, and even when a high speed printing machine is used, can reduce a problem of e.g. soiling in a long-term use and presents excellent image stability.

Means to Accomplish the Object

The present inventors have conducted an extensive study to accomplish the above object, and as a result, they have found it possible to accomplish the object when a specific relational formula is satisfied with respect to the toner particle size, and a specific electrophotographic photoreceptor is used, and thus have accomplished the present invention.

Namely, the present invention provides an image forming apparatus comprising, at least, an electrophotographic photoreceptor and a toner for developing an electrostatic charge image, wherein a photosensitive layer of the electrophotographic photoreceptor contains a resin having a structural unit represented by the following formula (A); the toner for developing an electrostatic charge image is a toner for developing an electrostatic charge image containing toner matrix particles formed in an aqueous medium; the toner has a volume median diameter (Dv50) of from 4.0 μm to 7.0 μm; and the relationship between the volume median diameter (Dv50) and the percentage in number (Dns) of toner particles having a particle diameter of from 2.00 μm to 3.56 μm satisfies the following formula (1):

(A)

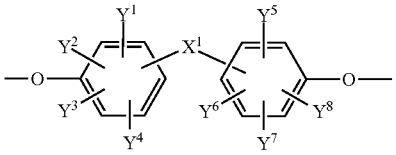

where $X^1$ is a single bond or a connecting group having no cyclic structure, and each of $Y^1$ to $Y^8$ which are independent of one another, is a hydrogen atom or a substituent having at most 20 carbon atoms;

$$Dns \leq 0.233\mathrm{EXP}(17.3/Dv50) \quad (1)$$

where Dv50 is the volume median diameter (μm) of the toner, and Dns is the percentage in number of toner particles having a particle diameter of from 2.00 μm to 3.56 μm.

In the following, the requirement in the present invention shown in the following guotation marks " " and relating to only the toner for developing an electrostatic charge image, will hereinafter referred to simply as "requirement (a)".

"The toner for developing an electrostatic charge image is a toner for developing an electrostatic charge image containing toner matrix particles formed in an aqueous medium; the toner has a volume median diameter (Dv50) of from 4.0 μm to 7.0 μm; and the relationship between the volume median diameter (Dv50) and the percentage in number (Dns) of toner particles having a particle diameter of from 2.00 μm to 3.56 μm satisfies the following formula (1):

$$Dns \leq 0.233\mathrm{EXP}(17.3/Dv50) \quad (1)$$

where Dv50 is the volume median diameter (μm) of the toner, and Dns is the percentage in number of toner particles having a particle diameter of from 2.00 μm to 3.56 μm".

Further, the present invention provides an image forming apparatus comprising, at least, an electrophotographic photoreceptor and a toner for developing an electrostatic charge image, wherein a photosensitive layer in the electrophotographic photoreceptor contains a polyarylate resin, and the toner for developing an electrostatic charge image satisfies the above requirement (a).

Further, the present invention provides an image forming apparatus comprising, at least, an electrophotographic photoreceptor and a toner for developing an electrostatic charge image, wherein a photosensitive layer of the electrophotographic photoreceptor contains a charge transport agent having an ionization potential of from 5.0 to 5.3, and the toner for developing an electrostatic charge image satisfies the above requirement (a).

Further, the present invention provides an image forming apparatus comprising, at least, an electrophotographic photoreceptor and a toner for developing an electrostatic charge image, wherein a photosensitive layer of the electrophotographic photoreceptor contains a hindered phenol compound as an antioxidant, and the toner for developing an electrostatic charge image satisfies the above requirement (a).

Further, the present invention provides an image forming apparatus comprising, at least, an electrophotographic photoreceptor and a toner for developing an electrostatic charge image, wherein a photosensitive layer of the electrophotographic photoreceptor contains a compound having a LUMO energy level value of from −1.0 eV to −3.0 eV by structural optimization by means of semiempirical molecular orbital is calculation using PM3 parameters, and the toner for developing an electrostatic charge image satisfies the above requirement (a).

Further, the present invention provides an image forming apparatus comprising, at least, an electrophotographic photoreceptor and a toner for developing an electrostatic charge image, wherein a photosensitive layer of the electrophotographic photoreceptor contains a compound represented by the following formula (B), and the toner for developing an electrostatic charge image satisfies the above requirement (a):

(B)

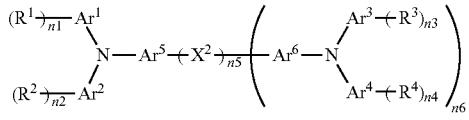

where each of $Ar^1$ and $Ar^6$ which are independent of one another, is an aromatic group which may have a substituent, or an aliphatic group which may have a substituent, $X^2$ is an organic group, each of $R^1$ to $R^4$ which are independent of one another, is an unsaturated group, and each of n1 to n6 which are independent of one another, is an integer of 0, 1 or 2, provided that when n1 is 1, n2 is also 1.

Further, the present invention provides an image forming apparatus comprising, at least, an electrophotographic photoreceptor and a toner for developing an electrostatic charge image, wherein the electrophotographic photoreceptor is a lamination type photoreceptor comprising a charge generation layer and a charge transport layer; the weight ratio of a charge transport agent to a binder (i.e. charge transport agent/binder) contained in the charge transport layer is from 0.3 to 0.6; and the toner for developing an electrostatic charge image satisfies the above requirement (a).

Further, the present invention provides an image forming apparatus comprising, at least, an electrophotographic photoreceptor and a toner for developing an electrostatic charge image, wherein the outermost layer of the electrophotographic photoreceptor has a surface free energy γ value of from 35 mN/m to 65 mN/m, and the toner for developing an electrostatic charge image satisfies the above requirement (a).

Effects of the Invention

According to the present invention, it is possible to obtain a toner for developing electrostatic charge image which is capable of suppressing soiling of image white parts, residual images (ghosts), blurring (blotted image follow-up properties), etc. and which provides good fixing properties, cleaning properties, etc., and presents excellent image stability without the above mentioned problems even when used for a long period of time. By a combination of such a toner and a specific requirement for an electrophotographic photoreceptor, it is possible to provide an image-forming apparatus which is further excellent in such performance and which presents little fogging and is free from dot missing till low image density.

Further, also at the time of forming images by a high speed printing method which has been developed in recent years, since the particle size distribution of the toner is narrow, and fine powder is little even the toner particle size is reduced, the packing fraction i.e. bulk density of the toner powder will be improved. Accordingly, the content of air present in spaces among toner matrix particles will be reduced, and the thermal insulation effect by such air will be reduced, whereby the heat conduction will be improved, and the fixing properties by heating will be improved.

Further, due to a synergistic effect of the electrophotographic photoreceptor with an interlayer having a high blocking property, it is possible to provide an image forming apparatus having image defects such as fogging, color spots, leaks, etc. reduced. Further, due to a synergistic effect of the photographic photoreceptor having a specific light sensitive layer and the toner for developing an electrostatic charge image having the particle diameter distribution defined, it is possible to provide an image forming apparatus having the above effects further improved.

MEANING OF SYMBOLS

Figure 1:
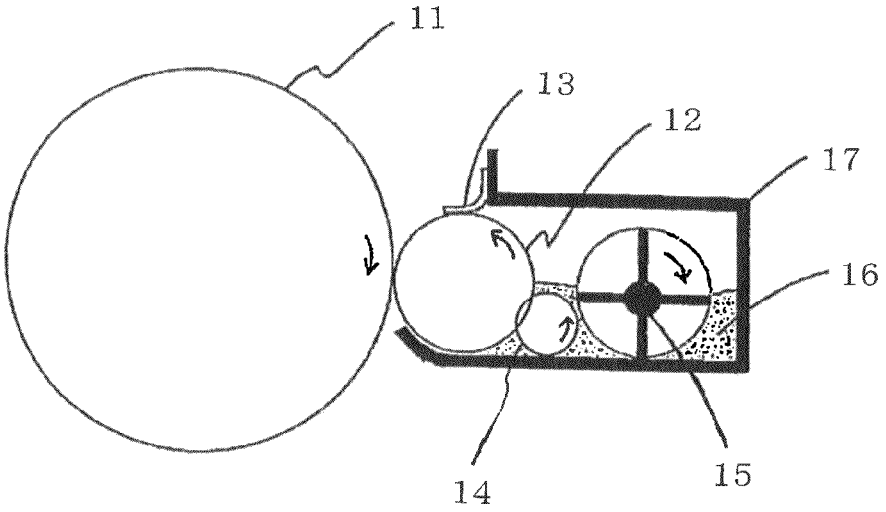
FIG. 1 is a schematic view illustrating an embodiment of a non-magnetic one component toner developing apparatus to be used for the image forming apparatus of the present invention.

11: Electrostatic latent image substrate
12: Toner transporting member
13: Elastic blade (member to regulate the thickness of toner layer)
14: Sponge roller (assisting member to supply toner)
15: Stirring vanes
16: Toner
17: Toner hopper
1: Photoreceptor (electrophotographic photoreceptor)
2: Charging device (charging roller, charging section)
3: Exposure device (exposure section)
4: Developing device (developing section)
5: Transfer device
6: Cleaning device (cleaning section)
7: Fixing device
41: Developer tank
42: Agitator
43: Feed roller
44: Developing roller
45: Regulating member
71: Upper fixing member (pressing roller)
72: Lower fixing member (fixing roller)
73: Heating device
T: Toner
P: Recording paper (sheet, medium)

BEST MODE FOR CARRYING OUT THE INVENTION

Now, the present invention will be described, but it should be understood that the present invention is by no means restricted to the following embodiments and may be practiced by optionally modifying them.

The process for producing the toner for developing an electrostatic charge image (hereinafter referred to simply as "toner") to be used for the image forming apparatus of the present invention is not particularly limited so long as it is formed in an aqueous medium. The toner to be used for the image forming apparatus of the present invention has the following construction.

However, the following construction is merely a typical embodiment of the present invention and may be optionally modified within a range not to depart from the scope of the present invention.

Construction of Toner

The binder resin for constituting the toner to be used for the image forming apparatus of the present invention may suitably be selected for use among those known to be used for toners. It may, for example, be a styrene resin, a vinyl chloride resin, a rosin-modified maleic acid resin, a phenol resin, an epoxy resin, a saturated or unsaturated polyester resin, a polyethylene resin, a polypropylene resin, an ionomer resin, a polyurethane resin, a silicone resin, a ketone resin, an ethylene/acrylate copolymer, a xylene resin, a polyvinyl butyral resin, a styrene/alkyl acrylate copolymer, a styrene/alkyl methacrylate copolymer, a styrene/acrylonitrile copolymer, a styrene/butadiene copolymer or a styrene/maleic anhydride copolymer. These resins may be used alone or in combination as a mixture thereof.

The colorant for constituting the toner to be used for the image forming apparatus of the present invention may suitably be selected for use among those known to be used for toners. It may, for example, be the following yellow pigment, magenta pigment or cyan pigment, and as a black pigment, carbon black or one having the following yellow pigment/magenta pigment/cyan pigment mixed and adjusted to black color, may be used.

Among them, carbon black as a black pigment is present in the form of aggregates of very fine primary particles, and when dispersed as a pigment dispersion, enlargement of particles by re-aggregation is likely to result. The degree of re-aggregation of carbon black particles is interrelated with the amount of impurities (the residual amount of non-decomposed organic substances) contained in carbon black, and the larger the amount of impurities, the greater the enlargement by re-aggregation after the dispersion. And, for quantitative evaluation of the amount of impurities, the ultraviolet ray absorbance of the toluene extract of carbon black is preferably at most 0.05, more preferably at most 0.03, as measured by the following method. Usually, carbon black by a channel method tends to have a large amount of impurities, and accordingly, one produced by a furnace method is preferred as the carbon black in the present invention.

The ultraviolet ray absorbance (λc) of carbon black is obtained by the following method. Firstly, 3 g of carbon black is sufficiently dispersed and mixed in 30 mL of toluene, and then, this mixture is subjected to filtration by using filtration paper No. 5C. Then, the filtrate is put in a quartz cell having a 1 cm square light absorbing section, and the absorbance at a wavelength of 336 nm is measured by using a commercially available ultraviolet ray spectrophotometer to obtain a value (λs), and in the same method, the absorbance of toluene only is measured as a reference to obtain a value (λo), whereupon the ultraviolet ray absorbance is obtained by λc=λs−λo. The commercially available spectrophotometer may, for example, be an ultraviolet visible spectrophotometer (UV-3100PC) manufactured by Shimadzu Corporation.

As the yellow pigment, a compound represented by a condensed azo compound or an isoindoline compound may be used. Specifically, C.I. Pigment Yellow 12, 13, 14, 15, 17, 62, 74, 83, 93, 94, 95, 109, 110, 111, 128, 129, 147, 150, 155, 168, 180, 194, etc. may suitably be used.

As the magenta pigment, a condensed azo compound, a diketopyrrolopyrrole compound, an anthraquinone, a quinacridone compound, a basic dye lake compound, a naphthol compound, a benzimidazolone compound, a thioindigo compound or a perylene compound, may, for example, be used. Specifically, C.I. Pigment Red 2, 3, 5, 6, 7, 23, 48:2, 48:3, 48:4, 57:1, 81:1, 122, 144, 146, 166, 169, 17.3, 184, 185, 202, 206, 207, 209, 220, 221, 238, 254, or C.I. Pigment Violet 19, may, for example, be suitably used. Among them, a quinacridone pigment such as C.I. Pigment Red 202, 207, 209 or C.I. Pigment Violet 19 is particularly preferred. Among quinacridone pigments, a compound represented by C.I. Pigment Red is particularly preferred.

As cyan pigment, a copper phthalocyanine compound or its derivative, an anthraquinone compound or a basic dye lake compound may, for example, be used. Specifically, C.I. Pigment Blue 1, 15, 15:1, 15:2, 15:3, 15:4, 60, 62, 66, or C.I. Pigment Green 7 or 36 may, for example, be particularly preferably used.

As a production method to obtain toner matrix particles in an aqueous medium, a method to carry out radical polymerization in an aqueous medium such as a suspension polymerization method or an emulsion polymerization aggregation method (hereinafter referred to simply as "polymerization method", and the obtained toner will be referred to simply as "polymerized toner") or a chemical pulverization method represented by a melt suspension method, may, for example, be suitably used. There is no particular restriction as to a method for producing toner matrix particles whereby the toner particle size is adjusted to be within the specific range of the present invention. For example, in the process for producing the polymerized toner, in the case of a suspension polymerization method, a method of exerting a high shearing force in the step of forming polymerizable monomer droplets, or a method of increasing the amount of a dispersion stabilizer or the like, may, for example, be mentioned.

As a method to obtain a toner having a particle size within the specific range of the present invention, it is possible to employ any one of a polymerization method such as the above mentioned suspension polymerization method or emulsion polymerization aggregation method, or a chemical pulverization method represented by a melt suspension method. In the "suspension polymerization method" or "chemical pulverization method represented by a melt suspension method", the toner matrix particle size is adjusted from a large size to a small size, whereby if it is attempted to reduce the average particle size, the particle size proportion on the small particle side tends to increase, whereby an excess load tends to be required in e.g. a classification step. Whereas, in the emulsion polymerization aggregation method, the particle size distribution is relatively sharp, and the toner matrix particle size is adjusted from a small size to a large size, whereby a toner having a uniform particle size distribution can be obtained without requiring such a step as a classification step. For the above reason, it is particularly preferred to produce toner matrix particles to be contained in the toner of the present invention, by the emulsion polymerization aggregation method.

Now, the toner to be produced by such an emulsion polymerization aggregation method will be described in further detail.

When a toner is produced by an emulsion polymerization aggregation method, the method usually comprises a polymerization step, a mixing step, an aggregation step, an aging step and a cleaning/drying step. Namely, usually, to a dispersion containing primary particles of a polymer obtained by emulsion polymerization, a dispersion of a colorant, a charge-controlling agent, wax, etc. is mixed; primary particles in this dispersion are aggregated to form core particles, on which fine resin particles, etc. are fixed or deposited as the case requires, followed by baking; particles thereby obtained are washed and dried to obtain toner matrix particles.

As a binder resin to constitute primary particles of a polymer to be used for the emulsion polymerization aggregation method, one or more polymerizable monomers which are polymerizable by an emulsion polymerization may suitably be employed. As such polymerizable monomers, it is preferred to employ, as raw material polymerizable monomers, e.g. "a polymerizable monomer having a polar group" (hereinafter sometimes referred to simply as "polar monomer"), such as "a polymerizable monomer having an acidic group" (hereinafter sometimes referred to simply as "acidic monomer" or "a polymerizable monomer having a basic group" (hereinafter sometimes referred to simply as "basic monomer"), and "a polymerizable monomer having neither acidic group nor basic group" (hereinafter sometimes referred to as "other monomers"). In such a case, the respective polymerizable monomers may separately be added, or a plurality of polymerizable monomers may be preliminarily mixed and simultaneously added. Further, it is also possible to change the composition of polymerizable monomers during the addition of the polymerizable monomers. Further, the polymerizable monomers may be added as they are, or they may be mixed or blended with water, an emulsifier, etc. and may be added in the form of emulsions.

The "acidic monomer" may, for example, be a polymerizable monomer having a carboxyl group such as acrylic acid, methacrylic acid, itaconic acid, maleic acid, fumaric acid or cinnamic acid; a polymerizable monomer having a sulfonic group such as styrene sulfonate; or a polymerizable monomer having a sulfonamide group such as vinyl benzene sulfonamide.

Further, the "basic monomer" may, for example, be an aromatic vinyl compound having an amino group such as aminostyrene, or a nitrogen-containing heteroring-containing polymerizable monomer such as vinylpyridine or vinylpyrrolidone.

These polar monomers may be used alone or in combination as a mixture of two or more of them, and further, they may be present in the form of their salts as accompanied by counter ions. Among them, it is preferred to employ an acidic monomer, and more preferred is (meth)acrylic acid. The proportion of the total amount of polar monomers in 100 mass % of all polymerizable monomers to constitute a binder resin as primary particles of a polymer is preferably at least 0.05 mass %, more preferably at least 0.3 mass %, particularly preferably at least 0.5 mass %, further preferably at least 1 mass %. The upper limit is preferably at most 10 mass %, more preferably at most 5 mass %, particularly preferably at most 2 mass %. Within the above range, the dispersion stability of the obtainable polymer primary particles will be improved, and adjustment of the particle shape or size in the aggregation step will be facilitated.

Said "other monomers" may, for example, be a styrene such as styrene, methylstyrene, chlorostyrene, dichlorostyrene, p-tert-butylstyrene, p-n-butylstyrene or p-n-nonylstyrene; an acrylate such as methyl acrylate, ethyl acrylate, propyl acrylate, n-butyl acrylate, isobutyl acrylate, hydroxyethyl acrylate or ethylhexyl acrylate; a methacrylate such as methyl methacrylate, ethyl methacrylate, propyl methacrylate, n-butyl methacrylate, isobutyl methacrylate, hydroxyethyl methacrylate or ethylhexyl methacrylate; an acrylamide, N-propylacrylamide, N,N-dimethylacrylamide, N,N-dipropylacrylamide, N,N-dibutylacrylamide, and an acrylic acid amide. The polymerizable monomers may be used alone or in combination as a mixture of two or more of them.

In the present invention, the above described polymerizable monomers are used in combination. Among them, as a preferred embodiment, it is preferred to use an acidic monomer in combination with other monomers. More preferably, (meth)acrylic acid is used as an acidic monomer, and polymerizable monomers selected from styrenes and (meth)acrylates are used as other monomers. More preferably, (meth) acrylic acid is used as an acidic monomer, and a combination of styrene and (meth)acrylate is used as other monomers, and particularly preferably, (meth)acrylic acid is used as the acidic monomer and a combination of styrene and n-butyl acrylate is used as other monomers.

Further, it is also preferred to employ a crosslinked resin as a binder resin to constitute the polymer primary particles. In such a case, as a crosslinking agent to be used together with the above polymerizable monomer, a polyfunctional monomer having radical polymerizability is employed. Such a polyfunctional monomer may, for example, be divinylbenzene, hexanediol diacrylate, ethylene glycol dimethacrylate, diethylene glycol dimethacrylate, diethylene glycol diacrylate, triethylene glycol diacrylate, neopentyl glycol dimethacrylate, neopentyl glyocol acrylate, or diallyl phthalate. Further, as the crosslinking agent, it is possible to employ a polymerizable monomer having a reactive group as a pendant group, such as glycidyl methacrylate, methylol acrylamide or acrolein. Among them, a radical polymerizable bifunctional monomer is preferred, and divinylbenzene or hexanediol diacrylate is particularly preferred.

Such crosslinking agents such as polyfunctional monomers may be used alone or in combination as a mixture of two or more of them. In a case where a cross-linked resin is used as a binder resin to constitute polymer primary particles, the proportion of the crosslinking agent such as a polyfunctional monomer occupying in all polymerizable monomers to constitute the resin is preferably at least 0.005 mass %, more preferably at least 0.1 mass %, further preferably at least 0.3 mass %, and preferably at most 5 mass %, more preferably at most 3 mass %, further preferably at most 1 mass %.

As the emulsifier to be used for emulsion polymerization, a known emulsifier may be employed, and one or more emulsifiers selected from cationic surfactants, anionic surfactants and nonionic surfactants may be used.

The cationic surfactants include, for example, dodecylammonium chloride, dodecylammonium bromide, dodecyltrimethylammonium bromide, dodecylpyridinium chloride, dodecylpyridinium bromide and hexadecyltrimethylammonium bromide.

The anionic surfactants include, for example, a fatty acid soap such as sodium stearate or sodium dodecanoate, sodium dodecyl sulfate, sodium dodecylbenzene sulfonate and sodium lauryl sulfate.

The nonionic surfactants include, for example, polyoxyethylene dodecyl ether, polyoxyethylene hexadecyl ether, polyoxyethylene nonylphenyl ether, polyoxyethylene lauryl ether, polyoxyethylene sorbitan monooleate ether and monodecanoyl sucrose.

The amount of the emulsifier to be used is usually from 1 to 10 parts by weight per 100 parts by weight of the polymerizable monomers. Further, with such an emulsifier, one or more selected from polyvinyl alcohols such as partially or completely saponified polyvinyl alcohols, and cellulose derivatives such as hydroxyethyl cellulose, may be used in combination as a protective colloid.

As the polymerization initiator to be used for emulsion polymerization, hydrogen peroxide; a persulfate such as potassium persulfate; an organic peroxide such as benzoyl peroxide or lauroyl peroxide; an azo compound such as 2,2'-azobisisobutyronitrile or 2,2'-azobis(2,4-dimethylvaleronitrile); or a redox initiator may, for example, be used. They may be used alone or in combination as a mixture of two or more of them. The polymerization initiator is usually employed in an amount of from about 0.1 to 3 parts by weight per 100 parts by weight of the polymerizable monomers. As the initiator, particularly preferred is one which is partially or wholly hydrogen peroxide or an organic peroxide.

Each of the above mentioned polymerizable initiators may be added to the polymerization system at any timing i.e. before, at the same time as or after the addition of polymerizable monomers, or such addition methods may be used in combination as the case requires.

At the time of the emulsion polymerization, a known chain transfer agent may be used as the case requires. As a specific example of such a chain transfer agent, t-dodecylmercaptan, 2-mercaptoethanol, diisopropylxanthogen, carbon tetrachloride or trichlorobromomethane may, for example, be mentioned. Such chain transfer agents may be used alone or in combination of two or more of them usually in an amount within a range of at most 5 mass %, based on all polymerizable monomers. Further, to the reaction system, a pH-adjusting agent, a polymerization degree-adjusting agent, a defoaming agent, etc., may further be incorporated, as the case requires.

In the emulsion polymerization, the above mentioned polymerizable monomers are polymerized in the presence of a polymerization initiator, and the polymerization temperature is usually from 50 to 120° C., preferably from 60° C. to 100° C., more preferably from 70 to 90° C.

The volume average diameter (Mv) of polymer primary particles obtained by the emulsion polymerization is usually at least 0.02 μm, preferably at least 0.05 μm, more preferably at least 0.1 μm, and usually at most 3 μm, preferably at most 2 μm, more preferably at most 1 μm. If the particle diameter is less than the above range, control of the aggregation rate tends to be difficult, and if it exceeds the above range, the particle size of the toner obtainable by aggregation tends to be large, whereby it tends to be difficult to obtain a toner having a desired particle size.

Tg (glass transition temperature) by DSC (differential scanning calorimetry) of the binder resin as polymer primary particles in the present invention is preferably from 40 to 80° C., more preferably from 55 to 65° C. Within such a range, the storage stability is good, and, in addition, the aggregation property will not be impaired. If Tg is too high, the aggregation property tends to be poor, and it will be required to add an aggregating agent excessively or to increase the aggregation temperature excessively, whereby fine powder tends to be formed. Here, in a case where Tg of the binder resin overlapped with a calorific change based on another component such as a fusion peak of wax or polylactone and therefore can not clearly be judged, it means Tg at the time when a toner is prepared by excluding such another component.

In the present invention, the acid value of the binder resin to constitute polymer primary particles, is preferably from 3 to 50 mgKOH/g, more preferably from 5 to 30 mgKOH/g, as a value measured by the method of JISK-0070.

With respect to the solid content concentration of the polymer primary particles in the "dispersion of polymer primary particles" to be used in the present invention, the lower limit value is preferably at least 14 mass %, more preferably at least 21 mass %. On the other hand, its upper limit value is preferably at most 30 mass %, more preferably at most 25 mass %. Within such a range, it is empirically easy to adjust the aggregation rate of polymer primary particles in the aggregation step, and consequently, it becomes easy to adjust the particle size, the particle shape and the particle size distribution of the core particles to be within optional ranges.

In the present invention, it is preferred that a dispersion of a colorant, a charge-controlling agent, wax, etc., is mixed to a dispersion containing polymer primary particles obtained by the emulsion polymerization, and the primary particles in this dispersion are aggregated to form core particles, on which fine resin particles or the like are then fixed or deposited, followed by fusion, whereupon the obtained particles are washed and cleaned to obtain toner matrix particles.

The fine resin particles may be produced by the same method as of the above polymer primary particles, and their construction is not particularly limited. However, the proportion of the total amount of polar monomers occupying in 100 mass % of all polymerizable monomers constituting the binder resin as the fine resin particles, is preferably at least 0.05 mass %, more preferably at least 0.1 mass %, more preferably at least 0.2 mass %. The upper limit is preferably at most 3 mass %, more preferably at most 1.5 mass %. In such a range, the dispersion stability of the fine resin particles thereby obtainable will be improved, whereby it tends to be easy to adjust the particle shape or particle size in the aggregation step.

Further, it is preferred that the proportion of the total amount of polar monomers occupying in 100 mass % of all polymerizable monomers constituting the binder resin as the fine resin particles, is smaller than the proportion of the total amount of polar monomers occupying in 100 mass % of all polymerizable monomers constituting the binder resin as polymer primary particles, whereby it becomes easy to adjust the particle shape or particle size in the aggregation step, it is possible to suppress formation of fine powder, and the charging properties will be excellent.

Further, from the viewpoint of e.g. the storage stability, Tg of the binder resin as the fine resin particles is higher than Tg of the binder resin as polymer primary particles.

The colorant may be a commonly employed colorant and is not particularly limited. For example, the above mentioned pigment; carbon black such as furnace black or lamp black; or a magnetic colorant may, for example, be mentioned. The content of the colorant may be such an amount that is sufficient for the obtainable toner to form a visible image by development. For example, it is preferably within a range of from 1 to 25 parts by weight, more preferably from 1 to 15 parts by weight, particularly preferably from 3 to 12 parts by weight, in the toner.

The above colorant may have a magnetic property, and such a magnetic colorant may, for example, be a ferromagnetic material showing ferromagnetism or to ferrimagnetism in the vicinity of from 0 to 60° C. as a practical temperature for printers, copying machines, etc. Specifically, it may, for example, be one showing magnetism in the vicinity of from 0 to 60° C. among magnetite ($Fe_3O_4$), maghematite ($\gamma$-$Fe_2O_3$), an intermediate product or mixture of magnetite and maghematite; spinel ferrite of $M_xFe_{3-x}O_4$ (wherein M is Mg, Mn, Fe, Co, Ni, Cu, Zn, Cd, etc.); hexagonal ferrite such as $BaO.6Fe_2O_3$ or $SrO.6Fe_2O_3$; garnet type oxide such as $Y_3Fe_5O_{12}$ or $Sm_3Fe_5O_{12}$; a rutile type oxide such as $CrO_2$; and a metal such as Cr, Mn, Fe, Co or Ni, or a ferromagnetic alloy thereof. Among them, magnetite, maghematite or an intermediate of magnetite and maghematite, is preferred.

In a case where it is incorporated with a view to preventing scattering or controlling electrification while providing characteristics as a non-magnetic toner, the content of the above magnetic powder in the toner is from 0.2 to 10 mass %, preferably from 0.5 to 8 mass %, more preferably from 1 to 5 mass %. In a case where it is used for a magnetic toner, the content of the above magnetic powder in the toner is usually at least 15 mass %, preferably at least 20 mass %, and usually at most 70 mass %, preferably at most 60 mass %. If the content of the magnetic powder is less than the above range, no adequate magnetization required as a magnetic toner may sometimes be obtainable, and if it exceeds the above range, such may sometimes cause a fixing property failure.

As a method for incorporating a colorant in the emulsion polymerization aggregation method, it is common that a dispersion of polymer primary particles and a dispersion of a colorant are mixed to obtain a mixed dispersion which is then aggregated to obtain particulate aggregates. The colorant is preferably used in a state emulsified in water in the presence of an emulsifying agent by a mechanical means such as a sand mill or a beads mill. At that time, the colorant dispersion preferably comprises from 10 to 30 parts by weight of a colorant and from 1 to 15 parts by weight of an emulsifying agent, per 100 parts by weight of water. Here, it is preferred that the particle size of the colorant in the dispersion is monitored during the dispersion, so that the volume average diameter (Mv) is finally controlled to be within a range of from 0.01 to 3 μm, more preferably from 0.05 to 0.5 μm. The colorant dispersion is incorporated in the emulsion aggregation so that the colorant would be from 2 to 10 mass % in the toner matrix particles finally obtainable after the aggregation.

To the toner to be used for the image forming apparatus of the present invention, it is preferred to incorporate wax in order to impart a release property. The wax may be incorporated to the polymer primary particles or to the fine resin particles. As such wax, any wax may be used without any particular restriction so long as it is one having a release property. Specifically, it may, for example, be an olefin wax such as a low molecular weight polyethylene, a low molecular weight polypropylene or a copolymerized polyethylene; paraffin wax; an ester type wax having a long chain aliphatic group such as a behenyl behenate, a montanate or stearyl stearate; a plant wax such as hydrogenated castor oil or carnauba wax; a ketone having a long chain alkyl group such as distearyl ketone; silicone having an alkyl group; a higher fatty acid such as stearic acid; a long chain fatty acid alcohol such as eicosanol; a carboxylic acid ester or partial ester of a polyhydric alcohol obtainable from a polyhydric alcohol such as glycerol or pentaerythritol, and a long chain fatty acid; a higher fatty acid amide such as oleic acid amide or stearic acid amide; or a low molecular weight polyester.

In order to improve the fixing property among these waxes, the melting point of wax is preferably at least 30° C., more preferably at least 40° C., particularly preferably at least 50° C. Further, it is preferably at most 100° C., more preferably at most 90° C., particularly preferably at most 80° C. If the melting point is too low, wax tends to be exposed on the surface, thus leading to stickiness, and if the melting point is too high, the fixing property at a low temperature tends to be poor. Furthermore, as a compound species of wax, an ester type wax obtainable from a fatty acid carboxylic acid and a monohydric or polyhydric alcohol, is preferred, and among ester type waxes, one having a carbon number of from 20 to 100 is preferred.

The above waxes may be used alone or in combination as a mixture. Further, the melting point of the wax compound may suitably be selected depending upon the fixing temperature to fix the toner. The amount of wax to be used, is preferably from 4 to 20 parts by weight, particularly preferably from 6 to 18 parts by weight, further preferably from 8 to 15 parts by weight, per 100 parts by weight of the toner. Usually, as the amount of wax increases, control of the aggregation tends to deteriorate, and the particle size distribution tends to be broad.

Further, in a case where the volume median diameter (Dv50) of the toner is at most 7 μm i.e. the toner has a small particle size, as the amount of wax increases, exposure of the wax on the toner surface tends to be remarkable, whereby the storage stability of the toner tends to be poor.

The toner to be used for the image forming apparatus of the present invention is a toner having a small particle size with a sharp particle size distribution, whereby the above mentioned deterioration of the toner properties is less likely to be led as compared with a conventional toner even when the amount of wax to be used is large as in the above mentioned range.

As a method for incorporating wax in the emulsion polymerization aggregation method, it is preferred to add a dispersion of wax preliminarily emulsified and dispersed in water to have a volume average diameter (Mv) of from 0.01 to 2.0 μm, more preferably from 0.01 to 0.5 μm, during the emulsion polymerization or in the aggregation step. In order to disperse wax with a preferred dispersed particle size in the toner, it is preferred to add wax as seeds at the time of the emulsion polymerization. By adding it as seeds, polymer primary particles having wax internally included will be obtained, whereby it is possible to avoid the presence of a large amount of wax at the toner surface and thereby to suppress deterioration of the heat resistance or the charging properties of the toner. Wax is employed by calculation so that the content of wax in the polymer primary particles will be preferably from 4 to 30 mass %, more preferably from 5 to 20 mass %, particularly preferably from 7 to 15 mass %.

Otherwise, wax may be contained in the fine resin particles. Also in such a case, it is preferred to add wax as seeds at the time of the emulsion polymerization in the same manner as in the case to obtain polymer primary particles. The content of wax in the entire fine resin particles is preferably smaller than the content of wax in the entire polymer primary particles. In general, when wax is contained in the fine resin particles, the fixing property will be improved, but the amount of formation of fine powder tends to be large. The reason is considered to be such that the fixing property will be improved as the transfer rate of wax to the toner surface becomes high upon receipt of heat, but the particle size distribution of the fine resin particles will be broadened by the incorporation of wax in the fine resin particles, whereby the control of aggregation tends to be difficult, thus leading to an increase of fine powder.

To the toner to be used in the present invention, a charge-controlling agent may be incorporated to control the electrostatic charge or to impart the charge stability. As such a charge-controlling agent, a known compound may be used. It may, for example, be a metal complex of a hydroxycarboxylic acid, a metal complex of an azo compound, a naphthol compound, a metal compound of a naphthol compound, a nigrosine dye, a quaternary ammonium salt or a mixture thereof. The amount of the charge-controlling agent to be incorporated, is preferably within a range of from 0.1 to 5 parts by weight per 100 parts by weight of the resin.

In a case where a charge-controlling agent is to be incorporated to the toner in the emulsion polymerization aggregation method, the charge-controlling agent may be incorporated by such a method wherein it is incorporated together with the polymerizable monomers, etc. at the time of the emulsion polymerization; it is incorporated in the aggregation step together with the polymer primary particles, the colorant, etc.; or it is incorporated after the polymer primary particles, the colorant, etc. are aggregated to a particle size suitable for a toner. Among them, it is preferred that the charge-controlling agent is emulsified and dispersed in water by means of an emulsifying agent and is used in the form of an emulsion with a volume average diameter (Mv) of from 0.01 μm to 3 μm. Incorporation of the dispersion of the charge-controlling agent at the time of the emulsion aggregation is carried out by calculation so that it will be from 0.1 to 5 mass % in the finally obtained toner matrix particles after the aggregation.

The volume average diameters (Mv) of the polymer primary particles, the fine resin particles, the colorant particles, the wax particles, the particles of the charge-controlling agent, etc. in the above dispersion are measured by using Nanotrac by the method disclosed in Examples and are defined to be the measured values.

In the aggregation step in the emulsion polymerization aggregation method, the above-described blend components such as the polymer primary particles, the fine resin particles, the colorant particles, the optional charge-controlling agent, wax, etc., may be mixed simultaneously or successively. However, it is preferred that dispersions of the respective components, i.e. a polymer primary particle dispersion, a fine resin particle dispersion, a colorant particle dispersion, a charge-controlling agent dispersion, a fine wax particle dispersion, etc., are preliminarily prepared, respectively, from the viewpoint of the uniformity of the composition and the uniformity of the particle size.

Further, when such different types of dispersions are to be mixed, the aggregation rates of components, contained in the respective dispersions are different, and in order to carry out the aggregation uniformly, it is preferred to mix them continuously or intermittently by taking time to some extent. A suitable time required for the addition varies depending upon the amounts, the solid content concentrations, etc. of the dispersions to be mixed, and it is preferably suitably adjusted. For example, when a colorant particle dispersion is to be mixed to a polymer primary particle dispersion, it is preferred to take a time of at least 3 minutes for the addition. Likewise, also in a case where a fine resin particle dispersion is to be mixed to the core particles, it is preferred to take a time of at least 3 minutes for the addition.

The above aggregation treatment may be carried out usually in an agitation tank by a method of heating, a method of adding an electrolyte, a method of reducing the concentration of an emulsifier in the system or a method of a combination thereof. In a case where particulate aggregates having substantially the same size as the toner are to be obtained by aggregating the polymer primary particles with stirring, the particle size of the particulate aggregates is controlled by the balance between the cohesive force of the particles to one another and the shearing force by agitation, and the cohesive force can be increased by the above method.

In a case where an electrolyte is added for the aggregation, the electrolyte may be an organic salt or an inorganic salt. Specifically, it may be an organic salt having a monovalent metal cation, such as NaCl, KCl, LiCl, $Na_2SO_4$, $K_2SO_4$, $Li_2SO_4$, $CH_3COONa$, or $C_6H_5SO_3Na$; an inorganic salt having a bivalent metal cation such as $MgCl_2$, $CaCl_2$, $MgSO_4$, $CaSO_4$ or $ZnSO_4$; or an inorganic salt having a trivalent metal cation such as $Al_2(SO_4)_3$ or $Fe_2(SO_4)_3$. Among them, it is preferred to use an inorganic salt having a bivalent or higher polyvalent metal cation, from the viewpoint of the productivity as the aggregation rate will be high. On the other hand, however, the amount of the polymer primary particles not taken into the core particles tends to increase, and consequently, fine powder not reaching to the desired particle size is likely to be formed. Accordingly, it is preferred to use an inorganic salt having a monovalent metal cation with an aggregation action being not so strong, with a view to suppressing formation of the fine powder.

The amount of the electrolyte to be used may vary depending upon the type of the electrolyte, the desired particle size, etc., but it is usually from 0.05 to 25 parts by weight, preferably from 0.1 to 15 parts by weight, further preferably from 0.1 to 10 parts by weight, per 100 parts by weight of the solid component of the mixed dispersion. If the amount is less than the above range, a problem may result such that the progress of the aggregation reaction tends to be slow, a fine powder of 1 μm or less may remain after the aggregation reaction, or the average particle size of the obtained particulate aggregates does not reach the desired particle size. If it exceeds the above range, there may be a problem such that aggregation tends to be rapid, whereby control of the particle size tends to be difficult, and coarse powder or irregularly shaped particles are likely to be contained in the obtained core particles.

Further, as a method for adding the electrolyte, it is preferred to add it intermittently or continuously by taking time to some extent, without adding it all at once. The time for such addition may vary depending upon the amount, etc., but more preferably, it is added by taking a time of at least 0.5 minute. Usually, as soon as the electrolyte is added, aggregation starts rapidly, whereby a large amount of polymer primary particles, colorant particles or their aggregates tend to remain without being aggregated, and they are considered to be a cause for formation of fine powder. By the above mentioned operation, uniform aggregation can be carried out without bringing about rapid aggregation, whereby formation of fine powder can be prevented.

The final temperature in the aggregation step of carrying out the aggregation by adding the electrolyte is preferably from 20 to 70° C., more preferably from 30 to 60° C. Here, to control the temperature before the aggregation step is one of the methods for controlling the particle size to be within the specific range of the present invention. Among colorants to be added in the aggregation step, there are some which induce aggregation like the above described electrolyte, and aggregation may sometimes be carried out without adding an electrolyte. Therefore, at the time of mixing the colorant dispersion, the temperature of the polymer primary particle dispersion may preliminarily be lowered by cooling, whereby the above mentioned aggregation can be prevented. Such aggregation will be a cause for formation of fine powder.

In the present invention, the polymer primary particles are preferably preliminarily cooled to a range of from 0 to 15° C., more preferably from 0 to 12° C., further preferably from 2 to 10° C. This method is effective not only in a case where aggregation is carried out by adding an electrolyte but also may be used for a method of carrying out aggregation without adding an electrolyte, for example, by controlling the pH or by adding a polar organic solvent such as an alcohol, and thus, this method is not particularly limited to the aggregation method.

The final temperature in the aggregation step in a case where the aggregation is carried out by heating, is usually within a temperature range of from (Tg-20° C.) to Tg of the polymer primary particles, preferably within a range of from (Tg-10° C.) to (Tg-5° C.).

Further, as a method for preventing rapid aggregation to prevent formation of fine powder, there is a method of adding e.g. deionized water. By the method of adding e.g. deionized water, the aggregation action is not so strong as compared with the method of adding an electrolyte, and accordingly, it is not a method which is positively adopted from the viewpoint of the production efficiency, and it rather tends to bring about a demerit such that in the subsequent filtration step, a large amount of a filtrate will be obtained. However, in a case where a delicate control of aggregation is required as in the present invention, such a method is very effective. Further, in the present invention, it is preferred to adopt it in combination with the above mentioned method of heating or the method of adding the electrolyte. Here, a method of adding deionized water after adding the electrolyte is particularly preferred in that aggregation can thereby easily be controlled.

The time required for aggregation is optimized by the shape of the apparatus or the treatment scale.

However, in order to let the particle size of the toner matrix particles reach the desired particle size, the time from a temperature lower by 8° C. than the temperature for the operation to terminate the aggregation step, e.g. the temperature for the operation to stop growth of core particles, for example, by the addition of an emulsifying agent or control of the pH (hereinafter referred to as the aggregation final temperature) to the aggregation final temperature, is adjusted to be at least 30 minutes, more preferably at least one hour. By adjusting such time to be long, the remaining polymer primary particles, colorant particles or their aggregates will be taken into the desired core particles without being left, or they will be aggregated one another to form the desired core particles.

In the present invention, fine resin particles may be coated (deposited or fixed) on the surface of core particles, as the case requires, to form toner matrix particles. The volume average diameter (Mv) of fine resin particles is preferably from 0.02 μm to 3 μm, more preferably from 0.05 μm to 1.5 μm. Usually, use of such fine resin particles accelerates formation of fine powder which does not reach the prescribed toner particle size. Accordingly, in a conventional toner covered by the fine resin particles, the amount of fine powder not reaching the prescribed toner particle size will increase.

In the present invention, when the amount of wax incorporated, is increased, the high temperature fixing property may be improved, but wax tends to be exposed on the toner surface, whereby the electrostatic property or heat resistance may sometimes deteriorate, but such deterioration of the performance can be prevented by covering the surface of core particles with fine resin particles containing no wax.

However, in a case where wax is incorporated to the fine resin particles for the purpose of improving the high temperature fixing property, the fine resin particles once deposited on the surface of the core particles, tend to peel off. The reason may be such that the above described particle size distribution of the resin fine particles will be broad, whereby resin fine particles having a large particle size with a weak cohesive force will be present. Therefore, in order to reduce such peel off, it is preferred to raise the temperature while adding an aqueous solution having a dispersion stabilizer and water preliminarily mixed, to the liquid wherein particles having fine resin particles deposited on the surface, are dispersed.

In a case where "a step of initiating the temperature raise after addition of an emulsifier" as a conventional method, is employed, i.e. in a case where an aging step is carried out after rapidly lowering the cohesive force, the fine resin particles once deposited tend to be detached due to an abrupt decrease of the cohesive force. Accordingly, it is preferred that without lowering the cohesive force so much and while suppressing the particle size growth, the fine resin particles are deposited and fused.

In the emulsion polymerization aggregation method, in order to increase the stability of particulate aggregates obtained by aggregation, it is preferred that after stopping the growth of toner particles by lowering the cohesive force of particles by adding an emulsifier or a pH-controlling agent as a dispersion stabilizer, an aging step is added to let aggregated particles fuse to one another.

The amount of the emulsifier to be incorporated is not particularly limited, but it is preferably at least 0.1 part by weight, more preferably at least 1 part by weight, further preferably at least 3 parts by weight, and preferably at most 20 parts by weight, more preferably at most 15 parts by weight, further preferably at most 10 parts by weight, per 100 parts by weight of the solid components in the mixed dispersion. By adding an emulsifier or increasing the pH value of the aggregated liquid during a period from the aggregation step to the completion of the aging step, it is possible to suppress aggregation or the like of the particulate aggregates obtained by aggregation in the aggregation step and to suppress formation of coarse particles in the toner after the aging step.

Here, as a method for controlling a small particle size toner to be used for the image forming apparatus of the present invention to a particle size within a specific range which means a sharp particle size distribution, a method may be mentioned to lower the agitation rotational speed before the step of adding an emulsifier or a pH-controlling agent i.e. to lower the shearing force by agitation. This method is preferably employed for a system where the cohesion is weak, for example, when an emulsifier or a pH-controlling agent is added all at once to rapidly change the system to a stable (dispersion) system. As mentioned above, in a case where a method of raising the temperature while adding an aqueous solution having a dispersion stabilizer and water preliminarily mixed, is employed, if the agitation rotational speed is lowered, the system tends to be shifted too much towards aggregation, thus leading to an increase of the particle size.

As an example, by the above method, it is possible to obtain a toner having a specific particle size distribution to be used for the image forming apparatus of the present invention. Further, by lowering this rotational speed, it is possible to control the content of fine powder particles. For example, by lowering the rotational speed from 250 rpm to 150 rpm, it is possible to obtain a small particle size toner with a particle size distribution sharper than a conventional toner, and it is possible to obtain a toner having a specific particle size distribution to be used for the image forming apparatus of the present invention. However, this value, of course, varies depending upon conditions such as (a) the diameter of the agitation tank (as a usual cylindrical shape) and the maximum diameter of stirring vanes (and their relative ratio), (b) the height of the agitation tank, (c) the circumferential speed of the forward ends of the stirring vanes, (d) the shape of the stirring vanes, (e) positions of the stirring vanes in the agitation tank, etc. Particularly, with respect to (c), the circumferential speed is preferably from 1.49 to m/sec. Within such a range, a suitable shearing speed can be imparted to the particles without leading to falling off or excessive growth.

The temperature in the aging step is preferably at least Tg of the binder resin as polymer primary particles, more preferably at least a temperature higher by 5° C. than such Tg, and preferably at most a temperature higher by 80° C. than such Tg, more preferably at most a temperature higher by 50° C. than such Tg. Further, the time required for the aging step varies depending upon the shape of the desired toner, but it is preferred that after reaching to a temperature of at least the glass transition temperature of the polymer constituting polymer primary particles, the particles are held usually for from 0.1 to 5 hours, preferably from 1 to 3 hours.

By such heat treatment, the polymer primary particles in aggregates are fused and integrated, whereby the shape of toner matrix particles as aggregates becomes close to a spherical shape. Particulate aggregates before the aging step are considered to be electrostatically or physically aggregated gathered bodies of polymer primary particles, but after the aging step, the polymer primary particles constituting the particulate aggregates are fused one another, and the shape of the toner matrix particles can be made to be close to a spherical shape. By such an aging step, it is possible to produce toners having various shapes depending upon the particular purposes, such as a grape type having polymer primary particles aggregated, a potato type having fusion advanced, and a spherical shape having fusion further advanced, by controlling the temperature, the time, etc. in the aging step.

The particulate aggregates obtained via the above respective steps are subjected to solid/liquid separation by a known method to recover the particulate aggregates, which are then washed, as the case requires, followed by drying to obtain the desired toner matrix particles.

Further, it is also possible to obtain encapsulated toner matrix particles by further forming an outer layer composed mainly of a polymer preferably in a thickness of from 0.01 to 0.5 μm on the surface of the particles obtained by the above emulsion polymerization aggregation method, for example, by such a method as a spray drying method, an in-situ method or an in-liquid particle covering method.

Further, the emulsion aggregation toner preferably has an average degree of circularity of at least 0.90, more preferably at least 0.92, further preferably at least 0.94, as measured by means of a flow particle image analyzer FPIA-2100. It is considered that as the shape is closer to a spherical shape, localization of electrostatic charge is less likely to occur, and the developability tends to be uniform. However, a completely spherical toner may deteriorate the cleaning property. Accordingly, the above average degree of circularity is preferably at most 0.98, more preferably at most 0.97.

Further, at least one of peak molecular weights in the gel permeation chromatography (hereinafter sometimes referred to simply as "GPC") of the soluble component of the toner in tetrahydrofuran (hereinafter sometimes referred to simply as "THF") is preferably at least 30,000, more preferably at least 40,000, further preferably at least 50,000 and preferably at most 200,000, more preferably at most 150,000, further preferably at most 100,000. In a case where all of the peak molecular weights are lower than the above range, the mechanical durability in a non-magnetic one component development system may sometimes deteriorate, and in a case where all of the peak molecular weights are higher than the above range, the low temperature fixing property or the fixing strength may sometimes deteriorate.

The electrification of the emulsion aggregation toner may be positive electrification or negative electrification, but it is preferably employed as a negatively electrifiable toner. Control of the electrification of the toner may be adjusted by the selection and content of a charge-controlling agent, the selection and blend amount of an auxiliary agent, etc.

It is essential that the toner to be used for the image forming apparatus of the present invention is a toner for developing an electrostatic charge image containing toner matrix particles formed in an aqueous medium; the volume median diameter (Dv50) of the toner is from 4.0 μm to 7.0 μm; and the relationship between the volume median diameter (Dv50) and the percentage in number (Dns) of toner particles having a particle diameter of from 2.00 μm to 3.56 μm satisfies the following formula (1):

$$Dns \leq 0.233\mathrm{EXP}(17.3/Dv50) \quad (1)$$

where Dv50 is the volume median diameter (μm) of the toner, and Dns is the percentage in number of toner particles having a particle diameter of from 2.00 μm to 3.56 μm.

The volume median diameter (Dv50) and Dns of the toner are measured by the methods disclosed in Examples and defined as ones measured in such a manner. In the present invention, the "toner" is one obtainable by, if necessary, incorporating an auxiliary agent, etc. which will be described hereinafter, to the "toner matrix particles". The above mentioned Dv50, etc. are Dv50, etc. of the "toner", and they are, of course, measured by using the "toner" as a sample for measurement.

Further, preferred is a toner wherein the relationship between Dv50 and Dns satisfies the following formula (1').

$$Dns \leq 0.110\mathrm{EXP}(19.9/Dv50) \quad (1')$$

In the formula (1), if the left-hand side (Dns) is larger than the right-hand side, which means the amount of a coarse powder in a specific range is substantial, image soiling or the like may sometimes occur.

Further, a toner is preferred wherein the relation between Dv50 and Dns satisfies the following formula (2):

$$0.0517\mathrm{EXP}(22.4/Dv50) \leq Dns \quad (2)$$

When Dns satisfies the above formula (1), the above mentioned effects of the present invention will be obtained, and when the formula (1') and/or the formula (2) is satisfied, a more remarkable effect will be obtained, whereby the object of the present invention can be accomplished. Here, in the formulae (1), (1') and (2), "EXP" represents "Exponential". Namely, it represents the base of natural logarithm, and its right-hand side is an exponent.

In the present invention, Dv50 of the toner is from 0.4 μm to 7.0 μm. Within this range, it is possible to present an image of high quality sufficiently. When Dv50 is at most 6.8 μm, the above effect will be more remarkable. Further, it is preferably at least 5.0 μm, more preferably at least 5.4 μm with a view to reducing the amount of fine powder to be formed. Further, a toner with Dns of at most 6% in number is preferred with a view to presenting an image of a higher image quality or to be free from soiling the image forming apparatus. Further, it is more preferred that the above formulae (1), (1') and (2) and the conditions of "Dv50 being at least 5.0 μm" and/or "Dns being at most 6% in number", are satisfied in combination.

The toner to be used for the image forming apparatus of the present invention which satisfies the above conditions of the particle size distribution, presents a high image quality and, even when a high speed printing machine is used, presents little soiling and is capable of suppressing residual images (ghosts) and blurring (blotted image follow-up properties) and excellent in cleaning properties. Further, as the particle size distribution is sharp, the electrostatic charge distribution is very sharp, whereby it is possible to avoid that small particles cause soiling of image white parts or scatter to soil the interior of the apparatus, or it is possible to avoid that particles having large electrostatic charge will deposit on members such as a layer-regulating blade, a roller, etc. without being developed, to cause image defects such as streaks or blurring.

Further, the reason for defining the particle diameter to be from 2.00 μm to 3.56 μm, for the percentage in number (Dns) of toner particles, is that the lower limit value is a measurement limit of the apparatus used to measure the toner particle diameter of the present invention, and the upper limit value is a critical value in the effect obtained from the results disclosed in Examples. Namely, if the percentage in number of toner particles including those having a particle diameter of more than 3.56 μm, is adopted, it becomes impossible to clearly divide by a formula a toner showing the effects of the present invention from the toner not showing such effects.

In order to obtain a toner satisfying the above formula (1), it is advisable to adopt an operation whereby the aggregation rate is not so high as compared with a usual operation in the aggregation step. Such an operation whereby the aggregation rate is not so high may, for example, be such that the dispersion to be used is preliminarily cooled, that the dispersion or the like is added by taking time, that an electrolyte or the like having no large aggregation action is employed, that the electrolyte is continuously or intermittently added, that the temperature raising rate is made low, or that the aggregation time is prolonged. Further, in the aging step, it is advisable to adopt an operation whereby the aggregated particles tend to be hardly re-dispersed. Such an operation whereby the aggregated particles tend to be hardly re-dispersed, may, for example, be such that the agitation rotational speed is reduced, that a dispersion stabilizer is continuously or intermittently added, or that a dispersion stabilizer and water are preliminarily mixed.

Further, it is preferred that the toner satisfying the above formula (1) is obtainable without via a step of removing particles of at most the volume median diameter (Dv50) by an operation such as classification of the finally obtained toner or toner matrix particles. To the toner matrix particles, in order to control the flowability or developability, a known auxiliary agent may be incorporated to the surface of the toner matrix particles to form a toner. The auxiliary agent may, for example, be a metal oxide or hydroxide such as alumina, silica, titania, zinc oxide, zirconium oxide, cerium oxide, talc or hydrotalcite; a titanic acid metal salt such as calcium titanate, strontium titanate or barium titanate; a nitride such as titanium nitride or silicon nitride; a carbide such as titanium carbide or silicon carbide; or organic particles of e.g. an acrylic resin or a melamine resin, and a plurality of them may be used in combination. Among them, silica, titania or alumina is preferred, and one surface-treated with e.g. a silane coupling agent or silicone oil is more preferred. The average primary particle size thereof is preferably within a range of from 1 to 500 nm, more preferably within a range of from 5 to 100 nm. Further, within such a particle size range, one having a small particle size and one having a large particle size may preferably be used in combination. The total amount of auxiliary agents is preferably within a range of from 0.05 to 10 parts by weight, more preferably from 0.1 to 5 parts by weight, per 100 parts by weight of the toner matrix particles.

The toner in the present invention having the above particle size distribution, obtained by the above method, has an electrostatic charge distribution which is very sharp as compared with conventional toners. The electrostatic charge distribution is interrelated with the particle size distribution, and in a case where a toner has a broad particle size distribution like a conventional toner, its electrostatic charge distribution will also be broad. If the electrostatic charge distribution becomes broad, the proportion of particles electrified too low or too high tends to increase to such an extent that it can hardly be controlled under the developing conditions of the apparatus for the toner, thus causing various image defects. For example, particles having less electrostatic charge tend to bring about soiling of image white parts or scatter in the apparatus to cause soiling, and particles having higher electrostatic charge tend to accumulate on a component such as a layer-regulating blade or a roller in the developer tank without being developed and tends to cause image defects such as streaks or blurring by fusion.

In a design of a developing process for the image forming apparatus, the developing process conditions are set to be suitable for the average value of the electrostatic charge of the toner, and a toner having an electrostatic charge which is far off the average value is likely to bring about scattering or image defects such as streaks or blurring by such an image forming apparatus, and thus, its matching with the apparatus is poor. However, when the electrostatic charge distribution is sharp as in the present invention, it becomes possible to control the developability by e.g. adjusting the bias, and it will be possible to present a clear image without soiling a component of the image forming apparatus.

The "standard deviation of the electrostatic charge" as one of the numerical values showing the "electrostatic charge distribution" of a toner to be used for the image forming apparatus of the present invention is preferably from 1.0 to 2.0, more preferably from 1.0 to 1.8, further preferably from 1.0 to 1.5. If the standard deviation exceeds the above upper limit value, there is sometimes an unfavorable case such that the toner tends to be deposited on the layer-regulating blade and tends to be hardly transported, and the deposited toner is likely to block the toner to be further transported, and may soil a component within the image forming apparatus. Further, in a case where the standard deviation is less than the above lower limit value, such may sometimes be undesirable from the industrial viewpoint. The lower limit value is preferably at least 1.3.

The toner to be used for the image forming apparatus of the present invention may be used for any of a magnetic two-component developer having a carrier co-existent to transport the toner to an electrostatic latent image portion by a magnetic force, a magnetic one component developer having a magnetic powder incorporated to the toner, or a non-magnetic one component developer using no magnetic powder for the developer. However, in order to obtain the effect of the present invention distinctly, it is particularly preferably employed for a developer for a non-magnetic one component developing system.

In the case of the above mentioned magnetic two component developer, as the carrier to be mixed with the toner to form the developer, it is possible to employ a known magnetic substance such as an iron powder type, ferrite type or magnetite type carrier, or one having a resin coating applied on the surface thereof, or a magnetic resin carrier. As the coating resin for the carrier, a commonly known styrene resin, acrylic resin, styrene/acrylic copolymer resin, silicone resin, modified silicone resin or fluorinated resin may, for example, be used, but the coating resin is not limited thereto. The average particle size of the carrier is not particularly limited, but it is usually preferably one having an average particle size of from 10 to 20 μm. Such a carrier is preferably used in an amount of from 5 to 100 parts by weight per one part by weight of the toner.

Construction of Electrophotographic Photoreceptor

The image forming apparatus of the present invention has an electrophotographic photoreceptor having a specific photosensitive layer formed on an electroconductive substrate, or having the surface state of an electroconductive substrate limited to be a specific one.

Electroconductive Substrate

As the electroconductive substrate to be used for the photoreceptor, a metal material such as aluminum, an aluminum alloy, stainless steel, copper or nickel; a resin material having electrical conductivity imparted by an application of an electroconductive powder of e.g. a metal, carbon or tin oxide; or a resin, glass or paper having an electroconductive material such as aluminum, nickel or ITO (indium oxide/tin oxide) vapor-deposited or coated on its surface, is mainly employed. As to the shape, one of drum-shape, sheet-shape or belt-shape may, for example, be employed. It may further be one having an electroconductive substrate made of a metal material coated with an electroconductive material having a proper resistance in order to cover defects or to control the electroconductivity or the surface properties.

In a case where a metal material such as an aluminum alloy is to be used for the electroconductive substrate, it is preferably employed after applying an anodic oxide coating. In a case where an anodic oxide coating is applied, it is preferred to apply sealing treatment by a known method.

For example, such an anodic oxide coating may be formed by anodizing in an acidic bath of e.g. chromic acid, sulfuric acid, oxalic acid, boric acid or sulfamic acid. However, anodizing in sulfuric acid is preferred, since it presents better results. In the case of anodic oxidation in sulfuric acid, it is preferred that the sulfuric acid concentration is set to be from 100 to 300 g/L, the dissolved aluminum concentration is set to be from 2 to 15 g/L, the liquid temperature is set to be from 15 to 30° C., the electrolysis voltage is set to be from 10 to 20 V, and the current density is set within a range of from 0.5 to 2 $A/dm^2$, but the anodizing conditions are not limited thereto.

To the anodic oxide coating thus formed, it is preferred to apply sealing treatment. The sealing treatment may be carried out by a known method, and for example, a low temperature sealing treatment by immersion in an aqueous solution containing nickel fluoride as the main component, or a high temperature sealing treatment by immersion in an aqueous solution containing nickel acetate as the main component, is preferred.

The concentration of the nickel fluoride aqueous solution to be used in the case of the above low temperature sealing treatment may suitably be selected, but when it is within a range of from 3 to 6 g/L, better results are obtainable. Further, in order to carry out the sealing treatment smoothly, it is preferred to carry out the treatment at a treating temperature of from 25 to 40° C., preferably from 30 to 35° C. and at a pH of the nickel fluoride aqueous solution within a range of from 4.5 to 6.5, preferably from 5.5 to 6.0. As a pH-controlling agent, oxalic acid, boric acid, formic acid, acetic acid, sodium hydroxide, sodium acetate or aqueous ammonia may, for example, be used. With respect to the treating time, it is preferred to carry out the treatment within a range of from 1 to 3 minutes per 1 μm in thickness of the coating. Further, in order to further improve the physical properties of the coating, cobalt fluoride, cobalt acetate, nickel sulfate, a surfactant or the like may be added to the nickel fluoride aqueous solution. Then, washing with water and drying are carried out to complete the low temperature sealing treatment.

As the sealing agent in the case of the above mentioned high temperature sealing treatment, an aqueous solution of a metal salt such as nickel acetate, cobalt acetate, lead acetate, nickel/cobalt acetate or barium nitrate may be used, but it is particularly preferred to employ nickel acetate. In the case of using a nickel acetate aqueous solution, it is preferably used at a concentration within a range of from 5 to 20 g/L. It is preferred to carry out the treatment at a treating temperature of from 80 to 100° C., preferably from 90 to 98° C. and at a pH of the nickel acetate aqueous solution within a range of from 5.0 to 6.0. Here, as a pH-controlling agent, aqueous ammonia or sodium acetate may, for example, be used. The treatment is preferably carried out for a treating time of at least 10 minutes, preferably at least 20 minutes. Further, also in this case, in order to improve the physical properties of the coating, sodium acetate, an organic carboxylic acid, an anionic surfactant, a nonionic surfactant or the like, may be added to the nickel acetate aqueous solution. Then, washing with water and drying are carried out to complete the high temperature sealing treatment.

In a case where the average coating thickness is thick, stronger sealing conditions are required by a higher concentration of the sealing liquid or treatment at a higher temperature or longer time. Accordingly, the productivity tends to be poor, and surface defects such as smear, stain or flouring tend to be formed on the surface of the coating. For such a reason, the average thickness of the anodic oxide coating is usually preferably at most 20 μm, particularly preferably at most 7 μm.

The surface of the substrate may be smooth or may be roughened by using a special cutting method or by applying grinding treatment. Further, it may be one surface-roughened by incorporating particles having a proper particle size to a material constituting the substrate. Further, to reduce the cost, a drawn tube may be used as it is i.e. without subjecting it to cutting treatment. It is particularly preferred to use an aluminum substrate prepared by non-cutting work such as drawing, impact extrusion or squeegeeing, since by such treatment stains, attachments such as foreign substances or scratch marks present on the surface will be removed, and a uniform clean substrate will be obtained. Specifically, the electroconductive substrate is preferably such that its surface roughness Ra is from 0.01 μm to 0.3 μm. If Ra is less than 0.01 μm, the adhesive property tends to be poor, and if it exceeds 0.3 μm, image defects such as black spots may sometimes occur. Ra is most preferably in a range of from 0.01 to 0.20 μm.

Measuring Method and Definition of Surface Roughness Ra

The surface roughness Ra means arithmetic average roughness and represents a mean value of absolute value deviations from a mean line. Specifically, it is a value obtained in such a manner that from a roughness curve, a reference length is withdrawn in its mean line direction, and absolute values of deviations from the mean line to the measured curve of this withdrawn portion, are totaled and averaged. As such Ra a value measured by a surface roughness meter (SURFCOM 570A, manufactured by TOKYO SEIMITSU CO., LTD.) is employed. However, other measuring instruments may be employed so long as they are measuring instruments giving the same results within an error range.

The processing method to bring the surface roughness of the electroconductive substrate to be within the above mentioned range, may, for example, be a method of grinding and roughening the surface of the substrate by a cutting tool, etc., a method of sandblasting by letting fine particles impinge on the surface of the substrate, a processing method by an ice-particle cleaning device disclosed in JP-A-4-204538, or a horning method disclosed in JP-A-9-236937. Further, an anodizing or alumite treatment method, a buffing method, a method by a laser ablation method disclosed in JP-A-4-233546, a method by an abrasive tape disclosed in JP-A-8-1502 or a roller varnishing method disclosed in JP-A-8-1510 may, for example, be mentioned. However, the method for roughening the surface of the substrate is not limited to such examples.

As the electroconductive material, a metal drum of e.g. aluminum or nickel; a plastic drum having aluminum, tin oxide, indium oxide or the like vapor-deposited; or a paper/plastic drum coated with an electroconductive substance may, for example, be used. As the material for the electroconductive substrate, one having a specific resistance of at most $10^3$ Ωcm at room temperature is preferred.

Undercoat Layer

The photoreceptor to be used for the image forming apparatus of the present invention preferably contains an undercoat layer. This undercoat layer preferably comprises a binder resin and metal oxide particles having a refractive index of at most 2.0. Further, it is preferred that the volume average particle diameter of secondary particles of metal oxide aggregates in a liquid having the undercoat layer dispersed in a solvent having methanol and 1-propanol mixed in a weight ratio of 7:3 is at most 0.1 μm, and the cumulative 90% particle diameter is at most 0.3 μm. More preferably, the volume average particle diameter is at most 0.09 μm, and the cumulative 90% particle diameter is at most 0.2 μm. Further, if the volume average particle diameter is too small, cleaning failure or soiling of apparatus may sometimes be caused. Therefore, the volume average particle diameter is preferably at least 0.01 μm, and the cumulative 90% particle diameter is at least 0.05 μm.

Metal Oxide

In the present invention, the undercoat layer preferably contains metal oxide particles. As the metal oxide particles, any metal oxide particles which are commonly useful for electrophotographic photoreceptors, may be used. More specifically, the metal oxide particles may, for example, be preferably particles of a metal oxide containing one metal element such as titanium oxide, aluminum oxide, silicon oxide, zirconium oxide, zinc oxide or iron oxide; or particles of a metal oxide containing plural metal elements such as calcium titanate, strontium titanate or barium titanate. Among them, metal oxide particles having a band gap of from 2 eV to 4 eV are preferred. The metal oxide particles may be used in a single type of particles or in combination as a mixture of a plural types of particles. Among these metal oxide particles, titanium oxide, aluminum oxide, silicon oxide or zinc oxide is preferred; titanium oxide or aluminum oxide is more preferred; and titanium oxide is particularly preferred.

As the crystal form of titanium oxide particles, any of rutile, anatase, brookite, amorphous may be used. Further, among such different crystal forms, a plurality of crystal forms may be contained in combination.

Various surface treatment may be applied to the surface of the metal oxide particles. For example, treatment with an inorganic substance such as tin oxide, aluminum oxide, antimony oxide, zirconium oxide or silicon oxide or with an organic substance such as stearic acid, a polyol or an organic silicone compound, may be applied. Particularly in a case where titanium oxide particles are to be employed, they are preferably surface-treated with an organic silicone compound. The organic silicone compound is usually a silicone oil such as dimethylpolysiloxane or methyl hydrogen polysiloxane; an organosilane such as methyldimethoxysilane or diphenyldimethoxysilane; a silazane such as hexamethyldisilazane; or a silane coupling agent such as vinyltrimethoxysilane, γ-mercaptopropyltrimethoxysilane or γ-aminopropyltriethoxysilane, but a silane treating agent represented by the structure of the following formula (1) has a good reactivity with the metal oxide particles and is the most suitable treating agent.

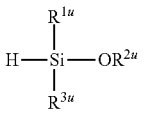

(C)

In the formula (c), each of $R^{1u}$ and $R^{2u}$ which are independent of each other, is an alkyl group, more specifically a methyl group or an ethyl group. $R^{3u}$ is an alkyl group or an alkoxy group, more specifically at least one group selected from the group consisting of a methyl group, an ethyl group, a methoxy group and an ethoxy group. Here, the outermost surface of particles thus surface-treated, are treated with such a treating agent, but before such treatment, the surface may be preliminarily treated with a treating agent such as aluminum oxide, silicon oxide or zirconium oxide. The titanium oxide particles may be used in one type of particles or in combination as a mixture of plural types of particles.

As the metal oxide particles to be used, ones having an average primary particle diameter of at most 500 nm are usually used, preferably ones of from 1 nm to 100 nm are used, and more preferably ones of from 5 to 50 nm are used. This average primary particle diameter can be obtained by an arithmetic average value of particle diameters directly observed by a transmission electron microscope (hereinafter sometimes referred to as "TEM").

Further, as the metal oxide particles to be used, ones having various refractive indices may be used. Any ones may be used so long as they are commonly useful for electrophotographic photoreceptors. Preferably, ones having a refractive index of at least 1.4 and at most 3.0 are used. The refractive indices of metal oxide particles are disclosed in various publications, but for example, according to Filler Katsuyo Jiten (compiled by Filler Research Association, published by TAISEISHA, LTD., 1994), they are as in the following Table 1.

TABLE 1

| | Refractive index |
|---|---|
| Titanium oxide (rutile form) | 2.76 |
| Lead titanate | 2.70 |
| Potassium titanate | 2.68 |
| Titanium oxide (anatase form) | 2.52 |
| Zirconium oxide | 2.40 |
| Zinc sulfide | 2.37 to 2.43 |
| Zinc oxide | 2.01 to 2.03 |
| Magnesium oxide | 1.64 to 1.74 |
| Barium sulfate (precipitated) | 1.65 |
| Calcium sulfate | 1.57 to 1.61 |
| Aluminum oxide | 1.56 |
| Magnesium hydroxide | 1.54 |
| Calcium carbonate | 1.57 to 1.60 |
| Quartz glass | 1.46 |

Among such metal oxide particles of the present invention, specific tradenames of titanium oxide particles may, for example, be "TTO-55(N)" ultrafine particulate titanium oxide having no surface treatment applied, "TTO-55(A)", "TTO-55(B)" ultrafine particulate titanium oxide having $Al_2O_3$ coating applied, "TTO-55(C)" ultrafine particulate titanium oxide having surface treatment applied with stearic acid, "TTO-55(S)" ultrafine particulate titanium oxide having surface treatment applied with $Al_2O_3$ and organosiloxane, "CR-EL" high purity titanium oxide, "R-550", "R-580", "R-630", "R-670", "R-680", "R-780", "A-", "A-", "W-10" sulfuric acid method titanium oxide, "CR-50", "CR-58", "CR-60", "CR-60-2", "CR-67" chlorine method titanium oxide, "SN-100P", "SV-D", "ET-300W" electroconductive titanium oxide (respectively manufactured by Ishihara Sangyo Kaisha, Ltd.), "R-60", "A-", "A-", etc. titanium oxide, "SR-1", "R-GL", "R5—N", "R-5N-2", "R-52N", "RK-1", "A-SP" having $Al_2O_3$ coating applied, "R-GX", "R-7E", having $SiO_2$ and $Al_2O_3$ coating applied, "R-650" having ZnO, $SiO_2$ and $Al_2O_3$ coating applied, "R-61N" having $ZrO_2$ and $Al_2O_3$ coating applied (respectively manufactured by Sakai Chemical Industry Co., Ltd.), "TR-700" surface-treated with $SiO_2$ and $Al_2O_3$, "TR-840" "TA-500" surface-treated with ZnO, $SiO_2$ and $Al_2O_3$, "TA-100", "TA-200", "TA-300", etc. titanium oxide having no surface treatment applied, "TA-400" surface-treated with $Al_2O_3$ (respectively manufactured by Fuji Titanium Industry Co., Ltd.), "MT-150 W", "MT-500B" having no surface treatment applied, "MT-100SA", "MT-500SA" surface-treated with $SiO_2$ and $Al_2O_3$, "MT-100SAS", "MT-500SAS" surface-treated with $SiO_2$, $Al_2O_3$ and organosiloxane (manufactured by Tayca Corporation), etc.

Further, as a specific tradename of aluminum oxide particles, "Aluminium Oxide C" (manufactured by Nippon Aerosil Co., Ltd.) may, for example, be mentioned.

Further, as a specific tradename of silicon oxide particles, "200CF", "R972" (manufactured by Nippon Aerosil Co., Ltd.) or "KEP-30" (manufactured by Nippon Shokubai Co., Ltd.) may, for example, be mentioned. Further, as a specific tradename of tin oxide particles, "SN-100P" (manufactured by Ishihara Sangyo Kaisha, Ltd.) may, for example, be mentioned. As a specific tradename of zinc oxide particles, "MZ-305S" (manufactured by Tayca Corporation) may be mentioned.

The metal oxide particles useful in the present invention are not limited to the above specific tradenames, in any case.

In the coating fluid for forming an undercoat layer of the electrophotographic photoreceptor in the present invention, it is preferred to use the metal oxide particles within a range of from 0.5 part by weight to 4 parts by weight, per one part by weight of the binder resin.

Binder Resin

The binder resin to be used in the undercoat layer is not particularly limited so long as it is soluble in an organic solvent which is commonly used in a coating fluid for forming an undercoat layer of an electrophotographic photoreceptor, and the undercoat layer after the formation is insoluble or hardly soluble to be substantially not mixed in an organic solvent to be used for a coating fluid for forming a photosensitive layer.

As such a binder resin, a resin such as phenoxy, epoxy, polyvinylpyrrolidone, polyvinyl alcohol, casein, a polyacrylic acid, a cellulose, gelatin, starch, polyurethane, polyimide or polyamide may be used as cured alone or together with a curing agent. Among them, a polyamide resin, particularly a polyamide resin such as an alcohol-soluble copolymer polyamide or a modified polyamide, is preferred as it shows good dispersibility and coating properties.

The polyamide resin may, for example, be an alcohol-soluble nylon resin, such as a so-called copolymerized nylon having e.g. 6-nylon, 66-nylon, 610-nylon, 11-nylon or 12-nylon copolymerized, or a type having nylon chemically modified such as an N-alkoxymethyl-modified nylon or an N-alkoxyethyl-modified nylon. A specific tradename may, for example, be "CM4000", "CM8000" (respectively manufactured by Toray Industries, Inc.), "F-30K", "MF-30", "EF-30T" (respectively manufactured by Nagase ChemteX Corporation).

Among these polyamide resins, a copolymerized polyamide resin containing a diamine represented by the following formula (D) as a constituting component, is particularly preferably employed.

(D)

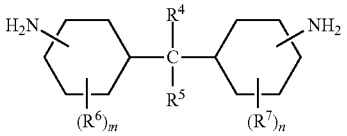

In the above formula (D), each of $R^4$ to $R^7$ which are independent of one another, is a hydrogen atom or an organic substituent, and each of m and n which are independent of each other, is an integer of from 0 to 4, provided that when there are a plurality of substituents, such substituents may be the same or different. The organic group for each of $R^4$ to $R^7$ is preferably a hydrocarbon group having at most 20 carbon atoms, which may contain a heteroatom, more preferably an alkyl group such as a methyl group, an ethyl group, a n-propyl group or an isopropyl group; an alkoxy group such as a methoxy group, an ethoxy group, a n-propoxy group or an isopropoxy group; or an aryl group such as a phenyl group, a naphthyl group, an anthryl group or a pyrenyl group, more preferably an alkyl group or an alkoxy group. Particularly preferred is a methyl group or an ethyl group.

The copolymerized polyamide resin containing the diamine of the above formula (D) as a constituting component may further be a binary, ternary or quaternary copolymerized one by further combining e.g. a lactam such as γ-butyrolactam, ϵ-caprolactam or lauryllactam; a dicarboxylic acid such as 1,4-butanedicarboxylic acid, 1,12-dodecanedicarboxylic acid or 1,20-icosane dicarboxylic acid; a diamine such as 1,4-butanediamine, 1,6-hexamethylenediamine, 1,8-octamethylenediamine or 1,12-dodecanediamine; or piperazine. Such a copolymerized ratio is not particularly limited, but usually, the diamine component of the above formula (D) is from 5 to 40 mol %, preferably from 5 to 30 mol %.

The number average molecular weight of the copolymerized polyamide is preferably from 10,000 to 50,000, particularly preferably from 15,000 to 35,000. If the number average molecular weight is too small or too large, it tends to be difficult to maintain the uniformity of the film.

The method for producing the copolymerized polyamide is not particularly limited, and a usual polycondensation method for a polyamide may suitable be used, and a melt polymerization method, a solution polymerization method or an interface polymerization method may, for example, be employed. Further, at the time of the polymerization, a monobasic acid such as acetic acid or benzoic acid, or a monoacid base such as hexylamine or aniline may be added as a molecular weight-adjusting agent without any problem.

Further, a thermal stabilizer represented by sodium phosphite, sodium hypophosphite, phosphorous acid, hypophosphorous acid or hindered phenol, or other polymerization additives may be added. Specific examples of the copolymerized polyamide to be suitably used in the present invention, will be shown below. Here, in the specific examples, the copolymerized ratios represent the charged ratios (mol ratios) of monomers.

Specific Examples of Polyamide

1

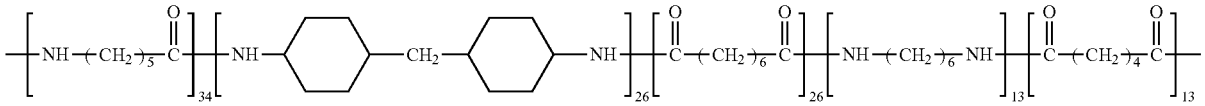

2

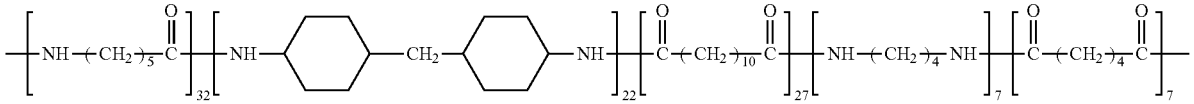

3

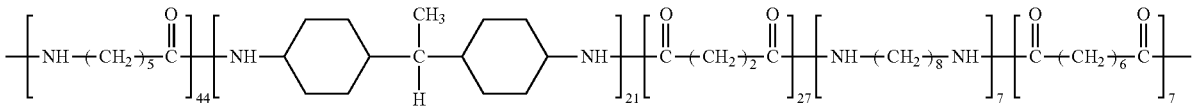

4

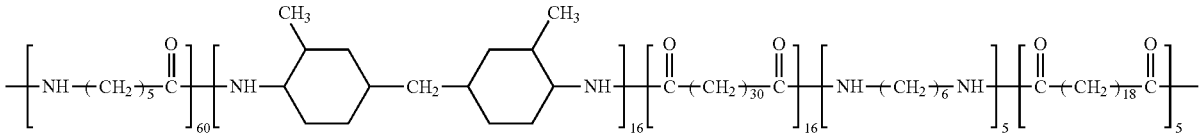

5

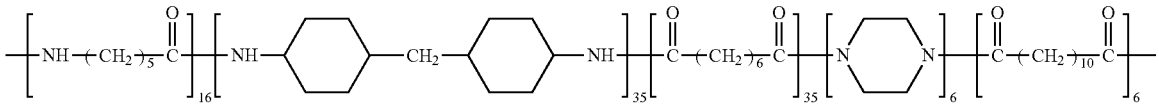

-continued

6

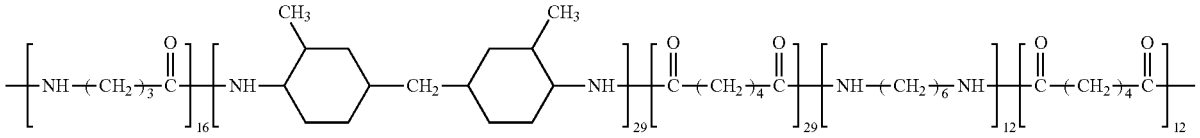

7

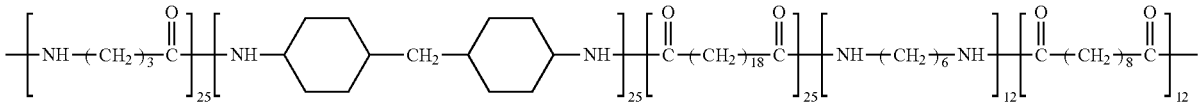

Further, it is preferred to incorporate at least one curable resin to the electrophotographic photoreceptor to be used for the image forming apparatus of the present invention. Particularly preferably, it is used for the undercoat layer. As such a curable resin, it is preferred to use a thermosetting resin, a photo-curable resin, an electron-beam (EB) curable resin or the like. In either case, after the coating, a reaction takes place e.g. in the polymer, and crosslinking takes place, whereby the polymer will be cured.

Here, specific examples of the curable resin will be described. The thermosetting resin is a general term for a type of a resin which undergoes a chemical reaction by heat and cures. Specifically, it may, for example, be a phenol resin, an urea resin, a melamine resin, an epoxy resin cured product, an urethane resin or an unsaturated polyester resin. Further, it is also possible to introduce a thermosetting substituent to a usual thermoplastic polymer to make it thermosetting. Generally, it may be called also as a condensation type crosslinked polymer or an addition type crosslinked polymer and is a polymer having a three dimensionally cross-linked structure. Usually, in its production, in the curable resin, as the time passes, the reaction proceeds, and the conversion and molecular weight increase, whereby the elastic modulus increases, the specific volume decreases, and the solubility in a solvent substantially decreases.

Now, a usual thermosetting resin will be described. A phenol resin is a synthetic resin made of a phenol and formaldehyde and has a merit that it is inexpensive and can be easily molded. Usually, by a reaction of a phenol (P) and formaldehyde (F), under an acidic condition, one having a F/P molar ratio of from about 0.6 to 1 may be obtained, and with a basic catalyst, a resin having a F/P molar ratio of from about 1 to 3 will be formed.

Whereas, an urea resin is a synthetic resin prepared by reacting urea and formalin and has a merit that it is a colorless transparent solid and can be freely colored. Usually, by a reaction of urea and formaldehyde, under an acidic condition, a polymethyleneurea having no methylol group will be formed, and in a basic condition, a mixture of methylolureas will be obtained.

A melamine resin is a thermosetting resin obtainable by a reaction of a melamine derivative and formaldehyde and has a merit that, although it is expensive than the urea resin, it is excellent in hardness, water resistance and heat resistance, and yet, it is colorless transparent and can be freely colored, and it is excellent for lamination or adhesion.

An epoxy resin is a general term for a thermosetting resin which can be cured by graft polymerization with epoxy groups remaining in the polymer. A prepolymer before the graft polymerization and a curing agent are mixed to carry out thermosetting treatment thereby to obtain a product. Both of such a prepolymer and the resin produced are called epoxy resins. The prepolymer is usually a liquid compound having at least two epoxy groups per molecule. Such a prepolymer will be reacted (mainly polyaddition) with various curing agents to form a three dimensional polymer thereby to form a cured product of epoxy resin. A cured product of epoxy resin has good adhesion and bonding properties and is excellent in heat resistance, chemical resistance and electrical stability. A common epoxy resin is a glycidyl ether type of bisphenol A, but as others, a resin of glycidyl ester type or glycidyl amine type, and a cyclic aliphatic epoxy resin, may for example, be mentioned. As a curing agent, an aliphatic or aromatic polyamine, an acid anhydride or a polyphenol may, for example, be typical. Such a curing agent will be reacted with an epoxy group by polyaddition for polymerization and formation of a three dimensional structure. As other curing agents, a tertiary amine, a Lewis acid, etc. may be mentioned.

An urethane resin is a polymer compound obtained by copolymerizing monomers by urethane bonds usually formed by condensation of an isocyanate group and an alcohol group. Usually, a main agent which is liquid at room temperature, and a curing agent are separated, and such two liquids are mixed and stirred and thereby polymerized to form a solid.

An unsaturated polyester resin is separated into a resin which is liquid at room temperature and a curing agent, and such two liquids are mixed and stirred and thereby polymerized to form a solid. It has a characteristic that the transparency is high, but shrinkage at the time of polymerization and curing is substantial, and thus there is a problem with respect to the dimensional stability, etc. It is sold frequently in the form having a volatile solvent mixed thereto, and therefore, even after the curing, it gradually undergoes deformation as the solvent evaporates.

The photocurable resin is made of a mixture comprising an oligomer (low polymer) of e.g. epoxy acrylate or urethane acrylate, a reactive diluent (monomer) and a photopolymerization initiator (benzoin type, acetophenone type, or the like). As other photopolymerizable resins, addition type crosslinked polymers may, for example, be mentioned which utilize one having a polyfunctional monomer such as divinylbenzene or ethylene glycol dimethacrylate copolymerized. Further, it is preferred to use a so-called polymer other than curable resin in combination, and particularly, a polyamide resin such as an alcohol-soluble copolymerized polyamide or the above mentioned modified polyamide is preferred as it shows good dispersibility and coating properties.

As the organic solvent to be used for a coating fluid for forming an undercoat layer, any solvent may be used so long as it is an organic solvent capable of dissolving the binder resin for the undercoat layer. Specifically, it may, for example, be an alcohol having at most 5 carbon atoms such as methanol, ethanol, isopropyl alcohol or n-propyl alcohol; a halogenated hydrocarbon such as chloroform, 1,2-dichloroethane, dichloromethane, trichlene, carbon tetrachloride or 1,2-dichloropropane; a nitrogen-containing organic solvent such as dimethylformamide; or an organic hydrocarbon such as toluene or xylene. They may be used as a solvent mixture of optional combination and in optional proportions. Further, even an organic solvent which by itself does not dissolve the binder resin for the undercoat layer, may be used in combination with e.g. the above mentioned organic solvent in the form of a mixed solvent, if it is thereby possible to dissolve the binder resin. Usually, it is preferred to employ a mixed solvent, since non-uniformity in coating can thereby be reduced.

The ratio in amount of the solid content such as the binder resin, titanium oxide particles, etc. to the organic solvent to be used for the coating fluid for forming an undercoat layer, may vary depending upon the method for coating the coating fluid for forming an undercoat layer and may be suitably changed for use so that a uniform coating film can be formed by the coating method to be used.

The coating fluid for forming an undercoat layer is preferably one containing metal oxide particles. In such a case, the metal oxide particles are present as dispersed in the coating fluid. To let the metal oxide particles be dispersed in the coating fluid, it is possible to carry out wet dispersion in an organic solvent by means of a known mechanical pulverization apparatus such as a ball mill, a sand grind mill, a planetary mill or a roll mill. However, it is preferred to carry out the dispersion by using a dispersion media.

As a dispersion apparatus to carry out dispersion by using a dispersion medium, any known dispersion apparatus may be used, and a pebble mill, a ball mill, a sand mill, a screen mill, a gap mill, a vibration mill, a paint shaker or an attritor may, for example, be mentioned. Among them, one capable of circulating the coating fluid for dispersion is preferred, and from the viewpoint of the dispersion efficiency, fineness of the final particle size, efficiency in continuous operation, etc., a wet system stirring ball mill such as a sand mill, a screen mill or a gap mill is employed. Such a mill may be vertical type or horizontal type. Further, the disk shape of the mill may be optional such as a flat plate type, a vertical pin type or a horizontal pin type, and preferably, a liquid circulation type sand mill is employed.

The above wet system stirring ball mill is preferably a wet system stirring ball mill comprising a cylindrical stator; a slurry inlet provided at one end of the stator; a slurry outlet provided at the other end of the stator; a pin, disk or annular type rotor to stir and mix the slurry supplied from the inlet and media filled in the stator; and an impeller type separator connected to the outlet and being rotatable together with the rotor or independently rotatable separately from the rotor to separate the media and slurry by a centrifugal action and to discharge the slurry from the outlet, wherein the axial center of a shaft for rotational drive of a separator is made to be hollow outlet connected to the above outlet.

By such a wet system stirring ball mill, the slurry separated from the media by the separator will be discharged through the axial center of the shaft, and at the axial center, no centrifugal force is applied, whereby the slurry will be discharged in a state having no motion energy. Thus, a motion energy will not be is discharged uselessly, and no useless motion power will be consumed.

Such a wet system stirring ball mill may be horizontal. However, in order to increase the filling factor of media, it is preferably vertical, and the outlet is provided at the top end of the mill. Further, the separator is preferably provided above the filling level of media. In a case where the outlet is provided at the upper end of the mill, the inlet is provided at the bottom of the mill.

In a preferred embodiment of the present invention, the inlet is constituted by a valve seat and a V-shape, trapezoidal or conical valve body which is disengageably fit on the valve seat and which is capable of line contact with the edge of the valve seat. Between the edge of the valve seat and the V-shape, trapezoidal or conical valve body, a ring-shaped slit is formed not to let the media pass therethrough, whereby the raw material slurry may be supplied, but the media are prevented from falling therethrough. Further, it is possible to let the valve body move up to broaden the slit thereby to discharge the media, or to let the valve body move down to close the slit thereby to seal the mill. Further, as the slit is formed by the valve body and the edge of the valve seat, coarse particles in the raw material slurry are less likely to be stuck, and if stuck, they can easily be released up or down, whereby clogging is less likely.

Further, if the valve body is designed to vibrate up and down by a vibrating means, coarse particles stuck in the slit may be released from the slit, and getting stuck itself tends to be less likely to occur. Besides, by the vibration of the valve body, a shearing force is applied to the raw material slurry, whereby the viscosity will be lowered, and the amount of the raw material slurry passing through the slit i.e. the feeding amount can be increased. As the vibrating means to vibrate the valve body, not only a mechanical means such as a vibrator, but also a means to vibrate the pressure of compressed air to act on the piston integral with the valve body, e.g. a compressing machine of a reciprocation type, or an electromagnetic switching valve to switch suction/ejection of compressed air, may be employed.

In such a wet system stirring ball mill, it is preferred to provide, at the bottom, a screen to separate media and an outlet to take out a slurry product so that the slurry product remaining in the mill may be taken out after completion of pulverization.

The wet system stirring ball mill to be used for dispering the coating fluid for forming an undercoat layer, which is suitable for use in the present invention, is preferably such that the separator is an impeller type although it may be of a screen or slit mechanism, and it is preferably a vertical type. It is advisable that the wet system stirring ball mill is designed to be vertial, and the separator is provided at an upper portion of the mill. Particularly, it is preferred to se the filling factor of media to be from 80 to 90%, pulverization can be carried out most efficiently, and the separator can be positioned above the filling level of media, such being effective to prevent the media from being discharged as mounted on the separator.

As a wet system stirring ball mill having such a structure, specifically, ULTRA APEX MILL manufactured by KOTOBUKI INDUSTRIES CO., LTD. may, for example, be mentioned.

It is preferred that after dispersion treatment using dispersing media, such dispersing media are separated and removed, followed further by ultrasonic treatment. The ultrasonic treatment is one to impart ultrasonic vibrations to the coating fluid for forming an undercoat layer, and the oscillation frequency, etc., are not particularly limited. Usually, ultrasonic vibrations are imparted by an oscillator with a frequency of from 10 kHz to 40 kHz, preferably from 15 kHz to 35 kHz.

The output power of the ultrasonic oscillator is not particularly limited, but it is usual to employ one having from 100 W to 5 kW. Usually, the dispersion efficiency is better by treating a small amount of the coating fluid with ultrasonic waves by an ultrasonic oscillator having a small output power rather than treating a large amount of the coating fluid with ultrasonic waves by an ultrasonic oscillator having a large output power. Accordingly, the amount of the coating fluid for forming an undercoat layer to be treated at one time is preferably from 1 to 50 L, more preferably from 5 to 30 L, particularly preferably from 10 to 20 L. Further, the output power of the ultrasonic oscillator in such a case is preferably from 200 W to 3 kW, more preferably from 300 W to 2 kW, particularly preferably from 500 W to 1.5 kW.

The method for imparting the ultrasonic vibration to the coating fluid for forming an undercoat layer is not particularly limited, and it may, for example, be a method of directly immersing the ultrasonic oscillator in a container containing the coating fluid for forming an undercoat layer, a method of contacting the ultrasonic oscillator to the outer wall of the container containing the coating fluid for forming an undercoat layer, or a method of immersing a solution containing the coating fluid for forming an undercoat layer, in a liquid having vibrations imparted by the ultrasonic oscillator. Among such methods, the method of immersing a solution containing the coating fluid for forming an undercoat layer, in a liquid having vibrations imparted by an ultrasonic oscillator, is suitably employed. In such a case, as the liquid having vibrations imparted by the ultrasonic oscillator may, for example, be water; an alcohol such as methanol; an aromatic hydrocarbon such as toluene; or an oil such as silicone oil. However, it is preferred to use water in consideration of the safety in the production, the cost, the cleaning properties, etc. In the method of immersing a solution containing the coating fluid for forming an undercoat layer, in a liquid having vibrations imparted by an ultrasonic oscillator, the efficiency of the ultrasonic treatment may change depending upon the temperature of the liquid, and therefore, it is preferred to maintain the temperature of the liquid to be constant. The temperature of the liquid having vibrations imparted by an ultrasonic oscillator may rise. With respect to the temperature of such a liquid, it is preferred to carry out ultrasonic treatment usually within a temperature range of from 5 to 60° C., preferably from 10 to 50° C., more preferably from 15 to 40° C.

As the container for the coating fluid for forming an undercoat layer to be used for ultrasonic treatment, any container may be used so long as it is container commonly used to accommodate the coating fluid for forming an undercoat layer to be used for forming a photosensitive layer for an electrophotographic photoreceptor. It may, for example, be a container made of a resin such as polyethylene or polypropylene, a glass contained or a can made of a metal. Among them, a can made of a metal is preferred, and particularly, a 18 L metal can as stipulated in JIS Z 1602 is suitably employed, since it is scarcely eroded by an organic solvent and is strong against impact.

In order to remove coarse particles, the coating fluid for forming an undercoat layer is subjected to filtration, as the case requires, and then used. In such a case, as the filtration media, any filtration material may be employed which is commonly used for filtration, such as cellulose fiber, resin fiber, glass fiber, etc. In the form of the filtration media, so-called wound filter is preferred, having various fibers wound on a core material, for such a reason that the filtration area is large, and the efficiency is good. As the core material, any known core material may be employed, but a core material made of stainless steel or a core material made of a resin not soluble in the coating fluid for forming an undercoat layer, such as polypropylene, may, for example, be mentioned.

The coating fluid for forming an undercoat layer, prepared in such a manner, is used for forming an undercoat layer, if necessary, after further adding a binder or various additives.

In order to disperse the metal oxide particles such as titanium oxide particles in the coating fluid for the undercoat layer, it is preferred to use dispersing media having an average particle diameter of from 5 μm to 200 μm.

The dispersing media usually have a shape close to a sphere, and therefore, the average particle diameter may be obtained, for example, by a method of sieving by sieves as disclosed in e.g. JIS Z 8801:2000, or by measurement by image analysis, and the density can be measured by an Archimedes method. Specifically, the average particle diameter and the sphericity may be measured by an image analysis apparatus represented by e.g. LUZEX50 manufactured by NIRECO CORPORATION. The average particle diameter of the dispersing media is usually from 5 μm to 200 μm, particularly preferably from 10 μm to 100 μm. Usually, as the particle diameter of the dispersing media becomes small, uniform dispersion tends to be obtained in a short time, but if the particle diameter becomes excessively small, the mass of the dispersing media tends to be too small, whereby efficient dispersion tends to be impossible.

The density of the dispersing media is usually at least 5.5 $g/cm^3$, preferably at least 5.9 $g/cm^3$, more preferably at least 6.0 $g/cm^3$. Usually, when dispersing media having a higher density is used for dispersion, uniform dispersion tends to be obtainable in a short period of time. The sphericity of the dispersing media is preferably at most 1.08, more preferably at most 1.07.

With respect to the material of the dispersing media, any known dispersing media may be used so long as they are insoluble in the coating fluid for forming an undercoat layer, and its specific gravity is larger than the coating fluid for forming an undercoat layer, and it will neither react with the coating fluid for forming an undercoat layer nor modify the coating fluid for forming an undercoat layer. They may, for example, be steel balls such as chrome balls (steel balls for ball bearing) or carbon balls (carbon steel balls); stainless steel balls; ceramic balls made of e.g. silicon nitride, silicon carbide, zirconia or alumina; or balls coated with a film of e.g. titanium nitride or titanium carbonitride. Among them, ceramic balls are preferred, and calcined zirconia balls are particularly preferred. More specifically, it is particularly preferred to employ calcined zirconia beads as disclosed in Japanese Patent No. 3,400,836.

Method for Forming Undercoat Layer

In the present invention, a suitable undercoat layer may be formed by applying the coating fluid for forming an undercoat layer on a substrate by a known coating method such as dip coating, spray coating, nozzle coating, spiral coating, ring coating, barcoat coating, roll coating, or blade coating, followed by drying.

The spray coating method may, for example, be air spray, airless spray, electrostatic air spray, electrostatic airless spray, rotary atomization electrostatic spray, hot spray or hot airless spray. However, when the atomization degree to obtain a uniform film thickness, the sticking efficiency, etc. are taken into consideration, it is preferred that in the rotary atomization electrostatic spray, transportation method disclosed in JP-A-1-805198 is adopted, i.e. a cylindrical work is, while being rotated, continuously transported in its axial direction without any interval, whereby it is possible to obtain an electrophotographic photoreceptor having an undercoat layer excellent in the uniformity of the film thickness with overall high sticking efficiency.

The spiral coating method may, for example, be a method of employing an injection coating machine or a curtain coating machine as disclosed in JP-A-52-119651, a method of continuously jetting a coating material in streaks from fine openings as disclosed in JP-A-1-231966, or a method of employing a multinozzle body as disclosed in JP-A-3-193161.

In the case of the dip coating method, the total solid content concentration in the coating fluid for forming an undercoat layer is usually at least 1 wt %, preferably at least 10 wt % and usually at most 50 wt %, preferably at most 35 wt %, and the viscosity is preferably within a range of from 0.1 mPa·s to 100 mPa·s.

Then, the coated film is dried, and the drying temperature and time are adjusted so that necessary and sufficient drying can be carried out. The drying temperature is usually within a range of from 100° C. to 250° C., preferably from 110° C. to 170° C., more preferably from 115° C. to 140° C. As the drying method, it is possible to employ a hot air dryer, a steam dryer, an infrared dryer or a far infrared dryer.

Charge Generation Material

The photosensitive layer formed on the electroconductive substrate may be of a single layer structure wherein a charge generation material and a charge transport material are present in the same layer as dispersed in a binder resin, or of a laminated structure wherein a charge generation layer having a charge generation material dispersed in a binder and a charge transport layer having a charge transport material dispersed in a binder resin are functionally separated.

In the present invention, it is preferred to use dyes or pigments as charge generation materials, as the case requires. As the dyes or pigments, for example, various photoconductive materials may be used including inorganic photoconductive materials such as selenium and its alloys, cadmium sulfide, etc., and organic pigments such as a phthalocyanine pigment, an azo pigment, a dithioketopyrrolopyrrole pigment, a squalene (squarylium) pigment, a quinacridone pigment, an indigo pigment, a perylene pigment, a polycyclic quinone pigment, an anthanthrone pigment and a benzimidazole pigment. It is particularly preferred to use an organic pigment, further preferably a phthalocyanine pigment or an azo pigment.

As phthalocyanine to be used, specifically, various crystal forms of metal-free phthalocyanine or phthalocyanines having a metal such as copper, indium, gallium, tin, titanium, zinc, vanadium, silicon or germanium, or its oxide or halide, coordinated thereto, may be used. Particularly preferred is highly sensitive X-type or τ-type metal-free phthalocyanine; titanyl phthalocyanine (another name: oxytitanium phthalocyanine) of A-type (another name β-type), B-type (another name α-type) or D-type (another name Y-type); vanadyl phthalocyanine; chloroindium phthalocyanine; chlorogallium phthalocyanine of II-type, etc.; hydroxygallium phthalocyanine of V-type, etc; μ-oxo-gallium phthalocyanine dimer of G-type, I-type, etc.; or μ-oxo-aluminum phthalocyanine dimer of II-type, etc. Among such phthalocyanines, particularly preferred is oxytitanium phthalocyanine of A-type (β-type), B-type (α-type) or D-type (Y-type); II-type chlorogallium phthalocyanine; V-type hydroxygallium phthalocyanine; or G-type μ-oxo-gallium phthalocyanine dimer.

Particularly, as an oxytitanium phthalocyanine, one having a main distinct diffraction peak at a Bragg angle) (2θ±0.2°) of 27.3° in the powder X-ray diffraction spectrum by CuKα characteristic X-ray, is preferred.

Further, such an oxytitanium phthalocyanine preferably has a distinct diffraction peak at a Bragg angle)(2θ±0.2°) of from 9.0° to 9.7° in the powder X-ray diffraction spectrum by CuKα characteristic X-ray. Further, in such an oxytitanium phthalocyanine, the chlorine content in the crystal is preferably at most 1.5 wt %. Such a chlorine content can be obtained from the elemental analysis.

Further, in the crystal of such an oxytitanium phthalocyanine, the ratio of chlorinated oxytitanium phthalocyanine represented by the following formula (E) to non-substituted oxytitanium phthalocyanine represented by the following formula (F) is preferably at most 0.070 by mass spectrum intensity ratio. Further, the mass spectrum intensity ratio is preferably at most 0.060, more preferably at most 0.055. In a case where a dry system pulverization method is used for amorphous conversion at the time of the production, the mass spectrum intensity ratio is preferably at least 0.02, and in a case where an acid paste method is employed for amorphous conversion, it is preferably at least 0.03. The amount of chlorine substituted can be measured by the method disclosed in JP-A-2001-115054.

(E)

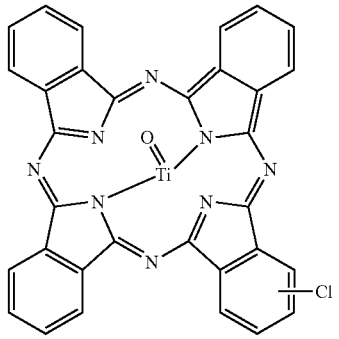

m/z: 610

(F)

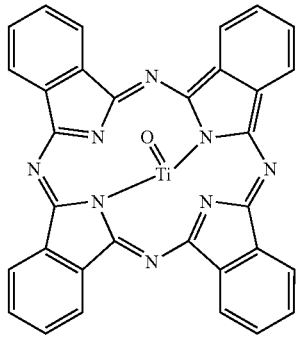

m/z: 576

The particle diameter of such an oxytitanyl phthalocyanine may vary substantially by the production method or the crystalline-conversion method. In consideration of dispersibility, the primary particle diameter is preferably at most 500 nm, and from the viewpoint of the coating film-forming property, it is preferably at most 300 nm. Further, such an oxytitanium phthalocyanine may be not only chlorinated oxytitanium phthalocyanine but also one substituted by a fluorine atom, a nitro group or a cyano group. Further, it may contain various oxytitanium phthalocyanine derivatives substituted by a substituent such as a sulfone group.

In the present invention, the oxytitanium phthalocyanine suitable for use may be produced, for example, in such a manner that using phthalonitrile and titanium halide as starting materials, dichlorotitanium phthalocyanine is prepared, and then such dichlorotitanium phthalocyanine is hydrolyzed and purified to obtain an intermediate of oxytitanium phthalocyanine composition; then the obtained intermediate of oxytitanium phthalocyanine composition is amorphous-modified; and amorphous oxytitanium phthalocyanine composition thereby obtained is crystallized in a solvent.

As the titanium halide, titanium chloride is preferred. The titanium chloride may, for example, be titanium tetrachloride or titanium trichloride, and titanium tetrachloride is particularly preferred. By using titanium tetrachloride, it is easy to control the content of the chlorinated oxytitanium phthalocyanine contained in the obtainable oxytitanium phthalocyanine composition.

The reaction temperature is usually at least 150° C., preferably at least 180° C., and in order to control the content of chlorinated oxytitanium phthalocyanine, more preferred is at least 190° C., and the reaction is carried out usually at most 300° C., preferably at most 250° C., more preferably at most 230° C. Usually, the titanium chloride is added to a mixture of phthalonitrile and a solvent for the reaction. The titanium chloride at that time may be added directly if the temperature is not higher than the boiling point, or may be added as mixed with the above high boiling point solvent.

In the present invention, when oxytitanium phthalocyanine is to be produced by using phthalonitrile and titanium tetrachloride and using, as a solvent for the reaction, e.g. a diarylalkane, it is possible to produce oxytitanium phthalocyanine suitable for use, by adding titanium tetrachloride dividedly at a low temperature of at most 100° C. and at a high temperature of at least 180° C.

The obtained dichlorotitanium phthalocyanine is subjected to hydrolysis treatment under heating and then subjected to treatment to be amorphous by e.g. pulverization by means of a known mechanical pulverization apparatus such as a paint shaker, a ball mill or a sand grind mill, or by the so-called acid paste method wherein it is dissolved in concentrated sulfuric acid and then obtained as solid in e.g. cold water. In consideration of dark decay, mechanical pulverization is preferred. From the viewpoint of the sensitivity and environmental dependency, the acid paste method is preferred.

The obtained amorphous oxytitanium phthalocyanine composition is subjected to crystallization by a known solvent, to obtain an oxytitanium phthalocyanine composition suitable for use in the present invention. The solvent is more specifically a halogenated aromatic hydrocarbon solvent such as orthodichlorobenzene, chlorobenzene or chloronaphthalene; a halogenated hydrocarbon solvent such as chloroform or dichloroethane; an aromatic hydrocarbon solvent such as methylnaphthalene, toluene or xylene; an ester solvent such as ethyl acetate or butyl acetate; a ketone solvent such as methyl ethyl ketone or acetone; an alcohol such as methanol, ethanol, butanol or propanol; an ether solvent such as ethyl ether, propyl ether, butyl ether or ethylene glycol; a monoterpene hydrocarbon solvent such as terpinalene or pinene; or liquid paraffin. Among them, orthodichlorobenzene, toluene, methylnaphthalene, ethyl acetate, butyl ether or pienene is, for example, preferred.

The powder X-ray diffraction spectrum by CuKα characteristic X-ray of the oxytitanium phthalocyanine may be measured by a method used for a usual solid powder X-ray diffraction measurement.

In the present invention, the oxytitanium phthalocyanine suitable for use, has a distinct diffraction peak at a Bragg angle)(2θ±0.2°) of 27.3° in the powder X-ray diffraction spectrum by CuKα characteristic X-ray. Further, it has preferably a distinct diffraction peak at from 9.0° to 9.8°, particularly preferably a peak at 9.0°, 9.6°, 9.5° or 9.7°. Among them, it is preferably one which does not have a distinct diffraction peak at a Bragg angle) (2θ±0.2°) 26.3°.

The phthalocyanine compound may be in a mixed crystal state. Here, a mixture of phthalocyanine compounds or crystal forms, may be prepared by mixing the respective constituting elements later, or the mixed state may be formed in the process for production or treatment of phthalocyanine compounds, such as synthesis, pigmentation or crystallization. As such treatment, acid paste treatment, pulverization treatment or solvent treatment is, for example, known. In order to let the mixed crystal state form, a method may be mentioned wherein, as disclosed in JP-A-10-48859, two types of crystals are mixed and then mechanically pulverized to a nonspecific form and then converted to the specific crystal state by solvent treatment.

Further, in a case where an azo pigment is used in combination, various known bisazo pigments or trisazo pigments are, for example, suitably used. Examples of preferred azo pigments are shown below. In the following formulae, each of $Cp^1$ to $Cp^3$ represents a coupler.

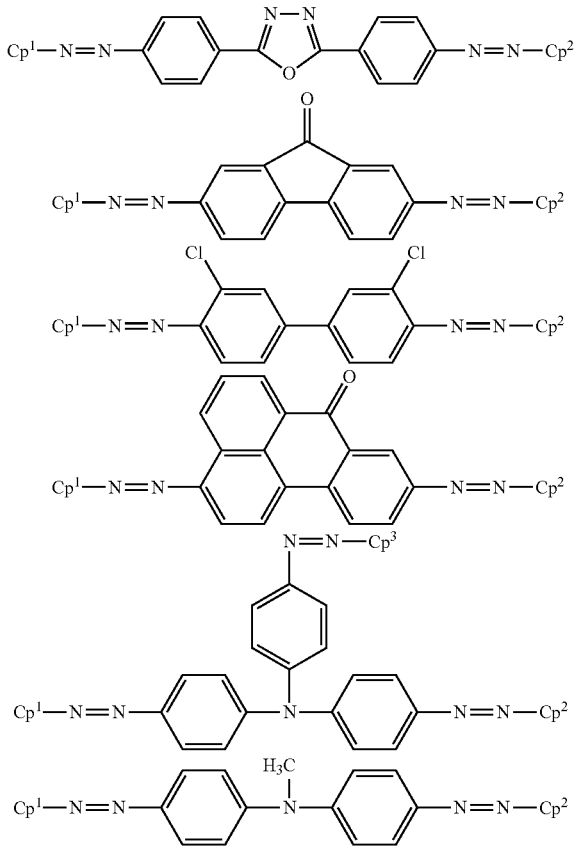

As the coupler for each of $Cp^1$ to $Cp^3$, preferred are those having the following structures.

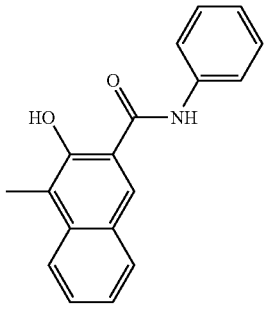

-continued

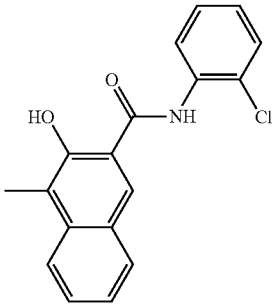

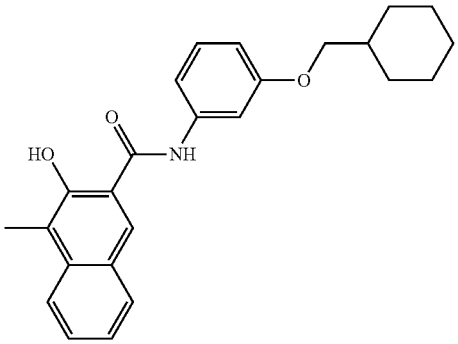

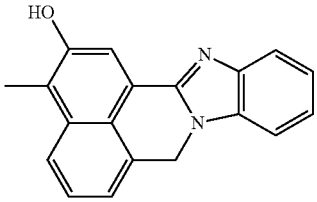

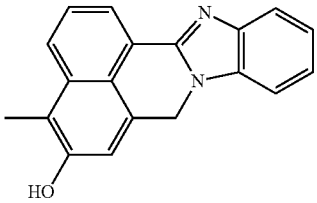

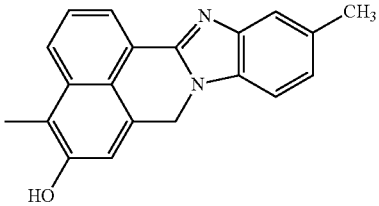

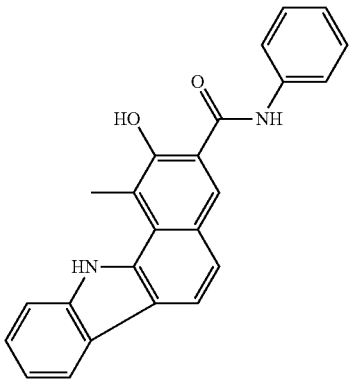

-continued

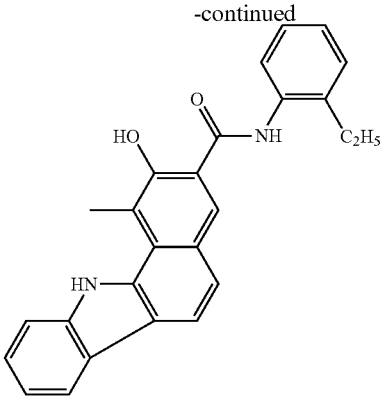

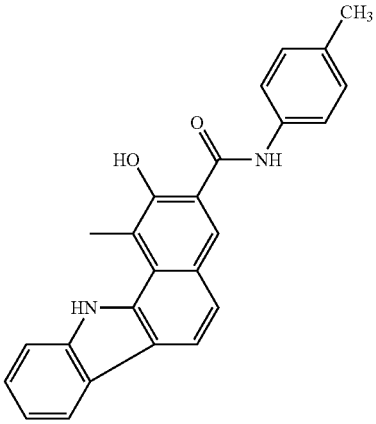

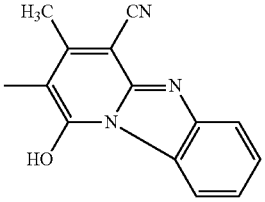

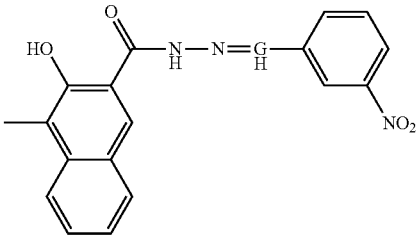

The binder resin to be used for the charge generation layer in the laminated type photoreceptor, may be selected for use among e.g. a polyvinyl butyral resin, a polyvinyl formal resin, a polyvinyl acetal resin such as a partially acetal-modified polyvinyl butyral resin having a part of butyral modified with e.g. formal or acetal, a polyarylate resin, a polycarbonate resin, a polyester resin, a modified ether type polyester resin, a phenoxy resin, a polyvinyl chloride resin, a polyvinylidene chloride resin, a polyvinyl acetate resin, a polystyrene resin, an acrylic resin, a methacrylic resin, a polyacrylamide resin, a polyamide resin, a polyvinyl pyridine resin, a cellulose type resin, a polyurethane resin, an epoxy resin, a silicone resin, a polyvinyl alcohol resin, a polyvinyl pyrrolidone resin, casein, a vinyl chloride/vinyl acetate type copolymer such as a vinyl chloride/vinyl acetate copolymer, a hydroxy-modified vinyl chloride/vinyl acetate copolymer, a carboxyl-modified vinyl chloride/vinyl acetate copolymer or a vinyl/chloride/vinyl acetate/maleic anhydride copolymer, a styrene/butadiene copolymer, a vinylidene chloride/acrylonitrile copolymer, a styrene/alkyd resin, a silicone/alkyd resin, an insulating resin such as a phenol/formaldehyde resin, and an organic photoconductive polymer such as poly-N-vinylcarbazole, polyvinyl anthracene or polyvinyl perylene, but the binder resin is not limited to such polymers. Further, these binder resins may be used alone or in combination as a mixture of two or more of them.

The solvent or dispersion medium to be used for the preparation of a coating fluid by dissolving the binder resin, may, for example, be a saturated aliphatic solvent such as pentane, hexane, octane or nonane; an aromatic solvent such as toluene, xylene or anisole; a halogenated aromatic solvent such as chlorobenzene, dichlorobenzene or chloronaphthalene; an amide solvent such as dimethylformamide or N-methyl-2-pyrrolidone; an alcohol solvent such as methanol, ethanol, isopropanol, n-butanol or benzyl alcohol; an aliphatic polyhydric alcohol such as glycerol or polyethylene glycol; a linear, branched or cyclic ketone solvent such as acetone, cyclohexanone, methyl ethyl ketone or 4-methoxy-4-methyl-2-pentanone; an ester solvent such as methyl formate, ethyl acetate or n-butyl acetate; a halogenated hydrocarbon solvent such as methylene chloride, chloroform or 1,2-dichloroethane; a linear or cyclic ether solvent such as diethyl ether, dimethoxyethane, tetrahydrofuran, 1,4-dioxane, methylcellsolve or ethylcellsolve; an aprotic polar solvent such as acetonitrile, dimethylsulfoxide, sulfolane or hexamethylphosphoric acid triamide; a nitrogen-containing compound such as n-butylamine, isopropanolamine, diethylamine, triethanolamine, ethylenediamine, triethylenediamine or triethylamine; a mineral oil such as ligroin; or water, and one which does not dissolve the after-mentioned undercoat layer, is preferably employed. Further, these solvents may be used alone or in combination as a mixture of two or more of them.

In the charge generation layer of a laminated type photoreceptor, the blend ratio (by weight) of the charge generation material to the binder resin is preferably from 10 to 1,000 parts by weight, preferably from 30 to 500 parts by weight, per 100 parts by weight of the binder resin, and its film thickness is usually from 0.1 μm to 4 μm, preferably from 0.15 μm to 0.6 μm. In a case where the ratio of the charge generation material is too high, the stability of the coating fluid deteriorates due to a problem such as aggregation of the charge generation material. On the other hand, if it is too low, the sensitivity as the photoreceptor deteriorates.

Therefore, it is preferably used within the above range.

As a method for dispersing the above charge generation material, a known dispersion method such as a ball mill dispersion method, an attritor dispersion method or a sand mill dispersion method may be employed. At that time, it is effective to reduce the particle size to a level of at most 0.5 μm, preferably at most 0.3 μm, more preferably at most 0.15 μm.

Charge Transport Material

The photosensitive layer formed on the electroconductive substrate may be of a single layer structure wherein the charge generation material and the charge transport material are present in the same layer, as dispersed in a binder resin, or of a laminated structure wherein a charge generation layer having a charge generation material dispersed in a binder and a charge transport layer having a charge transport material dispersed in a binder resin, are functionally separated. Each layer usually contains a binder resin and other components which are used as the case requires. Specifically, such a charge transport layer may be obtained, for example, by dissolving or dispersing the charge transport material or the like and the binder resin in a solvent to prepare a coating fluid and applying and drying the coating fluid on a charge generation layer in the case of an orderly laminated type photosensitive layer, on an electroconductive support in the case of a reversely laminated type photosensitive layer, or on an interlayer in a case where such an interlayer is provided.

The photoreceptor in the present invention preferably contains a charge transport agent having an ionization potential of from 5.0 to 5.3, as the charge transport material. The ionization potential can be measured simply in the atmospheric air by using a powder or film by means of "AC-1" (manufactured by RIKEN K.K.), and it is defined as a value measured in such a manner. If the ionization potential is too small, the agent tends to be weak against ozone or the like. Accordingly, it is preferably at least 5.05, particularly preferably at least 5.10. On the other hand, if the ionization potential value is too large, the efficiency for injection of the electric charge from the charge generation agent tends to be poor, and it is preferably at most 5.25.

Further, specifically, the photoreceptor to be used for the image forming apparatus of the present invention preferably contains a compound represented by the following formula (B).

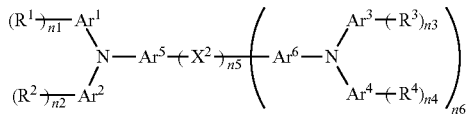

(B)

In the formula (B), each of $Ar^1$ to $Ar^6$ which are independent of one another, is an aromatic residue which may have a substituent or an aliphatic residue which may have a substituent, $X^2$ is an organic residue, each of $R^1$ to $R^4$ which are independent of one another, is an unsaturated group, and each of n1 to n6 which are independent of one another, is an integer of 0, 1 or 2, provided that when n1 is 1, n2 is also 1.

In the formula (B), each of $Ar^1$ to $Ar^6$ which are independent of one another, is an aromatic residue which may have a substituent, or an aliphatic residue which may have a substituent. Specifically, the aromatic may, for example, be an aromatic hydrocarbon such as benzene, naphthalene, anthracene, pyrene, perylene, phenanthrene or fluorene, or an aromatic heteroring such as thiophene, pyrrole, carbazole or imidazole. The number of carbon atoms is preferably from 5 to 20, more preferably at most 16, particularly preferably at most 10. The lower limit is at least 6 from the viewpoint of the electrical characteristics. Particularly preferred is an aromatic hydrocarbon residue, and a benzene residue is especially preferred.

As a specific aliphatic, the number of carbon atoms is preferably from 1 to 20, more preferably at most 16, particularly preferably at most 10. In the case of a saturated aliphatic, the number of carbon atoms is preferably at most 6, and in the case of an unsaturated aliphatic, the number of carbon atoms is preferably at least 2. The saturated aliphatic may, for example, be a branched or linear alkyl such as methane, ethane, propane, isopropane or isobutane, and the unsaturated aliphatic may, for example, be an alkene such as ethylene or butylene.

Their substituents are not particularly limited. Specifically, an alkyl group such as a methyl group, an ethyl group, a propyl group or an isopropyl group; an alkenyl group such as an allyl group; an alkoxy group such as a methoxy group, an ethoxy group or a propoxy group; an aryl group such as a phenyl group, an indenyl group, a naphthyl group, an acenaphthyl group, a phenanthryl group or a pyrenyl group; or a heterocyclic group such as an indolyl group, a quinolyl group or a carbazolyl group, may, for example, be mentioned. Further, these substituents may form a connecting group or may directly be bonded to form a ring. Introduction of such a substituent may be effective to adjust the intramolecular charge and to increase the charge mobility. On the other hand, if the bulk becomes too large, the charge mobility may rather be lowered by a distortion of the intramolecular conjugate plane or by the intermolecular steric repulsion. Accordingly, the number of carbon atoms is preferably at least 1 and preferably at most 6, more preferably at most 4, particularly preferably at most 2.

Further, it is preferred to have a plurality of substituents, whereby crystal precipitation can be avoided. However, if the number of substituents is too much, the charge mobility rather tends to deteriorate due to e.g. distortion of an intramolecular conjugate plane or intermolecular steric repulsion. Accordingly, the number of substituents is preferably at most 2 per one ring. And, in order to improve the stability in the photosensitive layer and to improve the electrical characteristics, one being not sterically bulky is preferred, and more specifically, a methyl group, an ethyl group, a butyl group, an isopropyl group or a methoxy group is, for example, preferred.

Particularly in a case where each of $Ar^1$ to $Ar^4$ is a benzene residue, the benzene residue preferably has a substituent. In such a case, a preferred substituent is an alkyl group, particularly a methyl group. Further, in a case where $Ar^5$ or $Ar^6$ is a benzene residue, a preferred substituent is a methyl group or a methoxy group. Particularly, in the formula (B), $Ar^1$ preferably has a fluorene structure.

Further, in the formula (B), $X^2$ is an organic residue and may, for example, be an aromatic residue, saturated aliphatic residue or heterocyclic residue, which may have a substituent, an organic residue having an ether structure, or an organic residue having a divinyl structure. It is particularly preferably an organic residue having from 1 to 15 carbon atoms, and among them, an aromatic residue or a saturated aliphatic residue is preferred. In the case of the aromatic residue, the number of carbon atoms is preferably 6 to 14, more preferably at most 10. In the case of the saturated aliphatic residue, the number of carbon atoms is preferably from 1 to 10, more preferably at most 8.

This organic residue $X^2$ may have a substituent on the above mentioned structure. Such a substituent is not particularly limited and may, for example, be an alkyl group such as a methyl group, an ethyl group, a propyl group, an isopropyl group or an allyl group; an alkoxy group such as a methoxy group, an ethoxy group or a propoxy group; an aryl group such as a phenyl group, an indenyl group, a naphthyl group, an acenaphthyl group, a phenanthryl group or a pyrenyl group; or a heterocyclic group such as an indolyl group, a quinolyl group or a carbazolyl group. Further, such substituents may form a connecting group or may directly be bonded to form a ring. Further, such a substituent preferably has at least one carbon atom and preferably at most 10 carbon atoms, more preferably at most 6 carbon atoms, particularly preferably at most 3 carbon atoms. More specifically, a methyl group, an ethyl group, a butyl group, an isopropyl group or a methoxy group is, for example, preferred.

Further, it is preferred to have a plurality of substituents, whereby crystal precipitation can be avoided. However, if the number of substituents is too much, the charge mobility rather tends to deteriorate due to distortion of an intramolecular conjugate plane or intermolecular steric repulsion. Accordingly, the number of substituents is preferably at most 2 per one $X^2$.

Each of n1 to n4 which are independent of one another, is an integer of 0, 1 or 2. n1 is preferably 1, and n2 is preferably 0 or 1. When n1 is 1, n2 is 1.

Each of $R^1$ to $R^4$ which are independent of one another, is an unsaturated group. It is preferably an organic group having at most 30 carbon atoms, more preferably an organic group having at most 20 carbon atoms. Further, as the unsaturated group, it is preferably one having a double bond. Further, it is preferably one having a hydrazone structure, a stilbene structure or a butadiene structure. The hydrazone structure is preferably one having no hydrogen atom directly conjugated to the nitrogen atom of the hydrazone. Preferred is one having carbon bonded to the nitrogen atom, and one having a diphenyl hydrazone structure.

Each of n5 and n6 which are independent of each other, is from 0 to 2. When n5 is 0, such represents a direct bond, and when n6 is 0, n5 is preferably 0. When n5 and n6 are both 1, $X^2$ is preferably a group which has a structure of alkylidene, arylene or ether. Here, as the alkylidene structure, phenylmethylidene, 2-methylpropylidene, 2-methylbutylidene or cyclohexylidene is, for example, preferred. As the arylene structure, phenylene or naphthylene is, for example, preferred. As the group having an ether structure, —O—$CH_2$O— is, for example, preferred.

When both n5 and n6 are 0, $Ar^5$ is preferably a benzene residue or a fluorene residue. When it is a benzene residue, it is preferably substituted by an alkyl group or an alkoxy group. More preferably, the substituent is a methyl group or a methoxy group and is preferably substituted at the p-position of the nitrogen atom. When n6 is 2, $X^2$ is preferably a benzene residue.

The following may be mentioned as examples of specific combinations of n1 to n6.

| n1 | n2 | n3 | n4 | n5 | n6 |
|---|---|---|---|---|---|
| 1 | 1 | 0 | 0 | 0 | 0 |
| 1 | 1 | 1 | 1 | 0 | 1 |
| 2 | 2 | 0 | 0 | 0 | 0 |
| 2 | 2 | 2 | 2 | 1 | 1 |
| 1 | 1 | 1 | 0 | 2 | 1 |
| 1 | 1 | 1 | 1 | 1 | 2 |

Specific examples of preferred structures of the formula (B) are shown below.

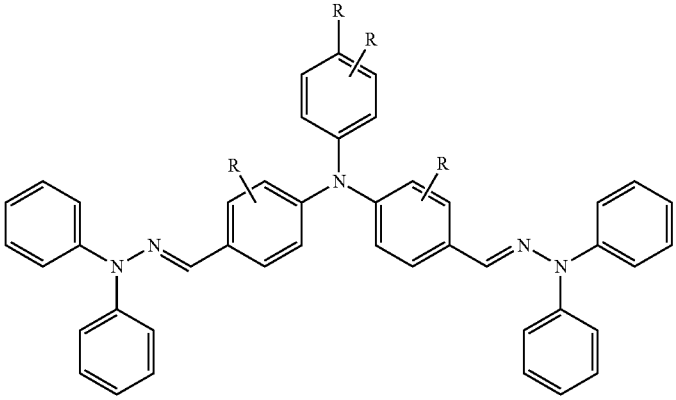

-continued
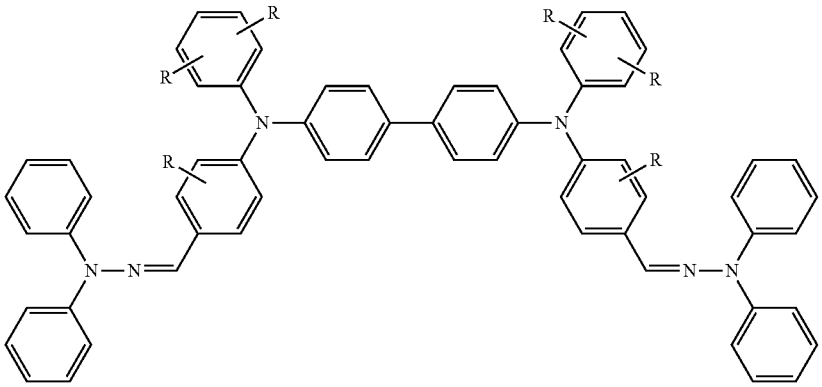
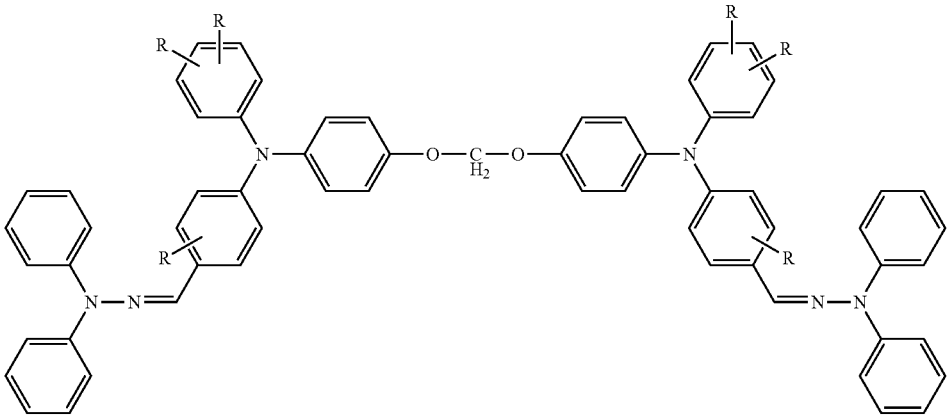
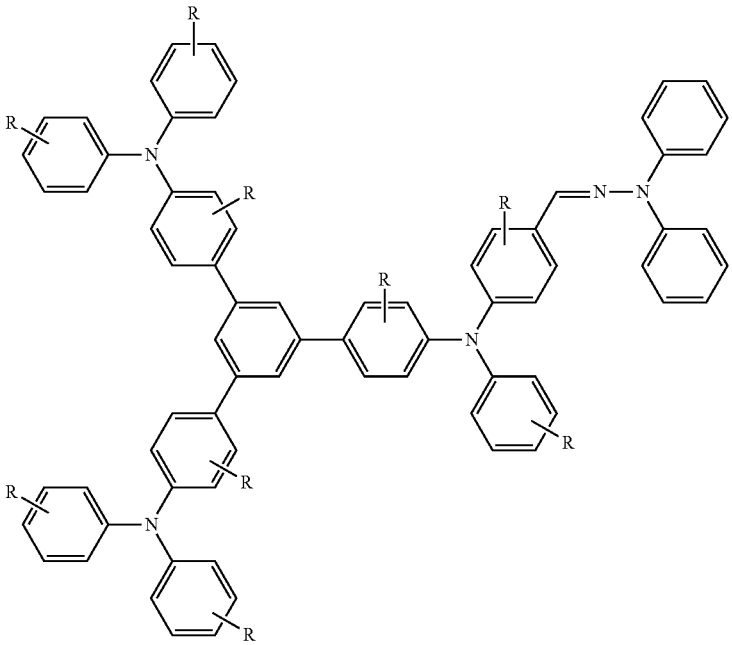

-continued
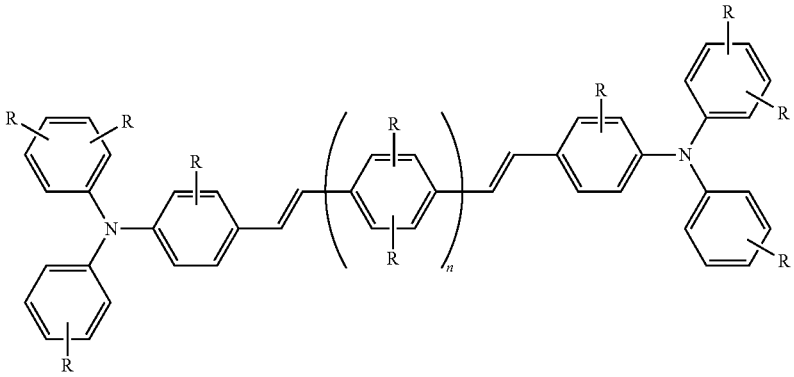
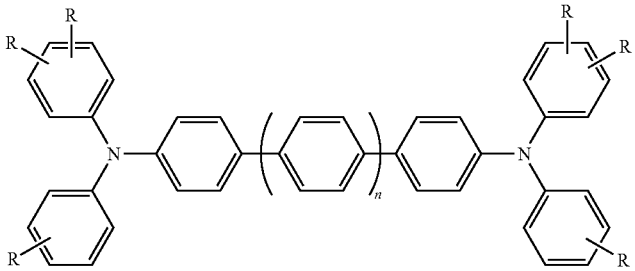
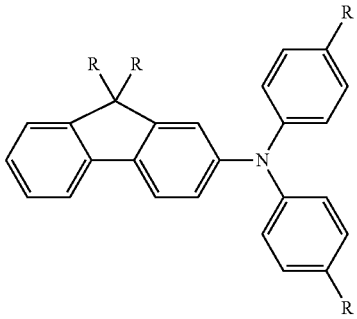
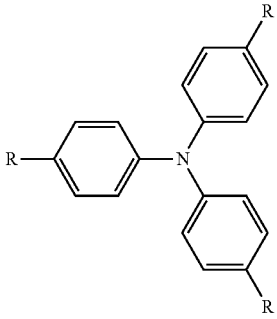
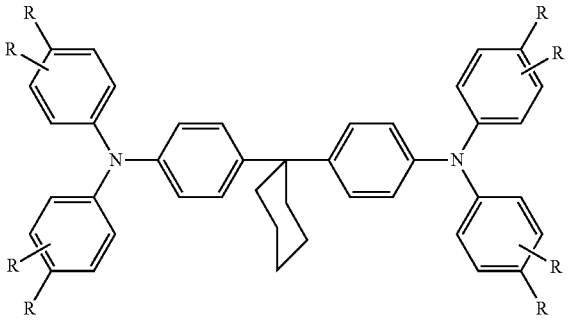
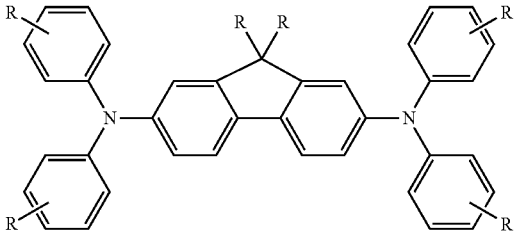
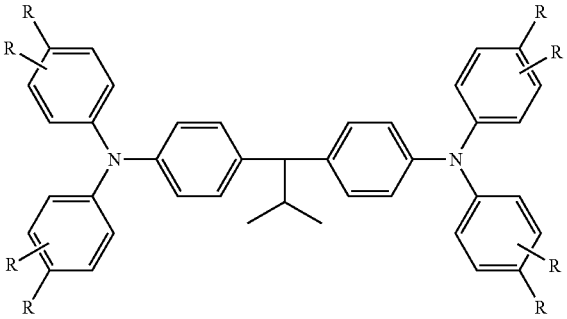
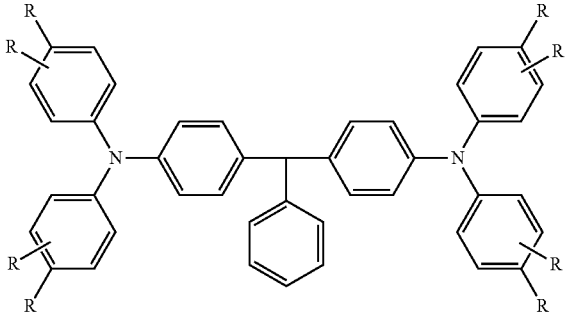
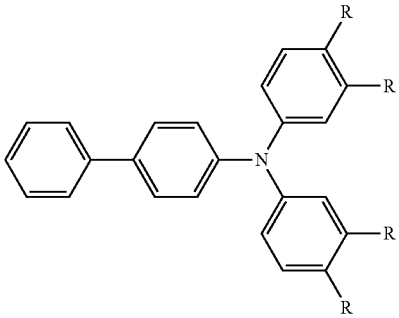

-continued
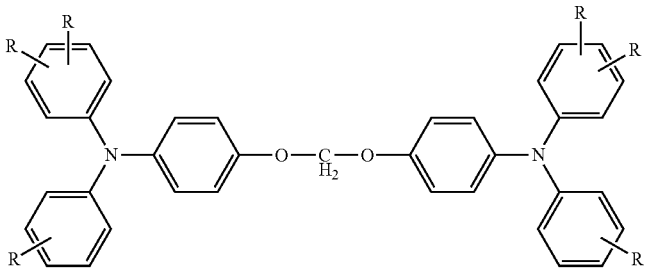
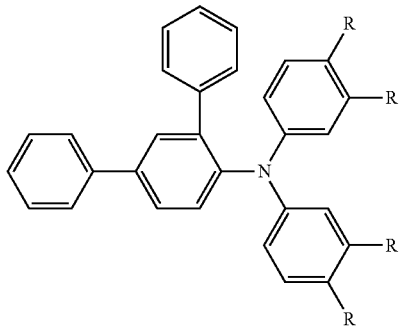
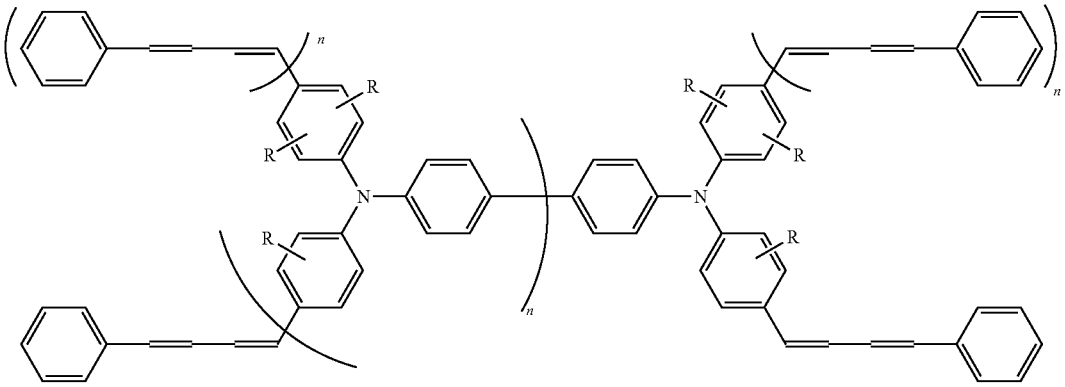
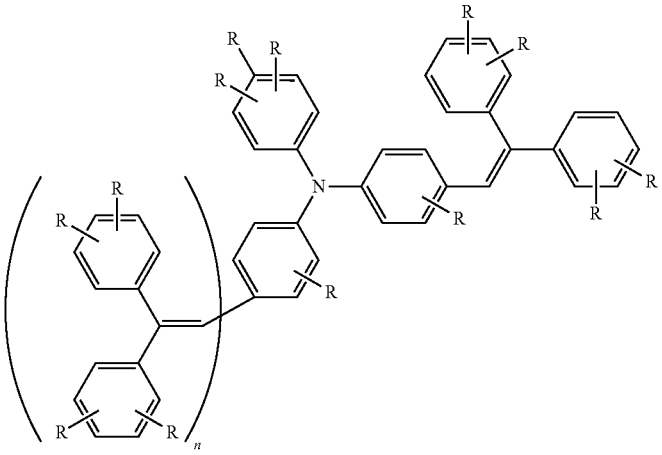
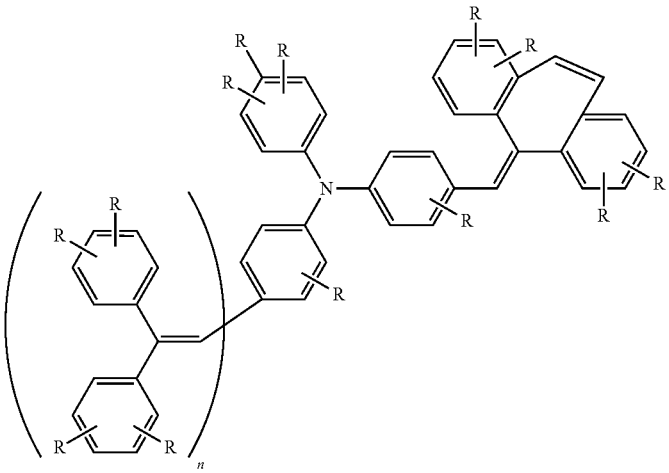

In the above formulae, the plurality of R may be the same or different, and specifically, each R is a hydrogen atom or a substituent. As the substituent, an alkyl group, an alkoxy group or an aryl group is, for example, preferred. Particularly preferred is a methyl group or a phenyl group. Further, n is an integer of from 0 to 2.

Further, the compound of the formula (B) may be used in combination with an optional known charge transport 3.0 material. Examples of the known charge transport material include an aromatic nitro compound such as 2,4,7-trinitrofluorenone; a cyano compound such as tetracyanoquinodimethane; an electron attractive material such as a quinone compound such as diphenoquinone; a heterocyclic compound such as a carbazole derivative, an indole derivative, an imidazole derivative, an oxazole derivative, a pyrazole derivative, a thiadiazole derivative or benzofuran derivative; an aniline derivative, a hydrazone derivative, an aromatic amine derivative, a stilbene derivative, a butadiene derivative, an enamine derivative and one having a plurality of these compounds bonded; and an electron donative material such as a polymer having a group made of such a compound on the main chain or on a side chain. Among them, a carbazole derivative, an aromatic amine derivative, a stilbene derivative, a butadiene derivative, an enamine derivative or one having a plurality of these compounds bonded, is preferred. These charge transport materials may be used alone or in combination as a mixture of optional two or more of them.

In the image forming apparatus of the present invention, it is preferred that the photoreceptor is a laminated type photoreceptor containing a charge generation layer and a charge transport layer, and the weight ratio of the charge transport agent contained in the charge transport layer to the binder i.e. the value of "charge transport agent/binder" is in a range of from 0.3 to 0.6. If it is smaller than 0.3, electrical characteristics may sometimes decrease, and particularly, the mobility may sometimes decrease. On the other hand, if it is larger than 0.6, the mechanical strength may sometimes decrease, and particularly, the friction resistance may sometimes decrease. The value of "charge transport agent/binder" is preferably at least 0.35, more preferably at most 0.55.

Binder Resin

At the time of forming a photosensitive layer of a single layer type photoreceptor, or a charge transport layer of a function-separated type photoreceptor having a charge generation layer and the charge transport layer, a binder resin to disperse the compound is used in order to secure the film strength. The charge transport layer of the function-separated type photoreceptor can be obtained by applying and drying a coating fluid obtained by dissolving or dispersing the charge transport material and various binder resins in a solvent, and the single layer type photoreceptor can be obtained by applying and drying a coating fluid obtained by dissolving or dispersing the charge generation material, the charge transport material and various binder resins in a solvent.

The binder resin may, for example, be a butadiene resin, a styrene resin, a vinyl acetate resin, a vinyl chloride resin, an acrylate resin, a methacrylate resin, a vinyl alcohol resin, a polymer or copolymer of a vinyl compound such as ethyl vinyl ether, a polyvinyl butyral resin, a polyvinyl formal resin, a partially modified polyvinyl acetal, a polycarbonate resin, a polyester resin, a polyallylate resin, a polyamide resin, a polyurethane resin, a cellulose ester resin, a phenoxy resin, a silicone resin, a silicone/alkyd resin or a poly-N-vinylcarbazole resin. Such a resin may be modified with e.g. a silicon reagent.

In the present invention, it is particularly preferred to contain at least one polymer obtained by interfacial polymerization. The interfacial polymerization is a polymerization method utilizing a polycondensation reaction which is permitted to proceed at an interface between at least two solvents not miscible to each other i.e. in many cases, at an interface between an organic solvent and an aqueous solvent. For example, a dicarboxylate is dissolved in an organic solvent, and a glycol component is dissolved in alkaline water, and both liquids are mixed at room temperature and permitted to be separated into two phases, whereupon a polycondensation reaction is permitted to proceed at the interface to form a polymer. As another example of two components, phosgene and a glycol aqueous solution may, for example, be mentioned. Further, as in the case of the polycondensing a polycarbonate oligomer by interfacial polymerization, the interface may be utilized as the site for polymerization, as opposed to a case where two components are respectively separated in two phases.

As solvents for the reaction, it is preferred to use two layers of an organic phase and an aqueous phase. The organic phase is preferably methylene chloride, and the aqueous phase is preferably an alkaline aqueous solution. It is preferred to use a catalyst at the time of the reaction, and the amount of a condensation catalyst to be used for the reaction is usually from 0.005 to 0.1 mol %, preferably from 0.03 to 0.08 mol %, to the diol as the glycol component. If it exceed 0.1 mol %, it may sometimes require a substantial labor to extract and remove the catalyst in a cleaning step after the polycondensation, such being undesirable.

The temperature for the reaction is usually at most 80° C., preferably at most 60° C., more preferably within a range of from 10° C. to 50° C. The reaction time may vary depending upon the reaction temperature, but is usually from 0.5 minute to 10 hours, preferably from 1 minute to 2 hours. If the temperature for the reaction is too is high, a side reaction can hardly be controlled. On the other hand, if it is too low, the cooling load increases, thus leading to an increase of the cost, although such low temperature may be preferred from the viewpoint of control of the reaction.

Further, the concentration in the organic phase may be within a range where the obtainable composition is soluble, and specifically, it is at a level of from 10 to 40 wt %. The ratio of the organic phase is preferably from 0.2 to 1.0 by volume ratio to the aqueous phase i.e. the aqueous solution of an alkali metal hydroxide of the diol.

Further, it is preferred to adjust the amount of the solvent so that the concentration of the formed resin in the organic phase obtainable by the polycondensation will be from 5 to 30 wt %. Thereafter, an aqueous phase comprising water and an alkali metal hydroxide is added anew, and in order to adjust the polycondensation conditions, a condensation catalyst is preferably added, whereupon in accordance with an interfacial polycondensation method, the desired polycondensation is completed. The ratio of the organic phase to the aqueous phase during the polycondensation is preferably at a level of organic phase:water phase=1:0.2 to 1 by volume ratio.

The polymer to be formed by the interfacial polymerization is particularly preferably a polycarbonate resin, or a polyester resin (particularly preferably a polyallylate resin). Such a polymer is preferably a polymer obtained from an aromatic diol as the starting material, and as a preferred aromatic diol structure, one represented by the following formula (A) may be mentioned.

(A)

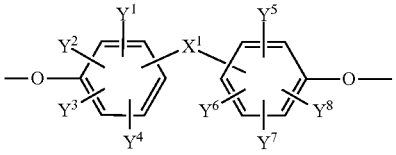

In the formula (A), $X^1$ represents a single bond or a connecting group which contains no cyclic structure, and each of $Y^1$ to $Y^8$ which are independent of one another, is a hydrogen atom or a substituent having at most 20 carbon atoms.

In the formula (A), $X^1$ is preferably a single bond or a group represented by the following structure. A "single bond" is meant for a state where there is no atom as "$X^1$" and the two benzene rings at the left and right in the formula (A) are simply bonded by a single bond.

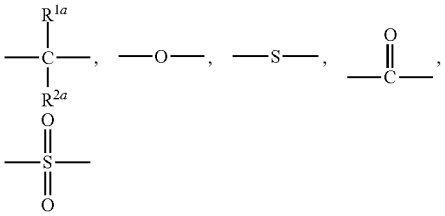

In the above structures, each of $R^{1a}$ and $R^{2a}$ which are independent of each other, is a hydrogen atom, a $C_{1-20}$ alkyl group, an aryl group which may be substituted, or a halogenated alkyl group.

Particularly preferred is a polycarbonate resin or polyallylate resin containing a bisphenol or biphenol component having the following structural formula, from the viewpoint of the sensitivity, residual potential, etc. Among them, the polycarbonate resin is more preferred from the viewpoint of the mobility.

The bisphenol or biphenol structure which may be suitably used for the polycarbonate resin will be exemplified below. This exemplification is intended to make the object clear, and the structure useful for the present invention is by no means restricted to the exemplified structures.

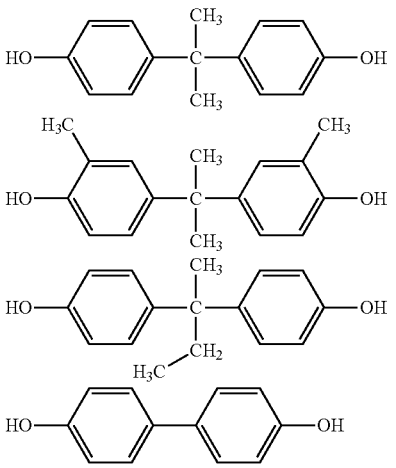

In order to maximize the effects of the present invention, it is particularly preferred to use a polycarbonate comprising a bisphenol derivative having the following structure.

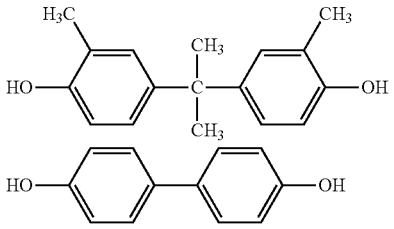

Further, in order to improve the mechanical properties, it is preferred to use a polyester, particularly a polyallylate, and in such a case, it is preferred to use the following structure as a bisphenol component.

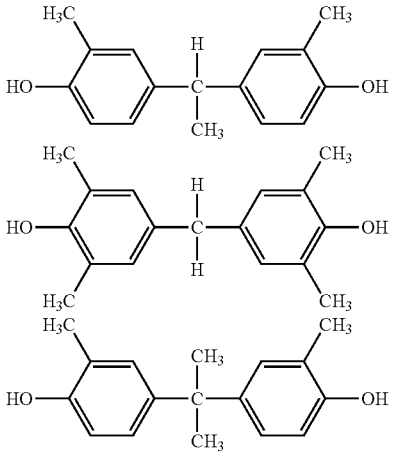

As an acid component, it is preferred to use the following structure.

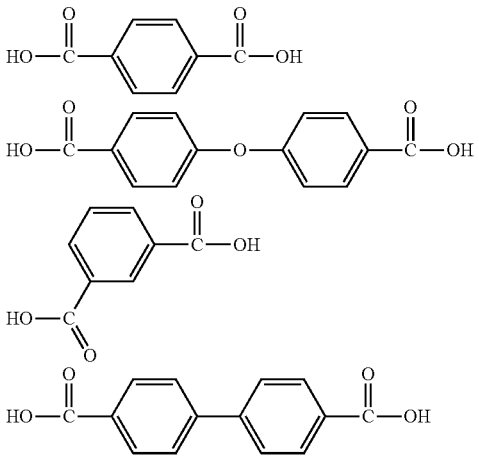

Further, in a case where terephthalic acid and isophthalic acid are used, it is preferred that the molar ratio of terephthalic acid is large.

The ratio of the charge transport material to the binder resin to be used for a photosensitive layer of a single layer type photoreceptor or for a charge transport layer of a laminated type photoreceptor, is such that in both the single layer type and the laminated type, the charge transport material is at least 20 parts by weight per 100 parts by weight of the binder resin, and with a view to reducing the residual potential, it is preferably at least 30 parts by weight. Further, from the viewpoint of the stability at the time of repeated use and the charge mobility, it is more preferably at least 40 parts by weight. On the other hand, from the viewpoint of the thermal stability of the photosensitive layer, it is usually at most 150 parts by weight, and from the viewpoint of the compatibility of the charge transport material and the binder resin, it is more preferably at most 120 parts by weight. Further, from the viewpoint of the printing resistance, it is further preferably at most 100 parts by weight, and from the viewpoint of the scratch resistance, it is particularly preferably at most 80 parts by weight.

In the case of the single layer photoreceptor, the above mentioned charge generation material is further dispersed in the charge transport medium in the above mentioned blend ratio. In such a case, the particle size of the charge generation material is required to be sufficiently small, and it is preferably at most 1 μm, more preferably at most 0.5 μm. If the amount of the charge generation material dispersed in the photosensitive layer is too small, no adequate sensitivity will be obtained, and if it is too large, there will be a problem such as a decrease in the charging property or sensitivity. Accordingly, it is preferably used in a range of from 0.1 to 50 wt %, preferably within a range of from 1 to 20 wt %.

The thickness of the photosensitive layer of the single layer type photoreceptor is usually within a range of from 5 to 100 μm, preferably from 10 to 50 μm, and the thickness of the charge transport layer of a regularly laminated type photoreceptor is usually within a range of from 5 to 50 μm, but from the viewpoint of long useful life and image stability, it is preferably from 10 to 45 μm, and from the viewpoint of high resolution, it is more preferably from 10 to 30 μm.

To the photosensitive layer, in order to improve the film-forming property, flexibility, coating properties, stain resistance, gas resistance, light resistance, etc., known additives such as an antioxidant, a plasticizer, an ultraviolet absorber, an electron attracting compound, a leveling agent, a visible light shielding agent, etc., may be incorporated. Further, the photosensitive layer may contain various additives such as leveling agent, an antioxidant, a sensitizer, etc. in order to improve the coating properties, as the case requires. Examples of the antioxidant may, for example, be a hindered phenol compound, a hindered amine compound, etc. Further, examples of the visible light shielding agent may, for example, be various types of colorant compounds, azo compounds, etc., and examples of the leveling agent may, for example, be silicone oil and a fluorinated oil.

Antioxidant

The antioxidant is a type of a stabilizer to be incorporated to prevent oxidation of a component contained in the photoreceptor. The antioxidant has a function as a radical scavenger, and specifically, a phenol derivative, an amine compound, a phosphonate, a sulfur compound, a vitamin or a vitamin derivative, may, for example, be mentioned.

Among them, a phenol derivative, an amine compound, a vitamin or the like is preferred. Particularly preferred is a hindered phenol having a bulky substituent near the hydroxyl group, or a trialkylamine derivative. Specifically, an aryl compound derivative having a t-butyl group at the o-position to the hydroxyl group, is preferred, and an aryl compound derivative having two t-butyl groups at the o-position to the hydroxyl group, is further preferred.

Further, if the molecular weight of the antioxidant is too large, there will be a problem in the ability of preventing oxidation. Therefore, preferred is a compound having the molecular weight of at most 1,500, particularly preferably at most 1,000. The lower limit is at least 100, preferably at least 150, further preferably at least 200.

Now, the antioxidant which can be used in the present invention will be shown. As the antioxidant which can be used in the present invention, it is possible to use any material known as an antioxidant, an ultraviolet absorber or a light stabilizer, for e.g. a plastic, a rubber, petroleum or fatty oil. However, it is particularly suitable to use a material selected from the following group of compounds.

(1) a phenol disclosed in JP-A-57-122444, a phenol derivative disclosed in JP-A-60-188956 or a hindered phenol disclosed in JP-A-63-18356.
(2) a paraphenylene diamine disclosed in JP-A-57-122444, a paraphenylene diamine derivative disclosed in JP-A-60-188956 or a paraphenylene diamine disclosed in JP-A-63-18356.
(3) a hydroquinone disclosed in JP-A-57-122444, a hydroquinone derivative disclosed in JP-A-60-188956 or a hydroquinone disclosed in JP-A-63-18356.
(4) a sulfur compound disclosed in JP-A-57-188956, or an organic sulfur compound disclosed in JP-A-63-18356.
(5) an organic phosphorus compound disclosed in JP-A-57-122444, or an organic phosphorus compound disclosed in JP-A-63-18356.
(6) a hydroxyanisole disclosed in JP-A-57-122444.
(7) a piperidine derivative or oxopiperazine derivative having a specific skeletal structure disclosed in JP-A-63-18355.
(8) a carotene, an amine, a tocopherol, a Ni(II) complex or a sulfide, disclosed in JP-A-60-188956.

Further, particularly preferred are the following hindered phenols (hindered phenols are phenols having a bulky substituent near the hydroxyl group): Dibutyl hydroxytoluene, 2,2'-methylenebis(6-t-butyl-4-methyl phenol), 4,4'-butylidenebis(6-t-butyl-3-methyl phenol), 4,4'-thiobis(6-t-butyl-3-methyl phenol), 2,2'-butylidenebis(6-t-butyl-4-methyl phenol), α-tocophenol, β-tocophenol, 2,2,4-trimethyl-6-hydroxy-7-t-butylchromane, pentaerystyl tetrakis[3-(3,5-di-t-butyl-4-hydroxyphenyl)propionate], 2,2'-thiodiethylenebis[3-(3,5-di-t-butyl-4-hydroxyphenyl)propionate], 1,6-hexane diolbis[3-(3,5-di-t-butyl-4-hydroxyphenyl)propionate], butylhydroxyanisole, dibutyl hydroxyanisole, octadecyl-3,5-di-tert-butyl-4-hydroxyhydrocinnamate and 1,3,5-trimethyl-2,4,6-tris(3,5-di-tert-butyl-4-hydroxybenzyl)-benzene.

Among the above hindered phenols, the following compound is particularly preferred:

Octadecyl-3,5-di-tert-butyl-4-hydroxyhydrocinnamate or 1,3,5-trimethyl-2,4,6-tris-(3,5-di-tert-butyl-4-hydroxybenzyl)-benzene.

Such a compound is known as an antioxidant for e.g. a rubber, a plastic or fatty oil, and some of them are commercially available.

In the photoreceptor to be used for the image forming apparatus of the present invention, the amount of the above antioxidant in the surface layer is not particularly limited, but it is preferably from 0.1 part by weight to 20 parts by weight, based on 100 parts by weight of the binder resin. If the amount is out of such a range, good electrical characteristics will not be obtained. Particularly preferred is at least 1 part by weight. Further, if the amount is too large, not only the electric characteristics but also printing durability may be impaired in some cases, and accordingly it is preferably at most 15 parts by mass, further preferably at most 10 parts by mass.

Electron Attractive Compound

The photoreceptor preferably contains an electron attractive compound. Specifically, it is preferably a sulfonate compound, a carbonate compound, an organic cyano compound, a nitro compound or an aromatic halogen derivative, more preferably a sulfonate or an organic cyano compound, particularly preferably a sulfonate compound. The photoreceptor has preferably at least one, more preferably at least two, further preferably at least three sulfonate structures, per molecule. The upper limit in number of such structures is preferably at most 10, further preferably at most 5.

The ability of attracting electrons may possibly be estimated by a value of an energy level of LUMO. Specifically, a compound is preferred wherein the value of an energy level of LUMO obtained by structural optimization by means of semiempirical molecular orbital calculation using PM3 parameters (hereinafter referred to simply as "by semiempirical molecular orbital calculation"), is from −1.0 eV to −3.0 eV. If the energy level of LUMO becomes smaller than 1.0 eV, it will not be possible to expect the effect for attracting electrons. If it exceeds 3.0 eV, there will be concern that the static electrification will deteriorate. The energy level of LUMO is more preferably at least 1.5 eV, further preferably at least 1.7 eV, further preferably at least 1.9 eV. The upper limit is preferably at most 2.7 eV, more preferably at most 2.5 eV.

As the electron attractive compound, the following compounds may, specifically, be mentioned.

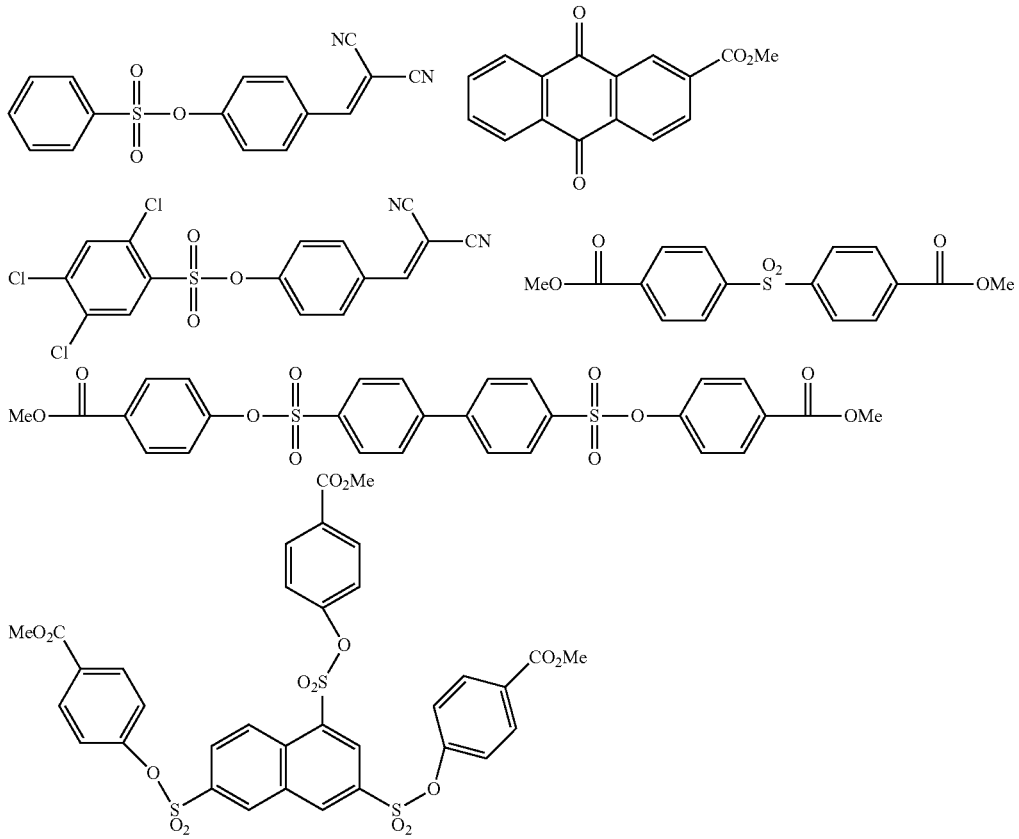

Outermost Surface Layer

The above charge generation material and charge transport material may be contained in any layer, but it is preferred that in the outermost surface layer, a fluorine atom or a silicon atom is present from the viewpoint of toner transfer, an improvement of the cleaning property, etc. Such an atom may be contained in any material such as an additive, a charge generation material, a charge transport material or a binder.

Surface Free Energy

Further, it is possible to detect the adhesion property of the surface of the photoreceptor as the surface free energy (equivalent to the surface tension). The value of the surface free energy of the outermost surface layer, is preferably in a range of from 35 mN/m to 65 mN/m. If it is too small, there will be a possibility that the toner starts to run. Further, if it is too high, the efficiency of toner transfer and cleaning property may possibly be deteriorated. The lower limit is preferably at least 40 mN/m, and the upper limit is preferably at most 55 mN/m, further preferably at most 50 mN/m.

Now, the surface free energy will be described. Attachment of foreign substances such as residual toner on the surface of the photoreceptor is in a category of a physical bonding, and the intermolecular force (van der Waals force) is the cause. As a phenomenon caused at the outermost surface layer by such an intermolecular force, a surface free energy ($\gamma$) is mentioned. The "wettability" of a material is generally classified into 3 types, i.e. "deposition wettability" wherein material 1 is deposited on material 2, "spreading wettability" wherein material 1 is spreaded on material 2, or "soaking wettability" wherein material 1 is soaked or penetrated into material 2.

As regards the deposition wettability, with respect to the surface free energy ($\gamma$) and wettability, the relation between material 1 and material 2 will be as follows by the Young equation.

$$\gamma_1=\gamma_2\cdot\cos\theta_{12}+\gamma_{12} \quad \text{Formula (1-1)}$$

$\gamma_1$: surface free energy of the surface of material 1

$\gamma_2$: surface free energy of the surface of material 2

$\gamma_{12}$: interface free energy of material 1/material 2

$\theta_{12}$: contact angle between material 1/material 2

In the above formula (1-1), when a contaminant or moisture is considered to be deposited on the surface of the photoreceptor in the image forming apparatus, material 1 is regarded as the photoreceptor and material 2 is regarded as the contaminant.

According to the formula (1-1), in order to make it hard for the surface to be wetted, namely, in order to increase $\theta_{12}$, it is effective to increase the surface free energy $\gamma_1$ of the surface of the photoreceptor, and decrease $\gamma_2$ and $\gamma_{12}$, which are "wet works" between the photoreceptor and the toner.

In the cleaning step for an electrophotograph, the surface free energy $\gamma_1$ of the photoreceptor, is controlled, and as a result, it is possible to control the deposition state on the right side of the formula (1-1). Further, with respect to durability, a toner and other foreign substances are products which are sequentially newly provided, and it is considered that $\gamma_2$ is constant. On the other hand, the surface free energy $\gamma_1$ of the photoreceptor changes depending on its durability. By the change of $\gamma_1$ by $\Delta\gamma_1$, the value of the right side of the formula (1-1) will consequently changes. That is, the state of the contaminant deposited on the surface of the photoreceptor changes, and as a result, the cleaning property or the load to the cleaning mechanism will change. In other words, by defining $\Delta\gamma_1$, it is possible to keep the cleaning property i.e. capability of being cleaned, at constant.

Here, with respect to the wetting between solid and liquid, it is possible to directly measure the contact angle $\theta_{12}$. However, in a case of solid and solid, like the photoreceptor and the toner, the contact angle $\theta_{12}$ cannot be measured. The photoreceptor and the toner in the present invention are usually solids, and such a case applies.

With respect to the Forkes' theory which describes a nonpolar intermolecular force with respect to an interfacial free energy (equivalent to the interfacial tension), in Journal of Adhesion Society of Japan 8 (3), 131 to 141 (1972), Yasuaki Kitazaki and Toshio Hata show that it is further possible to expand the theory to a component by means of the polarity or the intermolecular force by hydrogen bonding. By such an expanded Forkes theory, the surface free energy of each material may be obtained by 2 or 3 components. Taking the case of the deposition wettability as an example, the theory of 3 components will be described below. Such a theory consists of the following hypothesis.

1. Rule for addition of the surface free energy ($\gamma$):

$$\gamma=\gamma^d+\gamma^p+\gamma^h \qquad \text{Formula (1-2)}$$

$\gamma^d$: dispersion component (nonpolar wetting=deposition)

$\gamma^p$: dipole component (polar wetting=deposition)

$\gamma^h$: hydrogen-bonding component (wetting by hydrogen bonding=deposition)

By applying such a rule, the interfacial free energy $\gamma_{12}$ of 2 materials becomes as follows.

$$\gamma_{12}=\gamma_1+\gamma_2-2\cdot(\gamma_1^d\cdot\gamma_2^d)^{1/2}-2\cdot(\gamma_1^p\cdot\gamma_2^p)^{1/2}-2\cdot(\gamma_1^h\cdot\gamma_2^h)^{1/2} \qquad \text{Formula (1-3)}$$

$$\gamma_{12}=\{\sqrt{(\gamma_1^d)}-\sqrt{(\gamma_2^d)}\}^2+\{\sqrt{(\gamma_1^p)}-\sqrt{(\gamma_2^p)}\}^2-\{\sqrt{(\gamma_1^h)}-\sqrt{(\gamma_2^h)}\}^2 \qquad \text{Formula (1-4)}$$

The method for measuring the surface free energy is carried out in such a manner that using known reagents, of which the components p, d and h, of the surface free energy are known the adhesion properties are measured, and the surface energy is calculated. Specifically, by using an automatic contact angle meter CA-VP type manufactured by KYOWA INTERFACE SCIENCE CO., LTD, and using pure water, methylene iodide and $\alpha$-bromonaphthalene as the reagents, the contact angles of the above reagents to the photoreceptor were measured, respectively. The surface free energy $\gamma$ was calculated by a software FAMAS for an analysis of the surface free energy, manufactured by KYOWA INTERFACE SCIENCE CO., LTD. Other than the above reagents, it is possible to use ones having a proper combination of components of p, d and h, respectively. Further, with respect to the measuring method, other than the above one, it is possible to use a common method such as Wilhelmy method (plate method) or du Nouy method.

As mentioned above, there are multiple types of "wetting." However, with respect to a case where the toner is fixed or fused on the surface of the photoreceptor, it is greatly influenced by the fact that the toner remained on the surface of the photoreceptor is deposited on the photoreceptor, and as the steps such as cleaning, static electrification, etc. are repeated, the toner starts to spread on the surface of the photoreceptor as a film, and the strength of the deposition power becomes strong. Namely, such corresponds to a so-called "deposition wetting."

Further, also in the case of fixation, etc. of foreign substances such as paper powder, rosin, talc, etc. after the deposition, their contact surface (hereinafter referred to as the "interface") with the photoreceptor is increased, and the wetting becomes firm. Further, "wetting" by moisture of the surface of the photoreceptor or the foreign substances deposited on the surface of the photoreceptor, tends to cause a blurred image, so-called "high humidity flow".

With respect to such foreign substances, during the process for forming an electrophotographic image, various materials including a toner is once deposited on the surface of the photoreceptor. Among them, so-called "residual toner" and other foreign substances not transferred to a transfer material, are required to be cleaned or removed in a certain period of time. Here, the certain period of time means a period from the actual time when various materials are once deposited on the photoreceptor to a state wherein the area of the interface with the photoreceptor is increased by dispersion of the deposited materials and/or further deposition.

The characteristics of cleaning in the state within the above range, namely, "the deposition wetting" of the foreign materials deposited on the photoreceptor and "the spread wetting" are substantial factors influential over the actual cleaning characteristics or the useful life of the cleaning device or the photoreceptor. Therefore, the present inventors have considered that it is effective to define the surface free energy $\gamma$ of the photoreceptor, and they have conducted extensive studies, and as a result, have found it possible to obtain an electrophotographic image having a high image quality and high durability. Specifically, as material 2, namely as the above foreign substances, a toner, paper powder, moisture, silicone oil and many other types of foreign substances are considered.

In the present invention, with respect to the surface of the photoreceptor as material 1 which is the side to be attached, its surface free energy $\gamma_1$ was defined. Further, the above material 2 is supplied as needed during endurance process, while the surface of the photoreceptor as material 1 has its $\gamma_1$ changed by the durability. When the durability as an electrographic device for forming an image is to be studied, it is important to control the fluctuated portion $\Delta\gamma_1$.

Controlling

In order to obtain a high quality image constantly, the cleaning property of the photoreceptor, particularly the load for cleaning the photoreceptor is controlled. As a result of extensive studies, the present inventors have found it possible to obtain a good cleaning property with a low load by defining the value of the surface free energy $\gamma$ of the photoreceptor to be in a range of from 35 to 65 mN/m, more preferably from 40 to 60 mN/m. Further, by adjusting the amount Δγ fluctuated by durability to be within 25 mN/m, preferably within 15 mN/m, the fluctuations of loads on both the photoreceptor and cleaning devices were suppressed, and the cleaning characteristics were stabilized for a long period of time.

Especially, as the outermost layer of the photoreceptor, a protective layer may be provided for the purpose of preventing abrasion of the photosensitive layer or preventing or reducing deterioration of the photosensitive layer due to a discharging substance generated from e.g. a charging device. The protective layer may be formed by incorporating an electroconductive material in a suitable binder resin, or it is possible to employ a copolymer using a compound having a charge transporting ability such as a triphenylamine skeleton, as disclosed in JP-A-9-190004 and JP-A-10-252377. As the electroconductive material, an aromatic amino compound such as TPD (N,N'-diphenyl-N,N'-bis-(m-tolyl)benzidine) or a metal oxide such as antimony oxide, indium oxide, tin oxide, titanium oxide, tin oxide/antimony oxide, aluminum oxide or zinc oxide may, for example, be used, but it is not limited thereto. As the binder resin to be used for the protective layer, a known resin may be employed such as a polyamide resin, a polyurethane resin, a polyester resin, an epoxy resin, a polyketone resin, a polycarbonate resin, a polyvinyl ketone resin, a polystyrene resin, a polyacrylamide resin or a siloxane resin. Further, it is possible to use a copolymer of the above resin with a skeleton having a charge transport ability such as a triphenylamine skeleton as disclosed in JP-A-9-190004 or JP-A-10-252377. The above protective layer is preferably constructed so that the electrical resistance will be from $10^9$ to $10^{14}$Ω·cm. If the electrical resistance is higher than $10^{14}$Ω·cm, the residual potential increases, whereby images tend to have fogging. On the other hand, if it is lower than $10^9$Ω·cm, blurring of images or decrease in the resolution is likely to result. Further, the protective layer is required to be constructed not to substantially prevent transmittance of light irradiated for image exposure.

Further, for the purpose of reduction of the abrasion or friction resistance of the photoreceptor surface or increasing the transfer efficiency of the toner from the photoreceptor to the transfer belt or paper, the surface layer may contain a fluorine resin, a silicone resin, a polyethylene resin, a polystyrene resin or the like. Further, it may contain particles made of such a resin or particles of an inorganic compound.

Method for Forming Layers

The respective layers constituting a photoreceptor are formed by sequentially applying coating fluids containing materials constituting the respective layers on a substrate by a known coating method, by repeating coating/drying steps for every layer.

In the case of the single layer photoreceptor and the charge transport layer for the laminated type photoreceptor, the coating fluid for forming the layer is used with a solid content concentration being usually within a range of from 5 to 40 wt %, preferably from 10 to 35 wt %. Further, the viscosity of the coating fluid is usually within a range of from 10 to 500 mPa·s, preferably from 50 to 400 mPa·s.

In the case of the charge generation layer of the laminated type photoreceptor, the solid content concentration is usually within a range of from 0.1 to 15 wt %, preferably within a range of from 1 to 10 wt %. The viscosity of the coating fluid is usually within a range of from 0.01 to 20 mPa·s, but preferably within a range of from 0.1 to 10 mPa·s.

As the coating method for the coating fluid, a dip coating method, a spray coating method, a spinner coating method, a bead coating method, a wire bar coating method, a blade coating method, a roller coating method, an air knife coating method or a curtain coating method may, for example, be mentioned. However, other known coating methods may also be used.

Drying of the coating fluid is preferably carried out by heat drying within a temperature range of from 30 to 200° C. for from one minutes to two hours with or without circulating air, after tack-free drying at room temperature. Here, the heating temperature may be constant or may be changed during the drying.

Image Forming Apparatus

With reference to the drawings, the image-forming method using the image forming apparatus of the present invention will be described in further detail. FIG. 1 is a schematic view illustrating one embodiment of a developing apparatus using a non-magnetic one component toner which may be used for carrying out the image forming method. In FIG. 1, a toner 16 stored in a toner hopper 17 is forcibly brought to a roller-shaped sponge roller (a toner-supplying auxiliary member) 14 by stirring vanes 15, and the toner is supplied to the sponge roller 14. And, the toner taken into the sponge roller 14 is carried, by a rotation in the arrow direction of the sponge roller 14, to a toner transporting member 12 and rubbed to be electrostatically or physically adsorbed, and when the toner transporting member 12 is strongly rotated in the arrow direction, a uniform toner thin layer is formed by an elastic blade made of steel (a toner layer thickness-regulating member) 13, and at the same time, the toner thin layer is frictionally electrified. Then, the toner is carried to the surface of an electrostatic latent image carrier 11 which is in contact with the toner transporting member 12, whereby a latent image is developed. The electrostatic latent image is obtained, for example, by subjecting an organic photoreceptor to DC electrification with 500 V, followed by exposure.

The toner to be used for the image forming apparatus of the present invention has a sharp electrostatic charge distribution, whereby soiling (toner scattering) in the image forming apparatus which is likely to be caused by an insufficiently electrified toner, is very little. Such effects are remarkably observed particularly with a high speed type image forming apparatus with a development process speed of at least 100 mm/sec to the electrostatic latent image carrier.

Further, the toner to be used for the image forming apparatus of the present invention has a sharp electrostatic charge distribution, whereby the developing properties are very good, and toner particles accumulated without being developed are very little. Such effects are particularly remarkable with an image forming apparatus where the toner consumption speed is fast. Specifically, a toner to be used for an image forming apparatus, which satisfies the following formula (3) is particularly preferred as the above mentioned effects of the present invention can sufficiently be obtained.

$$\text{Guaranteed lifetime number of copies(sheets)by a developing machine having a developer packed} \times \text{print ratio} \geq 500\text{(sheets)} \quad (3)$$

In the formula (3), the "print ratio" is represented by a value obtained by dividing the total sum of the printed portion areas by the total area of the printing medium in a printed product for determining the guaranteed lifetime number of copies as the performance of the image forming apparatus. For example, the "print ratio" having a printed % of "5%" is "0.05".

Further, since the toner to be used for the image forming apparatus of the present invention has a very sharp particle size distribution, the reproducibility of a latent image is very good. Accordingly, the effects of the present invention are sufficiently obtained particularly when it is used for an image forming apparatus wherein the resolution to the electrostatic latent image carrier is at least 600 dpi.

Figure 2:
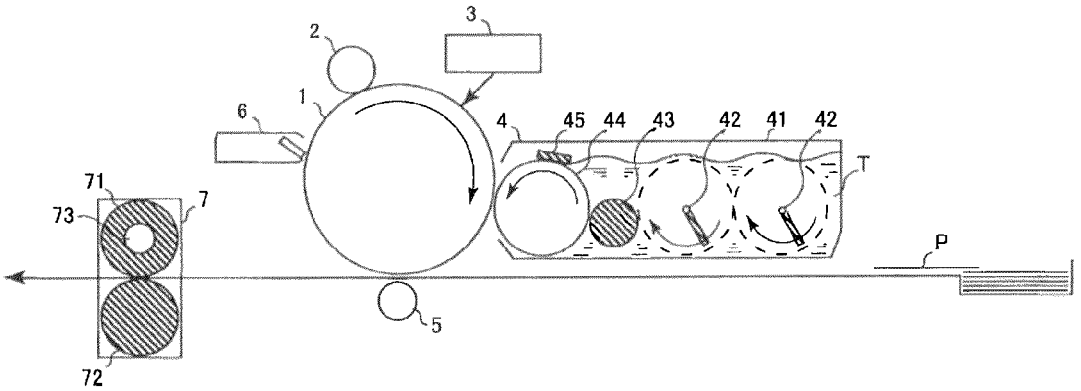
FIG. 2 is a schematic view of the essential construction illustrating an embodiment of the image forming apparatus of the present invention.

Now, an embodiment of the electrophotographic process of the image forming apparatus of the present invention will be described with reference to FIG. 2 illustrating the construction of the main portion of the apparatus. However, the practical embodiment is not limited to the following description, and may be optionally modified without departing from the concept of the present invention.

As shown in FIG. 2, the image forming apparatus comprises an electrophotographic photoreceptor 1, a charging device 2, an exposure device 3 and a developing device 4, and further, a transfer device 5, a cleaning device 6 and a fixing device 7 are provided as the case requires.

The electrophotographic photoreceptor 1 is not particularly limited so long as it is an electrophotographic photoreceptor to be used for the above described image forming apparatus of the present invention. In FIG. 2, as an example, a drum-shaped photoreceptor having the above described photosensitive layer formed on the surface of a cylindrical electroconductive substrate, is shown. Along the circumference of this electrophotographic photoreceptor 1, the charging device 2, the exposure device 3, the developing device 4, the transfer device 5 and the cleaning device 6 are respectively disposed.

The charging device 2 is one to electrostatically charge the electrophotographic photoreceptor 1, and it uniformly charges the surface of the electrophotographic photoreceptor 1 to a prescribed potential. In FIG. 2, as an example of the charging device 2, a roller type charging device (charging roller) is shown, but as other examples, a corona charging device such as corotron or scorotron, or a contact type charging device such as a charging brush may, for example, be frequently used.

The electrophotographic photoreceptor 1 and the charging device 2 are deigned, in many cases, in the form of a cartridge provided with both of them (hereinafter optionally referred to as a photoreceptor cartridge) so that the cartridge is detachable from the main body of the image forming apparatus. And, it is designed so that, in a case where e.g. the electrophotographic photoreceptor 1 or the charging device 2 has been deteriorated, such a photoreceptor cartridge may be detached from the main body of the image forming apparatus, and a separate fresh photoreceptor cartridge may be mounted on the main body of the image forming apparatus. Further, also with respect to the after-mentioned toner, in many cases, it is stored in a toner cartridge, and the toner cartridge is designed to be detachable from the main body of the image forming device, and a separate fresh toner cartridge may be mounted. Further, a cartridge may sometimes be used wherein the electrophotographic photoreceptor 1, the charging device 2 and the toner are all provided.

The exposure device 3 is not particularly limited in its type, so long as it is one capable of forming an electrostatic latent image on the photosensitive surface of the electrophotographic photoreceptor 1 by exposure of the electrophotographic photoreceptor 1. As a specific example, a halogen lamp, a fluorescent lamp, a laser such as a semiconductor laser or a He—Ne laser, or LED may, for example, be mentioned. Further, exposure may be carried out by an exposure system in the interior of the photoreceptor. Light for the exposure is optional, but it may, for example, be a monochromatic light with a wavelength of from 700 nm to 850 nm, a monochromatic light slightly inclined towards the short wavelength side with a wavelength of from 600 nm to 700 nm or a monochromatic light with a short wavelength of from 300 nm to 500 nm may be used for the exposure.

Particularly, in the case of an electrophotographic photoreceptor employing a phthalocyanine compound as a charge generation material, it is preferred to employ a monochromatic light with a wavelength of from 700 nm to 850 nm. In the case of an electrophotographic photoreceptor employing an azo compound, it is preferred to use a monochromatic light with a wavelength of at most 700 nm. In the case of an electrophotographic photoreceptor employing an azo compound, even when a monochromatic light with a wavelength of at most 500 nm is used as a light source, a sufficient sensitivity may be obtained in some cases, and therefore, it is particularly preferred to employ a monochromatic light with a wavelength of from 300 nm to 500 nm as the light source.

The developing device 4 is not particularly limited with respect to its type, and an optional device may be employed such as a dry developing system such as cascade development, one component electroconductive toner development or two-component magnetic brush development, or a wet developing system. In FIG. 2, the developing device 4 comprises a developer tank 41, an agitator 42, a feed roller 43, a developing roller 44 and a regulating member 45 and has a structure such that a toner T is stored in the interior of the developer tank 41. Further, as the case requires, a feeding device (not shown) to feed a toner T may be attached to the developing device 4. This feeding device is constituted so that the toner T can be fed from a container such as a bottle, a cartridge or the like.

The feed roller 43 is made of an electroconductive sponge or the like. The developing roller 44 is made of a metal roll of iron, stainless steel, aluminum or nickel, or a resin roll having such a metal roll coated with a silicone resin, an urethane resin, a fluorinated resin or the like. The surface of such a developing roller 44 may be subjected to smoothing processing or roughening processing, as the case requires.

The developing roller 44 is disposed between the electrophotographic photoreceptor 1 and the feed roller 43 and abuts on the electrophotographic photoreceptor 1 and the feed roller 43, respectively. The feed roller 43 and the developing roller 44 are rotated by a rotary-driving mechanism (not shown). The feed roller 43 carries the toner T stored and supplies the toner to the developing roller 44. The developing roller 44 carries the toner T supplied by the feed roller 43 and lets it contact the surface of the electrophotographic photoreceptor 1.

The regulating member 45 is formed by a resin blade of e.g. a silicone resin or an urethane resin, a metal blade of e.g. stainless steel, aluminum, copper, brass or phosphor bronze, or a blade having such a metal blade covered with a resin. Such a regulating member 45 abuts on the developing roller 44 and is pressed with a prescribed force (usual blade linear pressure is from 5 to 500 g/cm) against the developing roller 44. If necessary, this regulating member 45 may be provided with a function to impart electrostatic charge to the toner T by frictional electrification with the toner T.

The agitators 42 are respectively rotated by a rotary driving mechanism to stir the toner T and at the same time to transport the toner T to the feed roller 43 side. A plurality of agitators 42 may be provided by changing the shape, size, etc. of the vanes.

As the toner T, one having a small particle size i.e. a volume median diameter (Dv50) of from 4.0 μm to 7.0 μm and having the above mentioned specific particle size distribution, is used. Further, with respect to the shape of the toner particles, various ones may be used including one close to a spherical shape and one departed from a spherical shape like a potato shape. A polymerized toner is excellent in the uniformity of electrostatic charge and the transfer properties and thus is useful for high image quality.

The transfer device 5 is not particularly limited with respect to its type, and a device employing an optional system such as an electrostatic transfer method such as corona transfer, roller transfer or belt transfer, a pressure transfer method or an adhesion transfer method, may be used. Here, the transfer device 5 is one comprising a transfer charger disposed to face the electrophotographic photoreceptor 1, a transfer roller, a transfer belt, etc. Such a transfer device 5 is one whereby a prescribed voltage (transfer voltage) is applied in a polarity reverse to the charged potential of the toner T, and a toner image formed on the electrophotographic photoreceptor 1 is transferred to the record sheet (paper, medium) P.

The cleaning device 6 is not particularly limited, and an optional cleaning device may be employed such as a brush cleaner, a magnetic brush cleaner, an electrostatic brush cleaner, a magnetic roller cleaner or a blade cleaner. The cleaning device 6 is one to scrape off a remaining toner as attached to the photoreceptor 1 by a cleaning member to recover the remaining toner. However, in a case where the toner remaining on the surface of the photoreceptor is little or less, no cleaning device 6 may be provided.

The fixing device 7 comprises an upper fixing member (pressing roller) 71 and a lower fixing member (fixing roller) 72, and a heating device 73 is provided in the fixing member 71 or 72. FIG. 2 shows an embodiment wherein a heating device 73 is provided in the interior of the upper fixing member 71. As the upper and lower fixing members 71 and 72, a known heat fixing member may be used such as a fixing roll having a metal tube of e.g. stainless steel or aluminum covered with a silicon rubber, or a fixing roll or fixing sheet covered with a Teflon (registered trademark) resin. Further, the respective fixing members 71 and 72 may have such a construction that a release agent such as silicone oil is supplied in order to improve the release property, or may have such a construction that they are mutually pressed by e.g. a spring.

The toner transferred on the recording paper P is heated to a molten state when it passes between the upper fixing member 71 heated to a prescribed temperature and the lower fixing member 72 and cooled after the passing, whereby the toner is fixed on the recording paper P. Here, the fixing device is also not particularly limited in its type, and a fixing device by an optional system, such as one used here, heat roller fixing, flash fixing, oven fixing or pressure fixing, may be provided.

With the electrophotographic device constructed as described above, recording of an image is carried out as follows. Namely, the surface (the photosensitive surface) of the photoreceptor 1 is charged to a prescribed potential (e.g. −600 V) by the charging device 2. At that time, charging may be carried out by a DC voltage or by superimposing an AC voltage on a DC voltage. Then, the charged photosensitive surface of the photoreceptor 1 is exposed by the exposure device 3 depending on the image to be recorded thereby to form an electrostatic latent image on the photosensitive surface. And, development of the electrostatic latent image formed on the photosensitive surface of the photoreceptor 1 is carried out by the developing device 4.

In the developing device 4, the toner T supplied by the feed roller 43 is made to be a thin layer by the regulating member (developing blade) 45 and at the same time frictionally charged with a prescribed polarity (here the same polarity as the electrostatic potential of the photoreceptor 1, i.e. negative polarity), and transported as carried by the developing roller 44 and then contacted to the surface of the photoreceptor 1. When the charged toner T carried by the developing roller 44 is contacted with the surface of the photoreceptor 1, a toner image corresponding to the electrostatic latent to image will be formed on the photosensitive surface of the photoreceptor 1. And, this toner image is transferred to the recording paper P by the transfer device 5. Thereafter, the toner remaining on the photosensitive surface of the photoreceptor 1 without being transferred, will be removed by the cleaning device 6.

After transferring the toner image on the recording paper P, the recording paper is passed through the fixing device 7 to thermally fix the toner image on the recording paper P thereby to obtain a final image.

Further, the image forming apparatus may be constructed so that, for example, a neutralization step can be carried out in addition to the above described construction. The neutralization step is a step of carrying out neutralization of the electrophotographic photoreceptor by carrying out exposure of the electrophotographic photoreceptor, and as a neutralization device, a fluorescent lamp, LED or the like may be used. Further, light to be used in the neutralization step is, in many cases, light having an exposure energy with an intensity of at least three times of the exposure light.

Further, the image forming apparatus may further be modified. For example, it may be constructed so that a step such as a preexposure step or an auxiliary charging step may be carried out, or constructed so that offset printing is carried out. Further, it may be constructed to have a full color tandem system employing plural types of toners.

By using the above described toner in combination with the above described photoreceptor to be used for the image forming apparatus of the present invention excellent in the physical and electrical surface properties, it is possible to construct a system which is excellent in the image characteristics with little soiling of an image and has a high transferring efficiency.

EXAMPLES

Now, the present invention will be described in further detail with reference to Examples. However, it should be understood that the present invention is by no means restricted to the following Examples. In the following Examples, "parts" means "parts by weight".

Measuring Method and Definition of Volume Average Diameter ($M_V$)

The volume average diameter ($M_V$) of particles having a volume average diameter ($M_V$) of less than 1 μm was measured by means of Model: Microtrac Nanotrac 150 (hereinafter referred to simply as "Nanotrac"), manufactured by Nikkiso Co., Ltd., in accordance with the Instruction Manual of Nanotrac, using Microtrac Particle Analyzer Ver 10.1.2.-019EE, analysis soft, made by Nikkiso Co., Ltd., using, as a dispersing medium, deionized water having an electroconductivity of 0.5 μS/cm, under the following conditions or by inputting the following conditions, respectively, by a method described in the Instruction Manual.

With respect to wax dispersion and polymer primary particle dispersion:

Refractive index of solvent: 1.333
Time for measurement: 100 Seconds
Number of measuring times: Once
Refractive index of particles: 1.59
Permeability: Permeable
Shape: Spherical
Density: 1.04

With respect to pigment premix fluid and colorant dispersion:

Refractive index of solvent: 1.333

Time for measurement: 100 Seconds

Number of measuring times: Once

Refractive index of particles: 1.59

Permeability: Absorptive

Shape: Nonspherical

Density: 1.00

Measuring Method and Definition of Volume Median Diameter (Dv50)

Treatment before the measurement of the finally obtained toner after an auxiliary agent-adding step was carried out as follows. Into a cylindrical polyethylene (PE) beaker having an inner diameter of 47 mm and a height of 51 mm, 0.100 g of the toner was added by means of a spatula and 0.15 g of a 20 mass % DBS aqueous solution (NEOGEN S-20A, manufactured by Daiichi Kogyo Seiyaku Co., Ltd.) was added by means of a dropper. At that time, in order to avoid scattering of the toner to e.g. the brim of the beaker, the toner and the 20% DBS aqueous solution were put only at the bottom of the beaker. Then, by means of a spatula, the toner and the 20% DBS aqueous solution were stirred for 3 minutes until they became paste-like. Also at that time, due care was taken not to scatter the toner to e.g. the brim of the beaker.

Then, 30 g of a dispersion medium Isoton II (manufactured by Beckman Coulter K.K.) was added, followed by stirring for two minutes by means of a spatula to obtain an entirely uniform solution as visually observed. Then, a fluororesin-coated rotor having a length of 31 mm and a diameter of 6 mm was put into the beaker, followed by dispersion at 400 rpm for 20 minutes by means of a stirrer. At that time, at a rate of once for every three minutes, by means of a spatula, macroscopic particles as visually observed at the air-liquid interface and at the brim of the beaker were permitted to fall into the interior of the beaker and stirred to form a uniform dispersion. Then, the dispersion was filtered through a mesh having an aperture of 63 μm, and the obtained filtrate was taken as "the toner dispersion".

Further, in the measurement of the particle diameter in the step of producing toner matrix particles, a filtrate obtained by filtering the slurry during the aggregation through a mesh of 63 μm was taken as "the slurry liquid".

The volume median diameter (Dv50) of particles was measured by means of Multisizer III (manufactured by Beckman Coulter K.K. (aperture diameter: 100 μm) (hereinafter referred to simply as "Multisizer"), by using Isoton II as a dispersion medium, by diluting the above "toner dispersion" or "slurry liquid" so that the dispersoid concentration became 0.03 mass %, by using the Multisizer III analysis soft by setting the KD value to be 118.5. The measuring particle diameter range was set to be from 2.00 to 64.00 μm, and this range was discretized in 256 divisions at equal intervals by logarithmic scale, and one calculated based on such volume-based statistical values was taken as the volume median diameter (Dv50).

Measuring Method and Definition of Percentage in Number (Dns) of Toner Particles Having Particle Diameter of from 2.00 μm TO 3.56 μm Treatment before the measurement of the toner after an auxiliary agent-adding step was carried out as follows. Into a cylindrical polyethylene (PE) beaker having an inner diameter of 47 mm and a height of 51 mm, 0.100 g of the toner was added by means of a spatula and 0.15 g of a 20 mass % DBS aqueous solution (NEOGEN S-20A, manufactured by Daiichi Kogyo Seiyaku Co., Ltd.) was added by means of a dropper. At that time, in order to avoid scattering of the toner to e.g. the brim of the beaker, the toner and the 20% DBS aqueous solution were put only at the bottom of the beaker. Then, by means of a spatula, the toner and the 20% DBS aqueous solution were stirred for 3 minutes until they became paste-like. Also at that time, due care was taken not to scatter the toner to e.g. the brim of the beaker.

Then, 30 g of a dispersion medium Isoton II was added and stirred for two minutes by means of a spatula to obtain an entirely uniform solution as visually observed. Then, a fluororesin-coated rotor having a length of 31 mm and a diameter of 6 mm was put into the beaker, followed by dispersion at 400 rpm for 20 minutes by means of a stirrer. At that time, at a rate of once for every three minutes, by means of a spatula, macroscopic particles as visually observed at the air-liquid interface and at the brim of the beaker were permitted to fall into the interior of the beaker and stirred to form a uniform dispersion. Then, this dispersion was filtered through a mesh having an aperture of 63 μm, and the obtained filtrate was taken as a toner dispersion.

The percentage in number (Dns) of toner particles having a particle diameter of from 2.00 μm to 3.56 μm was measured by means of Multisizer (aperture diameter: 100 μm), by using Isoton II as a dispersion medium, by diluting the above "toner dispersion" or "slurry liquid" so that the dispersoid concentration became 0.03 mass %, by using Multisizer III analysis soft by setting the KD value to be 118.5.

The lower limit particle diameter of 2.00 μm is the detection limit of this measuring apparatus Multisizer, and the upper limit particle diameter of 3.56 μm is the prescribed value of channels in this measuring apparatus Multisizer. In the present invention, this region of the particle diameter of from 2.00 μm to 3.56 μm was taken as a fine powder region.

The measuring particle diameter range was set to be from 2.00 to 64.00 μm, and this range was discretized in 256 divisions at equal intervals by logarithmic scale, and on the basis of such number-based statistical values, the proportion of the particle diameter component of from 2.00 to 3.56 μm was calculated on the number base to obtain "Dns".

Measuring Method and Definition of Average Circularity

In the present invention, "average circularity" is measured as follows and defined as follows. Namely, toner matrix particles were dispersed in a dispersion medium (Isoton II, manufactured by Beckman Coulter K.K.) so that they became within a range of 5,720 to 7,140 particles/μL, and by means of a flow type particle image analyzing apparatus (FPIA2100, manufactured by SYSMEX CORPORATION), the measurement was carried out under the following apparatus conditions, and the obtained value is defined as the "average circularity". In the present invention, the same measurement is carried out three times, and an arithmetic average value of the three "average circularity" is adopted as the "average circularity".

Mode: HPF

Amount of HPF analysis: 0.35 μL

Number of HPF detection: 2,000 to 2,500 particles

The following is measured by the above apparatus, and automatically calculated within the above apparatus and shown, and the "degree of circularity" is defined by the following formula.

Degree of circularity=circumferential length of circle having the same area as the projected area of particle/circumferential length of the projected image of particle From 2,000 to 2,500 particles as the number of HPF detection are measured, and an arithmetic average (arithmetical mean) of the degrees of circularity of such individual particles is shown by the apparatus as the "average circularity".

Measuring Method of Electrical Conductivity

The measurement of the electrical conductivity was carried out by means of a conductivity meter (Personal SC meter model SC72 and detector SC72SN-11, manufactured by Yokogawa Electric Corporation) in accordance with a usual method in the Instruction Manual.

Measuring Methods of Melting Point Peak Temperature, Melting peak half value width, Crystallization Temperature and Crystallization Peak Half Value Width By using Model: SSC5200, manufactured by Seiko Instruments Inc., by the method disclosed in the Instruction Manual of the same company, the temperature was raised at a rate of 10° C./min from 10° C. to 110° C., and from the endothermic curve at that time, the melting point peak temperature and the melting peak half value width were measured, and then, the temperature was lowered at a rate of 10° C./min from 110° C., and from the exothermic curve at that time, the crystallization temperature and the crystallization peak half value width were measured.

Measuring Method of Solid Content Concentration

Using INFRARED MOISTURE DETERMINATION BALANCE model FD-100, manufactured by Kett Electric Laboratory, 1.00 g of a sample containing a solid content was accurately weighed on the balance, and the solid content concentration was measured under such conditions that the heater temperature was 300° C., and the heating time was 90 minutes.

Measuring Method of Electrostatic Charge Distribution (Standard Deviation of Electrostatic Charge)

0.8 g of a toner and 19.2 g of a carrier (ferrite carrier: F150, manufactured by Powdertech Co., Ltd.) were put into a sample bottle made of glass and stirred at 250 rpm for 30 minutes by means of a Recipro Shaker NR-1 (manufactured by TAITEC CORPORATION). The stirred toner/carrier mixture was subjected to the measurement of the electrostatic charge distribution by means of an E-Spart electrostatic charge distribution measuring apparatus (manufactured by Hosokawa Micron Corporation). From the obtained data, with respect to individual particles, values obtained by dividing their electrostatic charges by the respective particle diameters (a range of from −16.197 C/μm to +16.197 C/μm was discretized in 128 divisions at every 0.2551C/μm) were obtained, and the standard deviation of the results of measurement of 3,000 particles was obtained and taken as the standard deviation of electrostatic charge.

Actual Print Evaluation Methods

Actual Print Evaluation 1

80 g of a toner was charged into a cartridge of a 600 dpi machine of a non-magnetic one-component developing system, a roller charging, rubber developing roller-contact developing system with a developing speed of 164 mm/sec, a belt transfer system and a blade drum cleaning system with a guaranteed lifetime number of copies being 30,000 sheets at a 5% print ratio, employing, as a photoreceptor, the after-mentioned electrophotographic photoreceptor E1, and a chart of a 1% print ratio was continuously printed on 50 sheets.

Actual Print Evaluation 2

200 g of a toner was charged into a cartridge of a 600 dpi machine of a non-magnetic one-component developing system, a roller charging, rubber developing roller-contact developing system with a developing speed of 100 mm/sec, a belt transfer system, a blade drum cleaning system, with a guaranteed lifetime number of copies being 8,000 sheets at a 5% print ratio, employing, as a photoreceptor, the after-mentioned electrophotographic photoreceptor E14, and a chart of a 5% print ratio was continuously printed until a warning of "running out of toner" appeared.

Soiling

In "ACTUAL PRINT EVALUATION 1" using the after-mentioned electrophotographic photoreceptor E1, soiling of an image after printing 50 sheets was visually observed and judged by the following standards.

◎: No soiling observed

○: Very slight soiling observed but acceptable level

Δ: Slight soiling observed partly

X: Distinct soiling observed partly or entirely

Further, in Tables, "–" means "not evaluated".

Residual Images (Ghosts)

In "ACTUAL PRINT EVALUATION 2" using the after-mentioned electrophotographic photoreceptor E14, a solid image was printed, and the image density at the forward end portion and the image density at a portion printed after two rotations of the developing roller therefrom, were measured, respectively, by X-rite 938 (manufactured by X-Rite), whereupon the ratio (%) to the forward end portion, of the image density after the two rotations, was obtained.

◎: No problem at all (at least 98%)

○: Very slight difference in the image density observed but acceptable level (at least 95% and less than 98%)

Δ: Slight difference in the image density observed (at least 85% and less than 95%)

X: Distinct difference in the image density observed (less than 85%)

Blurring (Blotted Image Follow-Up Properties)

In "ACTUAL PRINT EVALUATION 2" using the after-mentioned electrophotographic photoreceptor E14, a solid image was printed, and the image density at the forward end portion and the image density at the rear end portion were measured, respectively, by X-rite 938 (manufactured by X-Rite), whereupon the ratio (%) to the forward end portion, of the image density at the rear end portion, was obtained.

◎: No problem at all (at least 80%)

○: Very slight blurring observed at the rear end but acceptable level (at least 70% and less than 80%)

X: Substantial blurring observed at the rear end (less than 70%)

Cleaning Properties

In "ACTUAL PRINT EVALUATION 2" using the after-mentioned electrophotographic photoreceptor E14, soiling of an image after printing 8,000 sheets, was visually observed to ascertain whether or not there was soiling of an image due to drum cleaning failure.

○: No soiling observed

Δ: Slight soiling observed partly

X: Distinct soiling observed partly or entirely

Toner Production Example 1

Preparation of Wax/Long Chain Polymerizable Monomer Dispersion A1

27 Parts (540 g) of paraffin wax (HNP-9, manufactured by NIPPON SEIRO CO., LTD., surface tension: 23.5 mN/m, thermal characteristics: melting point peak temperature: 82° C., heat of fusion: 220 J/g, melting peak half value width: 8.2° C., crystallization temperature: 66° C., crystallization peak half value width: 13.0° C.), 2.8 parts of stearyl acrylate (manufactured by Tokyo Kasei K.K.), 1.9 parts of a 20 mass % sodium dodecylbenzenesulfonate aqueous solution (NEOGEN S20A, manufactured by Daiichi Kogyo Seiyaku Co., Ltd.) (hereinafter referred to simply as "20% DBS aqueous solution") and 68.3 parts of deionized water were heated to 90° C. and stirred for 10 minutes by using a homomixer (Mark II f model, manufactured by Tokushu Kika Kogyo K.K.).

Then, this dispersion was heated to 90° C., and by using a homogenizer (15-M-8PA model, manufactured by GAULIN), circulation emulsification was initiated under a pressure condition of 25 MPa. The particle size was measured by Nanotrac, and dispersion was carried out until the volume average diameter (Mv) became 250 nm to prepare a wax/long chain polymerizable monomer dispersion A1 (emulsion solid content concentration=30.2 mass %).

Preparation of Polymer Primary Particle Dispersion A1

Into a reactor (internal capacity: 21 L, inner diameter: 250 mm, height: 420 mm) equipped with an agitation device (three vanes), a heating/cooling device, a concentrating device and the respective material/agent feeding devices, 35.6 parts (712.12 g) of the above wax/long chain polymerizable monomer dispersion A1 and 259 parts of deionized water were charged and heated to 90° C. in a nitrogen stream with stirring.

Then, while stirring of the above liquid was continued, a mixture of the following "polymerizable monomers" and "emulsifier aqueous solution" was added over a period of 5 hours. The time when dropwise addition of this mixture was initiated is taken as "initiation of polymerization", and the following "initiator aqueous solution" was added over a period of 4.5 hours after 30 minutes from the initiation of polymerization, and further, the following "additional initiator aqueous solution" was added over a period of two hours after 5 hours from the initiation of polymerization, and while stirring was further continued, the internal temperature was maintained at 90° C. for one hour.

| POLYMERIZABLE MONOMERS | |
|---|---|
| Styrene | 76.8 Parts (1,535.0 g) |
| Butyl acrylate | 23.2 Parts |
| Acrylic acid | 1.5 Parts |
| Hexanediol diacrylate | 0.7 Part |
| Trichlorobromomethane | 1.0 Part |
| EMULSIFIER AQUEOUS SOLUTION | |
| 20% DBS aqueous solution | 1.0 Part |
| Deionized water | 67.1 Parts |
| INITIATOR AQUEOUS SOLUTION | |
| 8 Mass % hydrogen peroxide aqueous solution | 15.5 Parts |
| 8 Mass % L(+)-ascorbic acid aqueous solution | 15.5 Parts |
| ADDITIONAL INITIATOR AQUEOUS SOLUTION | |
| 8 Mass % L(+)-ascorbic acid aqueous solution | 14.2 Parts |

After completion of the polymerization reaction, the reaction solution was cooled to obtain a milky white polymer primary particle dispersion A1. The volume average diameter (Mv) measured by using Nanotrac was 280 nm, and the solid content concentration was 21.1 mass %.

Preparation of Polymer Primary Particle Dispersion A2

Into a reactor (internal volume: 21 L, inner diameter: 250 mm, height: 420 mm) equipped with an agitation device (three vanes), a heating/cooling device, a concentrating device and the respective material/agent feeding devices, 1.0 part of a 20 mass % DBS aqueous solution and 312 parts of deionized water were charged and heated to 90° C. in a nitrogen stream, and with stirring, 3.2 parts of a 8 mass % hydrogen peroxide aqueous solution and 3.2 parts of a 8 mass % L(+)-ascorbic acid aqueous solution were added all at once. The time after 5 minutes from the time of addition all at once is taken as "initiation of polymerization".

A mixture of the following "polymerizable monomers" and "emulsifier aqueous solution" was added over a period of 5 hours from the initiation of polymerization, and the following "initiator aqueous solution" was added over a period of 6 hours from the initiation of polymerization. Then, while stirring was continued, the internal temperature was maintained at 90° C. for one hour.

| POLYMERIZABLE MONOMERS | |
|---|---|
| Styrene | 92.5 Parts (1,850.0 g) |
| Butyl acrylate | 7.5 Parts |
| Acrylic acid | 0.5 Part |
| Trichlorobromomethane | 0.5 Part |
| EMULSIFIER AQUEOUS SOLUTION | |
| 20% DBS aqueous solution | 1.5 Parts |
| Deionized water | 66.0 Parts |
| INITIATOR AQUEOUS SOLUTION | |
| 8 Mass % hydrogen peroxide aqueous solution | 18.9 Parts |
| 8 Mass % L(+)-ascorbic acid aqueous solution | 18.9 Parts |

After completion of the polymerization reaction, the reaction mixture was cooled to obtain a milky white polymer primary particle dispersion A2. The volume average diameter (Mv) measured by using Nanotrac was 290 nm, and the solid content concentration was 19.0 mass %.

Preparation of Colorant Dispersion A

Into a container having an internal capacity of 300 L and equipped with a stirrer (propeller vanes), 20 parts (40 kg) of carbon black (Mitsubishi Carbon Black MA100S, manufactured by Mitsubishi Chemical Corporation) produced by a furnace method and having a true density of 1.8 g/cm$^3$ and an ultraviolet ray absorbance of a toluene extract liquid being 0.02, 1 part of a 20% DBS aqueous solution, 4 parts of a nonionic surfactant (EMULGEN 120, manufactured by Kao Corporation) and 75 parts of deionized water having an electrical conductivity of 2 μS/cm, were added and preliminarily dispersed to obtain a pigment premix fluid. The volume average diameter (Mv) of carbon black in the dispersion after pigment premix, as measured by Nanotrac, was 90 μm.

The above pigment premix fluid was supplied, as a raw material slurry, to a wet system beads mill and subjected to one-pass dispersion. Here, the inner diameter of the stator was 75 mm, the diameter of the separator was 60 mm, and the distance between the separator and the disk was 15 mm. As dispersing media, zirconia beads (true density: 6.0 g/cm$^3$) having a diameter of 100 μm were used. The effective internal capacity of the stator was 0.5 L, and the packed volume of media was 0.35 L, whereby the packed ratio of media was 70 mass %. While the rotational speed of the rotor was set to be constant (the circumferential speed of the forward end of the rotor was 11 m/sec), the above pigment premix fluid was continuously supplied from the feed inlet at a feeding speed of 50 L/hr by a non-pulsation metering pump, and continuously discharged from the discharge outlet to obtain a black colorant dispersion A. The volume average diameter (Mv) obtained by measuring the colorant dispersion A by Nanotrac was 150 nm, and the solid content concentration was 24.2 mass %.

Production of Toner Matrix Particles A

Using the following respective components, the following aggregation step (core material-aggregating step and shell-covering step), rounding step, washing step and drying step were continuously carried out to obtain toner matrix particles A.

Polymer primary particle dispersion A1: 95 Parts as solid content (998.2 g as solid content)

Polymer primary particle dispersion A2: 5 Parts as solid content

Colorant dispersion A: 6 Parts as colorant solid content

20% DBS aqueous solution: 0.2 Part as solid content in the core material-aggregating step 20% DBS aqueous solution: 6 Parts as solid content in the rounding step ○ Core Material-Aggregating Step Into a mixer (capacity: 12 L, inner diameter: 208 mm, height: 355 mm) equipped with an agitation device (double helical vanes), a heating/cooling device, a concentrating device and the respective material/agent charging devices, the polymer primary particle dispersion A1 and the 20% DBS aqueous solution were charged and uniformly mixed for 5 minutes at an internal temperature of 7° C. Then, with continuous stirring at an internal temperature of 7° C. at 250 rpm, a 5 mass % aqueous solution of ferric sulfate was added in an amount of 0.52 part as $FeSO_4.7H_2O$, over a period of 5 minutes, and then the colorant dispersion A was added over a period of 5 minutes, followed by mixing uniformly at an internal temperature of 7° C. Further, under the same conditions, a 0.5 mass % aluminum sulfate aqueous solution was dropwise added over a period of 8 minutes (solid content being 0.10 part to the resin solid content). Then, while maintaining the rotational speed at 250 rpm, the internal temperature was raised to 54.0° C., and by using Multisizer, the volume median diameter (Dv50) was measured, and the particles were grown to 5.32 μm.

○ Shell-Covering Step

Then, while maintaining the internal temperature at 54.0° C. and the rotational speed at 250 rpm, the polymer primary particle dispersion A2 was added over a period of 3 minutes, followed by stirring under the same condition for 60 minutes.

○ Rounding Step

Then, the rotational speed was reduced to 150 rpm (circumferential speed of the forward ends of stirring vanes: 1.56 m/sec, reduction of the stirring speed by 40% relative to rotational speed in the agglomeration step), and then, the 20% DBS aqueous solution (6 parts as solid content) was added over a period of 10 minutes. Then, the temperature was raised to 81° C. over a period of 30 minutes, and heating/stirring were continued under this condition until the average circularity became 0.943. Thereafter, the temperature was lowered to 30° C. over a period of 20 minutes to obtain a slurry.

○ Washing Step

The obtained slurry was withdrawn and subjected to suction filtration by an aspirator by using a filter paper of grade 5C (No5C, manufactured by Toyo Roshi Kaisha, Ltd.). The cake which remained on the filter paper was transferred to a stainless steel container having an internal capacity of 10 L equipped with a stirrer (propeller vanes) and uniformly dispersed by adding 8 kg of deionized water having an electrical conductivity of 1 μS/cm and stirring at 50 rpm, followed by continuously stirring for 30 minutes.

Then, the dispersion was again subjected to suction filtration by an aspirator by using a filter paper of grade 5C (No5C, manufactured by Toyo Roshi Kaisha, Ltd.), and the solid which remained on the filter paper was again transferred to a container having an internal capacity of 10 L, equipped with a stirrer (propeller vanes) and containing 8 kg of deionized water having an electrical conductivity of 1 μS/cm, and uniformly dispersed by stirring at 50 rpm, followed by continuous stirring for 30 minutes. This process was repeated five times, whereupon the electrical conductivity of the filtrate became 2 μS/cm.

○ Drying Step

The solid product thereby obtained was spread on a stainless steel vat so that the height became 20 mm and dried for 48 hours in an air-circulating dryer set at 40° C. to obtain toner matrix particles A.

Production of Toner A

○ Auxiliary Agent-Adding Step

To 250 g of the obtained toner matrix particles A, 1.55 g of silica H2000, manufactured by Clariant K.K. and 0.62 g of fine thitania powder SMT150IB manufactured by Tayca Corporation were mixed as auxiliary agents, followed by mixing for one hour at 6,000 rpm by a sample mill (manufactured by Kyoritsu Riko K.K.) and then by sieving with 150 mesh to obtain toner A.

○ Analysis Step

The "volume median diameter (Dv50)" of the toner A thus obtained, as measured by means of Multisizer, was 5.54 μm, "the percentage in number (Dns) of toner particles having a particle diameter of from 2.00 μm to 3.56 μm" was 3.83%, and the average circularity was 0.943.

Toner Production Example 2

Production of Toner Matrix Particles B

Toner matrix particles B were obtained in the same manner as in "PRODUCTION OF TONER MATRIX PARTICLES A" in Toner Production Example 1 except that in the aggregation step (core material-aggregating step and shell-covering step), the rounding step, the washing step and the drying step in "PRODUCTION OF TONER MATRIX PARTICLES A", "core material-aggregating step", "shell-covering step" and "rounding step" were changed as follows.

○ Core Material-Aggregating Step

Into a mixer (capacity: 12 L, inner diameter: 208 mm, height: 355 mm) equipped with an agitation device (double helical vanes), a heating/cooling device, a concentrating device and the respective material/agent feeding devices, the polymer primary particle dispersion A1 and the 20% DBS aqueous solution were charged and uniformly mixed for 5 minutes at an internal temperature of 7° C. Then, while maintaining the internal temperature at 7° C. and continuously stirring at 250 rpm, a 5 mass % aqueous solution of ferrous sulfate was added in an amount of 0.52 part as $FeSO_4.7H_2O$ over a period of 5 minutes. Then, the colorant dispersion A was added over a period of 5 minutes, followed by mixing uniformly at the internal temperature of 7° C., and further under the same conditions, a 0.5 mass % aluminum sulfate aqueous solution was dropwise added over a period of 8 minutes (the solid content being 0.10 part to the resin solid content). Then, while maintaining the rotational speed at 250 rpm, the internal temperature was raised to 55.0° C., and the volume median diameter (Dv50) was measured by using Multisizer, and the particles were grown to 5.86 μm.

○ Shell-Covering Step

Then, while maintaining the internal temperature at 55.0° C. and the rotational speed at 250 rpm, the polymer primary particle dispersion A2 was added over a period of 3 minutes, followed by stirring under the same condition for 60 minutes.

○ Rounding Step

Then, the rotational speed was reduced to 150 rpm (circumferential speed of the forward ends of stirring vanes: 1.56 m/sec, the stirring speed reduced by 40% relative to the rotational speed in the aggregation step), and then, the 20% DBS aqueous solution (6 parts as solid content) was added over a period of 10 minutes, and then, the temperature was raised to 84° C. over a period of 30 minutes, whereupon heating and stirring were continued until the average circularity became 0.942. Thereafter, the temperature was lowered to 30° C. over a period of 20 minutes to obtain a slurry.

Production of Toner B

Then, toner B was obtained by the same operation as in the auxiliary agent-adding step in "PRODUCTION OF TONER A" except that as the auxiliary agents, the amount of silica H2000 was changed to 1.41 g, and the amount of the fine titania powder SMT150IB was changed to 0.56 g.

○ Analysis Step

The volume median diameter (Dv50) of toner B thus obtained, as measured by using Multisizer, was 5.97 μm, "the percentage in number (Dns) of toner particles having a particle diameter of from 2.00 μm to 3.56 μm" was 2.53%, and the average circularity was 0.943.

Toner Production Example 3

Production of Toner Matrix Particles C

Toner matrix particles C were obtained in the same manner as in "PRODUCTION OF TONER MATRIX PARTICLES A" in Toner Production Example 1 except that in the aggregation step (core material-aggregating step and shell-covering step), the rounding step, the washing step and the drying step in "PRODUCTION OF TONER MATRIX PARTICLES A", "core material-aggregating step", "shell-covering step" and "rounding step" were changed as follows.

○ Core Material-Aggregating Step

Into a mixer (capacity: 12 L, inner diameter: 208 mm, height: 355 mm) equipped with an agitation device (double helical vanes), a heating/cooling device, a concentrating device and the respective material/agent feeding devices, the polymer primary particle dispersion A1 and the 20% DBS aqueous solution were charged and uniformly mixed for 5 minutes at the internal temperature of 7° C. Then, while the internal temperature was maintained at 7° C. and stirring was continued at 250 rpm, a 5 mass % aqueous solution of ferrous sulfate was added in an amount of 0.52 part as $FeSO_4.7H_2O$ over a period of 5 minutes. And then, the colorant dispersion A was added over a period of 5 minutes, followed by mixing uniformly at the internal temperature of 7° C. Further, under the same conditions, a 0.5 mass % aluminum sulfate aqueous solution was dropwise added over a period of 8 minutes (the solid content being 0.10 part relative to the resin solid content). Then, while maintaining the rotational speed at 250 rpm, the internal temperature was raised to 57.0° C., and the volume median diameter (Dv50) was measured by using Multisizer, and the particles were grown to 6.72 μm.

○ Shell-Covering Step

Then, while maintaining the internal temperature at 57.0° C. and the rotational speed at 250 rpm, the polymer primary particle dispersion A2 was added over a period of 3 minutes, followed by stirring continuously for 60 minutes.

○ Rounding Step

Then, the rotational speed was reduced to 150 rpm (peripheral speed of the forward ends of stirring vanes: 1.56 m/sec, the stirring speed reduced by 40% relative to the rotational speed in the aggregation step), the 20% DBS aqueous solution (6 parts as solid content) was added over a period of 10 minutes, and then, the temperature was raised to 87° C. over a period of 30 minutes, and heating and stirring were continued until the average circularity became 0.941. Then, the temperature was lowered to 30° C. over a period of 20 minutes to obtain a slurry.

Production of Toner C

Then, toner C was obtained in the same manner as in the auxiliary agent-adding step in "PRODUCTION OF TONER A" except that as auxiliary agents, the amount of silica H2000 was changed to 1.25 g, and the amount of fine titania powder SMT150IB was changed to 0.50.

○ Analysis Step

The volume median diameter (Dv50) of toner C thereby obtained, as measured by using Multisizer, was 6.75 p "the percentage in number (Dns) of toner particles having a particle diameter of from 2.00 μm to 3.56 μm" was 1.83%, and the average circularity was 0.942.

Toner Production Example 4

Production of Toner Matrix Particles D

Toner matrix particles D were obtained in the same manner as in "PRODUCTION OF TONER MATRIX PARTICLES A" in Toner Production Example 1 except that in the aggregation step (core material-aggregating step and shell-covering step), rounding step, washing step and drying step in "PRODUCTION OF TONER MATRIX PARTICLES A", "core material-aggregating step", "shell-covering step" and "rounding step" were changed as follows.

○ Core Material-Aggregating Step

Into a mixer (capacity: 12 L, inner diameter: 208 mm, height: 355 mm) equipped with an agitation device (double helical vanes), a heating/cooling device, a concentrating device and the respective material/agent feeding devices, the polymer primary particle dispersion A1 and the 20% DBS aqueous solution were charged and uniformly mixed for 5 minutes at an internal temperature of 7° C. Then, while maintaining the internal temperature at 21° C. and continuously stirring at 250 rpm, a 5 mass % aqueous solution of ferrous sulfate was added in an amount of 0.52 part as $FeSO_4.7H_2O$ over a period of 5 minutes. And then, the colorant dispersion A was added over a period of 5 minutes, followed by mixing uniformly at the internal temperature of 7° C. Further, under the same conditions, a 0.5 mass % aluminum sulfate aqueous solution was dropwise added over a period of 8 minutes (the solid content being 0.10 part relative to the resin solid content). Then, while maintaining the rotational speed at 250 rpm, the internal temperature was raised to 54.0° C., and the volume median diameter (Dv50) was measured by using Multisizer, and particles were grown to 5.34 μm.

○ Shell-Covering Step

Then, while maintaining the internal temperature at 54.0° C. and the rotational speed at 250 rpm, the polymer primary particle dispersion A2 was added over a period of 3 minutes, followed by continuous stirring under the same conditions for 60 minutes.

○ Rounding Step

Then, the rotational speed was reduced to 220 rpm (circumferential speed of the forward ends of stirring vanes: 2.28 m/sec, the stirring speed reduced by 12% relative to the rotational speed in the aggregation step), the 20% DBS aqueous solution (6 parts as solid content) was added over a period of 10 minutes, and then, the temperature was raised to 81° C. over a period of 30 minutes. Heating and stirring were continued until the average circularity became 0.942. Then, the temperature was lowered to 30° C. over a period of 20 minutes to obtain a slurry.

Production of Toner D

Then, toner D was obtained in the same manner as in the auxiliary agent-adding step in "PRODUCTION OF TONER A" in Toner Production Example 1.

○ Analysis Step

The volume median diameter (Dv50) of toner D thereby obtained, as measured by using Multisizer, was 5.48 μm, "the percentage in number (Dns) of toner particles having a particle diameter of from 2.00 μm to 3.56 μm" was 4.51%, and the average circularity was 0.943.

Toner Production Example 5

Production of Toner Matrix Particles E

Toner matrix particles E were obtained in the same manner as in "PRODUCTION OF TONER MATRIX PARTICLES A" in Toner Production Example 1 except that in the aggregation step (core material-aggregating step and shell-covering step), rounding step, washing step and drying step in "PRODUCTION OF TONER MATRIX PARTICLES A", "core material-aggregating step", "shell-covering step" and "rounding step" were changed as follows.

○ Core Material-Aggregating Step

Into a mixer (capacity: 12 L, inner diameter: 208 mm, height: 355 mm) equipped with an agitation device (double helical vanes), a heating/cooling device, a concentrating device and the respective material/agent feeding devices, the polymer primary particle dispersion A1 and the 20% DBS aqueous solution were charged and uniformly mixed for 5 minutes at an internal temperature of 7° C. Then, while maintaining the internal temperature at 21° C. and continuously stirring at 250 rpm, a 5 mass % aqueous solution of ferrous sulfate was added in an amount of 0.52 part as $FeSO_4.7H_2O$ over a period of 5 minutes. And then, the colorant dispersion A was added over a period of 5 minutes, followed by mixing uniformly at an internal temperature of 7° C. Further, under the same conditions, a 0.5 mass % aluminum sulfate aqueous solution was dropwise added over a period of 8 minutes (the solid content being 0.10 part relative to the resin solid content). Then, while maintaining the rotational speed at 250 rpm, the internal temperature was raised to 55.0° C., and the volume median diameter (Dv50) was measured by using Multisizer, and the particles were grown to 5.86 μm.

○ Shell-Covering Step

Then, while maintaining the internal temperature at 55.0° C. and the rotational speed at 250 rpm, the polymer primary particle dispersion A2 was added over a period of 3 minutes, followed by continuous stirring under the same condition for 60 minutes.

○ Rounding Step

Then, the rotational speed was reduced to 220 rpm (circumferential speed of the forward ends of stirring vanes: 2.28 m/sec, the stirring speed reduced by 12% relative to the rotational speed in the aggregation step), and then, the 20% DBS aqueous solution (6 parts as solid content) was added over a period of 10 minutes, then, the temperature was raised to 84° C. over a period of 30 minutes, and heating and stirring were continued until the average circularity became 0.941. Then, the temperature was lowered to 30° C. over a period of 20 minutes to obtain a slurry.

Production of Toner E

Then, toner E was obtained in the same manner as in the auxiliary agent-adding step in "PRODUCTION OF TONER A" except that as auxiliary agents, the amount of silica H2000 was changed to 1.41 g, and the amount of fine titania powder SMT150IB was changed to 0.56 g.

○ Analysis Step

The volume median diameter (Dv50) of toner E for development thereby obtained, as measured by using Multisizer, was 5.93 μm, "the percentage in number (Dns) of toner particles having a particle diameter of from 2.00 μm to 3.56 μm" was 3.62%, and the average circularity was 0.942.

Toner Production Example 6

Production of Toner Matrix Particles F

Toner matrix particles F were obtained in the same manner as in "PRODUCTION OF TONER MATRIX PARTICLES A" in Toner Production Example 1 except that in the aggregation step (core material-aggregating step and shell-covering step), rounding step, washing step and drying step in "PRODUCTION OF TONER MATRIX PARTICLES A", "core material-aggregating step", "shell-covering step" and "rounding step" were changed as follows.

○ Core Material-Aggregating Step

Into a mixer (capacity: 12 L, inner diameter: 208 mm, height: 355 mm) equipped with an agitation device (double helical vanes), a heating/cooling device, a concentrating device and the respective material/agent feeding devices, the polymer primary particle dispersion A1 and the 20% DBS aqueous solution were charged and uniformly mixed for 5 minutes at an internal temperature of 7° C. Then, while maintaining the internal temperature at 21° C. and continuously stirring at 250 rpm, a 5 mass % aqueous solution of ferrous sulfate was added in an amount of 0.52 part as $FeSO_4.7H_2O$ over a period of 5 minutes. And then, the colorant dispersion A was added over a period of 5 minutes, followed by mixing uniformly at an internal temperature of 7° C. Further, under the same conditions, a 0.5 mass % aluminum sulfate aqueous solution was dropwise added over a period of 8 minutes (the solid content being 0.10 part relative to the resin solid content). Then, while maintaining the rotational speed at 250 rpm, the internal temperature was raised to 57.0° C., and the volume median diameter (Dv50) was measured by using Multisizer, and the particles were grown to 6.76 μm.

○ Shell-Covering Step

Then, while maintaining the internal temperature at 57.0° C. and the rotational speed at 250 rpm, the polymer primary particle dispersion A2 was added over a period of 3 minutes, followed by continuous stirring under the same condition for 60 minutes.

○ Rounding Step

Then, the rotational speed was reduced to 220 rpm (circumferential speed of the forward ends of stirring vanes: 2.28 m/sec, the stirring speed reduced by 12% relative to the rotational speed in the aggregation step), the 20% DBS aqueous solution (6 parts as solid content) was added over a period of 10 minutes, and then, the temperature was raised to 87° C. over a period of 30 minutes, and heating and stirring were continued until the average circularity became 0.941. Then, the temperature was lowered to 30° C. over a period of 20 minutes to obtain a slurry.

Production of Toner F

Then, toner F was obtained in the same manner as in the auxiliary agent-adding step in "PRODUCTION OF TONER A" except that as auxiliary agents, the amount of silica H2000 was changed to 1.25 g, and the amount of fine titania powder SMT150IB was changed to 0.50 g.

○ Analysis Step

The volume median diameter (Dv50) of toner F thereby obtained, as measured by using Multisizer, was 6.77 μm, "the percentage in number (Dns) of toner particles having a particle diameter of from 2.00 μm to 3.56 μm" was 2.48%, and the average circularity was 0.942.

Toner Comparative Production Example 1

Production of Toner Matrix Particles G

Toner matrix particles G were obtained in the same manner as in "PRODUCTION OF TONER MATRIX PARTICLES A" in Toner Production Example 1 except that in the aggregation step (core material-aggregating step and shell-covering step), rounding step, washing step and drying step in "PRODUCTION OF TONER MATRIX PARTICLES A", "core material-aggregating step", "shell-covering step" and "rounding step" were changed as follows.

○ Core Material-Aggregating Step

Into a mixer (capacity: 12 L, inner diameter: 208 mm, height: 355 mm) equipped with an agitation device (double helical vanes), a heating/cooling device, a concentrating device and the respective material/agent feeding devices, the polymer primary particle dispersion A1 and the 20% DBS aqueous solution were charged and uniformly mixed for 5 minutes at an internal temperature of 7° C. Then, while maintaining the internal temperature at 7° C. and continuously stirring at 250 rpm, a 5 mass % aqueous solution of ferrous sulfate was added in an amount of 0.52 part as $FeSO_4.7H_2O$ all at once in 5 minutes. And the colorant dispersion A was added all at once in 5 minutes, followed by stirring uniformly at an internal temperature of 21° C. Further, under the same conditions, a 0.5 mass % aluminum sulfate aqueous solution was added all at once in 8 seconds (the solid content being 0.10 part relative to the resin solid content). Then, while maintaining the rotational speed at 250 rpm, the internal temperature was raised to 57.0° C., and the volume median diameter (Dv50) was measured by using Multisizer, and particles were grown to 6.85 μm.

○ Shell-Covering Step

Then, while maintaining the internal temperature at 57.0° C. and the rotational speed at 250 rpm, the polymer primary particle dispersion A2 was added all at once in 8 seconds, followed by continuous stirring under the same conditions for 60 minutes.

○ Rounding Step

Then, while maintaining the rotational speed at 250 rpm (circumferential speed of the forward ends of stirring vanes: 2.59 m/sec, the same stirring speed as the rotational speed in the aggregation step), the 20% DBS aqueous solution (6 parts as solid content) was added over a period of 10 minutes. Then, the temperature was raised to 87° C. over a period of 30 minutes, and heating and stirring were continued until the average circularity became 0.942. Then, the temperature was lowered to 30° C. over a period of 20 minutes to obtain a slurry.

Production of Toner G

Then, toner G was obtained in the same manner as in the auxiliary agent-adding step in "PRODUCTION OF TONER A" except that as auxiliary agents, the amount of silica H2000 was changed to 1.25 g, and the amount of fine titania powder SMT150IB was changed to 0.50 g.

○ Analysis Step

The volume median diameter (Dv50) of toner G for development thereby obtained, as measured by using Multisizer, was 6.79 μm, "the percentage in number (Dns) of toner particles having a particle diameter of from 2.00 μm to 3.56 μm" was 4.52%, and the average circularity was 0.943.

Using toners A to G and using, as a photoreceptor, the after-mentioned E1, "soiling" was evaluated by the method of the above mentioned "ACTUAL PRINT EVALUATION 1". The results are shown in the following Table 2.

TABLE 2

| No. | Toner | Rotational speed in rounding step (Circumferential speed of the forward ends of stirring vanes) | Volume median diameter (Dv50) (μm) | Dns (%) | Electrostatic charge distribution (Standard deviation of electrostatic charge) | Soiling |
|---|---|---|---|---|---|---|
| Ex. 1 | A | 150 rpm | 5.54 | 3.83 | 1.64 | — |
| Ex. 2 | B | (1.56 m/sec) | 5.97 | 2.53 | 1.66 | — |
| Ex. 3 | C | | 6.75 | 1.83 | 1.68 | ◎ |
| Ex. 4 | D | 220 rpm | 5.48 | 4.51 | 1.94 | — |
| Ex. 5 | E | (2.28 m/sec) | 5.93 | 3.62 | 1.91 | — |
| Ex. 6 | F | | 6.77 | 2.48 | 1.92 | ○ |
| Comp. Ex. 1 | G | 250 rpm (2.59 m/sec) | 6.79 | 4.52 | 2.60 | X |

As is evident from the results in the above Table 2, toners A to F satisfying the formula (1) in the present invention were actually produced by the production process shown in Toner Production Examples 1 to 6. And, all of toners A to F satisfying the formula (1) showed a sufficiently small standard deviation of electrostatic charge and a sharp electrostatic charge distribution. Further, in the actual print evaluation 1 in combination with the after-mentioned photoreceptor E1, no soiling was observed, or very slight soiling was observed, but such was acceptable level (Examples 3 and 6).

On the other hand, toner G not satisfying the formula (1) showed a large standard deviation of electrostatic charge, and the electrostatic charge distribution was not sharp. Further, also in the actual print evaluation 1 in combination with the after-mentioned photoreceptor E1, distinct soiling was observed entirely (Comparative Example 1).

Toner Production Example 7

Preparation of Wax/Long Chain Polymerizable Monomer Dispersion H1

27 Parts (540 g) of paraffin wax (HNP-9, manufactured by NIPPON SEIRO CO., LTD., surface tension: 23.5 mN/m, thermal characteristic: melting point peak temperature: 82° C., melting point half value width: 8.2° C., crystallization temperature: 66° C., crystallization peak half value width: 13.0° C.), 2.8 parts of stearyl acrylate (manufactured by Tokyo Kasei K.K.), 1.9 parts of a 20% DBS aqueous solution, and 68.3 parts of deionized water, were heated to 90° C. and stirred for 10 minutes by using a homomixer (Mark II f model, manufactured by Tokushu Kika Kogyo K.K.).

Then, this dispersion was heated to 90° C. to initiate circulation emulsification under a pressure condition of 25 MPa by using a homogenizer (15-M-8PA model, manufactured by GAULIN), and the particle diameter was measured by Nanotrac, and dispersion was carried out until the volume average particle diameter (Mv) became 250 nm to prepare a wax/long chain polymerizable monomer dispersion H1 (solid content concentration of emulsion=30.2 mass %).

Preparation of Polymer Primary Particle Dispersion H1

Into a reactor (internal capacity: 21 L, inner diameter: 250 mm, height: 420 mm) equipped with an agitation device (three vanes), a heating/cooling device and the respective material/agent-feeding devices, 35.6 parts (712.12 g) of the above wax/long chain polymerizable monomer dispersion H1 and 259 parts of deionized water were charged and heated to 90° C. in a nitrogen stream with stirring.

Then, while stirring of the above liquid was continued, a mixture of the following "polymerizable monomers" and "emulsifier aqueous solution" was added over a period of 5 hours. The time when dropwise addition of this mixture was initiated, is regarded as "initiation of polymerization", and the following "initiator aqueous solution" was added over a period of 4.5 hours after 30 minutes from the initiation of polymerization, and further the following "additional initiator aqueous solution" was added over a period of two hours after 5 hours from the initiation of polymerization, and further, the stirring was continued at an internal temperature of 90° C. for one hour.

| POLYMERIZABLE MONOMERS | |
|---|---|
| Styrene | 76.8 Parts (1,535.0 g) |
| Butyl acrylate | 23.2 Parts |
| Acrylic acid | 1.5 Parts |
| Hexanediol diacrylate | 0.7 Part |
| Trichlorobromomethane | 1.0 Part |
| EMULSIFIER AQUEOUS SOLUTION | |
| 20% DBS aqueous solution | 1.0 Part |
| Deionized water | 67.1 Parts |
| INITIATOR AQUEOUS SOLUTION | |
| 8 Mass % hydrogen peroxide aqueous solution | 15.5 Parts |
| 8 Mass % L(+)-ascorbic acid aqueous solution | 15.5 Parts |
| ADDITIONAL INITIATOR AQUEOUS SOLUTION | |
| 8 Mass % L(+)-ascorbic acid aqueous solution | 14.2 Parts |

After completion of the polymerization reaction, the system was cooled to obtain a milky white polymer primary particle dispersion H1. The volume average diameter (Mv) measured by using Nanotrac was 265 nm, and the solid content concentration was 22.3 mass %.

Preparation of Silicone Wax Dispersion H2

27 Parts (540 g) of alkyl-modified silicone wax (thermal characteristics: melting point peak temperature: 77° C., heat of fusion: 97 J/g, melting peak half value width: 10.9° C., crystallization temperature: 61° C., crystallization peak half value width: 17.0° C.), 1.9 parts of a 20% DBS aqueous solution, and 71.1 parts of deionized water, were put into a 3 L stainless steel container, heated to 90° C. and stirred for 10 minutes by using a homomixer (Mark II f model, manufactured by Tokushu Kika Kogyo K.K.). Then, this dispersion was heated to 99° C. to initiate circulation emulsification under a pressure condition of 45 MPa by using a homogenizer (15-M-8PA model, manufactured by GAULIN), and dispersed until the volume average diameter (Mv) became 240 nm as measured by Nanotrac, to prepare a silicone wax dispersion H2 (solid content concentration of emulsion=27.3 mass %).

Preparation of Polymer Primary Particle Dispersion H2

Into a reactor (internal capacity: 21 L, inner diameter: 250 mm, height: 420 mm) equipped with an agitation device (three vanes), a heating/cooling device and the respective material/agent-feeding devices, 23.3 parts (466 g) of the silicone wax dispersion H2, 1.0 part of the 20% DBS aqueous solution and 324 parts of deionized water were charged and heated to 90° C. in a nitrogen stream, and 3.2 parts of a 8% hydrogen peroxide aqueous solution and 3.2 parts of a 8% L(+)-ascorbic acid aqueous solution were added all at once with stirring. The time after five minutes from the time of such addition all at once is regarded as "initiation of polymerization".

A mixture of the following "polymerizable monomers" and "emulsifier aqueous solution" was added over a period of 5 hours from the initiation of polymerization, and the following "initiator aqueous solution" was added over a period of 6 hours from the initiation of polymerization. Thereafter, stirring was further carried out at an internal temperature of 90° C. for one hour.

| POLYMERIZABLE MONOMERS | |
|---|---|
| Styrene | 92.5 Parts (1,850.0 g) |
| Butyl acrylate | 7.5 Parts |
| Acrylic acid | 1.5 Parts |
| Trichlorobromomethane | 0.6 Part |
| EMULSIFIER AQUEOUS SOLUTION | |
| 20% DBS aqueous solution | 1.0 Part |
| Deionized water | 67.0 Parts |
| INITIATOR AQUEOUS SOLUTION | |
| 8 Mass % hydrogen peroxide aqueous solution | 18.9 Parts |
| 8 Mass % L(+)-ascorbic acid aqueous solution | 18.9 Parts |

After completion of the polymerization reaction, the system was cooled to obtain a milky white polymer primary particle dispersion H2. The volume average diameter (Mv) measured by using Nanotrac was 290 nm, and the solid content concentration was 19.0 mass %.

Preparation of Colorant Dispersion H

Into a container having an internal capacity of 300 L equipped with a stirrer (propeller vanes), 20 parts (40 kg) of carbon black (Mitsubishi Carbon Black MA100S, manufactured by Mitsubishi Chemical Corporation) produced by a furnace method and having true density of 1.8 g/cm$^3$ and an ultraviolet ray absorbance of a toluene extract liquid being 0.02, 1 part of a 20% DBS aqueous solution, 4 parts of a nonionic surfactant (EMULGEN 120, manufactured by Kao Corporation) and 75 parts of deionized water having an electrical conductivity of 2 μS/cm, were added, and preliminarily dispersed to obtain a pigment premix fluid. The volume average particle diameter (Mv) of carbon black in the dispersion after the pigment premix as measured by Nanotrac, was 90 μm.

The above pigment premix fluid was supplied as a starting material slurry to a wet system beads mill and subjected to one-pass dispersion. Here, the inner diameter of the stator was 75 mm, the diameter of the separator was 60 mm, the distance between the separator and the disk was 15 mm, and as the dispersing media, zirconia beads (true density: 6.0 g/cm$^3$) having a diameter of 100 μm, were used. The effective inner capacity of the stator was 0.5 L, and the packed volume of the media was 0.35 L, whereby the media packing ratio was 70 mass %. By setting the rotational speed of the rotor to be constant (the circumferential speed of the forward end of the rotor being 11 m/sec), from the supply inlet, the above pigment premix fluid was continuously supplied at a feeding speed of 50 L/hr by a non-pulsation metering pump and continuously discharged from a discharge outlet to obtain a black colorant dispersion H. The volume average diameter (Mv) obtained by measuring the colorant dispersion H by Nanotrac, was 150 nm, and the solid content concentration was 24.2 mass %.

Production of Toner Matrix Particles H

Using the following respective components, toner matrix particles H were produced by carrying out the following aggregation step (core material-aggregating step and shell-covering step), rounding step, washing step and drying step.

Polymer primary particle dispersion H1: 90 Parts as solid content (958.9 g as solid content)

Polymer primary particle dispersion H2: 10 Parts as solid content

Colorant dispersion H, 4.4 Parts as colorant solid content

20% DBS aqueous solution: 0.15 Part as solid content in core material-aggregating step 20% DBS aqueous solution: 6 Parts as solid content in rounding step ○ Core Material-Aggregating Step Into a mixer (capacity: 12 L, inner diameter: 208 mm, height: 355 mm) equipped with an agitation device (double helical vanes), a heating/cooling device and the various material/agent feeding devices, the polymer primary particle dispersion H1 and the 20% DBS aqueous solution were charged and uniformly mixed for 10 minutes at an internal temperature of 10° C. Then, with stirring at 280 rpm at an internal temperature of 10° C., a 5 mass % aqueous solution of potassium sulfate was continuously added over a period of one minute in an amount of 0.12 part as $K_2SO_4$, and then, the colorant dispersion H was continuously added over a period of 5 minutes, followed by mixing uniformly at an internal temperature of 10° C.

Then, 100 parts of deionized water was continuously added over a period of 30 minutes, and then while maintaining the rotational speed at 280 rpm, the internal temperature was raised (0.5° C./min) to 48.0° C. over a period of 67 minutes. Then, the temperature was raised by 1° C. every 30 minutes (0.03° C./min) and maintained at 54.0° C., whereby the volume median diameter (Dv50) was measured by using Multisizer, and the particles were grown to 5.15 μm.

The stirring conditions at that time were as follows.

(1) Diameter of the agitation container (so-called usual cylindrical shape): 208 mm (2) Height of the agitation container: 355 mm (3) Circumferential speed of the forward ends of stirring vanes: 280 rpm, i.e. 2.78 m/sec.

(4) Shape of stirring vanes: Double helical vanes (diameter: 190 mm, height: 270 mm, width: 20 mm)

(5) Position of the vanes in the agitation container: Disposed at 5 mm from the bottom of the container ○ Shell-Covering Step Then, while maintaining the internal temperature at 54.0° C. and the rotational speed at 280 rpm, the polymer primary particle dispersion H2 was continuously added over a period of 6 minutes, and continuously stirred under the same conditions for 60 minutes. At that time, Dv50 of the particles was 5.34 μm.

○ Rounding Step

Then, the temperature was raised to 83° C. while adding a mixed aqueous solution of the 20% DBS aqueous solution (6 parts as solid content) and 0.04 part of water over a period of 30 minutes. Thereafter, the temperature was raised by 1° C. every 30 minutes up to 88° C., and heating and stirring were continued under this condition until the average circularity became 0.939 over a period of 3.5 hours. Thereafter, the temperature was lowered to 20° C. over a period of 10 minutes to obtain a slurry. At that time, Dv50 of particles was 5.33 μm, and the average circularity was 0.937.

○ Washing Step

The obtained slurry was withdrawn and subjected to suction filtration by an aspirator by using a filter paper of grade 5C (No5C, manufactured by Toyo Roshi Kaisha, Ltd.). The cake which remained on the filter paper was transferred to a stainless steel container having an internal capacity of 10 L equipped with a stirrer (propeller vanes) and 8 kg of deionized water having an electrical conductivity of 1 μS/cm was added, followed by stirring at 50 rpm for uniform dispersion, and then, stirring was continued for 30 minutes.

Then, suction filtration was carried out again by an aspirator by using a filter paper of grade SC (No5C, manufactured by Toyo Roshi Kaisha, Ltd.), and the solid product remained on the filter paper was again transferred to a container having an internal capacity of 10 L, equipped with a stirrer (propeller vanes) and containing 8 kg of deionized water having an electrical conductivity of 1 μS/cm, followed by stirring at 50 rpm for uniform dispersion, and stirring was continued for 30 minutes. This process was repeated five times, whereupon the electrical conductivity of the filtrate became 2 μS/cm.

○ Drying Step

The solid product thereby obtained was spread on a stainless steel vat so that the height would be 20 mm, and dried for 48 hours in an air-circulating dryer set at 40° C., to obtain toner matrix particles H.

Production of Toner H

○ Auxiliary Agent-Adding Step

To 500 g of the obtained toner matrix particles H, 8.75 g of silica H30TD, manufactured by Clariant K.K. was mixed as an auxiliary agent, followed by mixing for 30 minutes at 300 rpm by a 9 L Henschel mixer (manufactured by Mitsui Mining Co., Ltd.), and then 1.4 g of calcium phosphate HAP-05NP manufactured by Maruo Calcium Co., Ltd. was mixed, followed by stirring for 10 minutes at 300 rpm and then by sieving with 200 mesh to obtain toner H.

○ Analysis Step

The "volume median diameter (Dv50)" of the toner H thereby obtained, as measured by means of Multisizer, was 5.26 μm, "the percentage in number (Dns) of toner particles having a particle diameter of from 2.00 μm to 3.56 μm" was 5.87%, and the average circularity was 0.948.

Toner Production Example 8

Production of Toner Matrix Particles I

Toner matrix particles I were obtained in the same manner as in "PRODUCTION OF TONER MATRIX PARTICLES H" in Toner Production Example 7 except that in the aggregation step (core material-aggregating step and shell-covering step), rounding step, washing step and drying step in "PRODUCTION OF TONER MATRIX PARTICLES H", "core material-aggregating step", "shell-covering step" and "rounding step" were changed as follows.

○ Core Material-Aggregating Step

Into a mixer (capacity: 12 L, inner diameter: 208 mm, height: 355 mm) equipped with an agitation device (double helical vanes), a heating/cooling device, a concentrating device and the respective material/agent feeding devices, the polymer primary particle dispersion H1 and the 20% DBS aqueous solution were charged and uniformly mixed for 5 minutes at an internal temperature of 10° C. Then, while stirring at 280 rpm at an internal temperature of 10° C., 0.12 part of a 5 mass % aqueous solution of potassium sulfate was continuously added over a period of one minute, and then the colorant dispersion H was continuously added over a period of 5 minutes, followed by mixing uniformly at an internal temperature of 10° C. Then, 100 parts of deionized water was continuously added over a period of 26 minutes, and while maintaining the rotational speed at 280 rpm, the internal temperature was raised to 52.0° C. over a period of 64 minutes (0.5° C./min). Then, the temperature was raised by 1° C. over a period of 30 minutes (0.03° C./min) and then maintained for 110 minutes, and the volume median diameter (Dv50) was measured by using Multisizer, and the particles were grown to 5.93 μm. The stirring conditions at that time were the same as in Toner Production Example 7.

○ Shell-Covering Step

Then, while maintaining the internal temperature at 53.0° C. and the rotational speed at 280 rpm, the polymer primary particle dispersion H2 was continuously added over a period of 6 minutes, and continuously stirred under the same conditions for 90 minutes. At that time, Dv50 of the particles was 6.23 μm.

○ Rounding Step

Then, the temperature was raised to 85° C. while adding a mixed aqueous solution of the 20% DBS aqueous solution (6 parts as solid content) and 0.04 part of water over a period of 30 minutes. Then, the temperature was raised to 92° C. over a period of 130 minutes, and heating and stirring were continued under this condition until the average circularity became 0.943. Thereafter, the temperature was lowered to 20° C. over a period of 10 minutes to obtain a slurry. At that time, Dv50 of particles was 6.17 μm, and the average circularity was 0.945. The washing, drying and auxiliary agent-adding steps were carried out in the same manner as in Toner Production Example 7.

○ Auxiliary Agent-Adding Step

To 1,500 g of the obtained toner matrix particles, 7.5 g of silica H30TD manufactured by Clariant K.K. was mixed as an auxiliary agent, followed by mixing for 30 minutes at 3,000 rpm by a 9 L Henschel mixer (manufactured by Mitsui Mining Co., Ltd.). Then, 1.2 g of calcium phosphate HAP-05NP manufactured by Maruo Calcium Co., Ltd. was mixed, followed by stirring for 10 minutes at 3,000 rpm and then by sieving with 200 mesh to obtain toner I.

○ Analysis Step

The "volume median diameter (Dv50)" of the toner I thereby obtained, as measured by means of Multisizer, was 6.16 μm, "the percentage in number (Dns) of toner particles having a particle diameter of from 2.00 μm to 3.56 μm" was 2.79%, and the average circularity was 0.946.

Toner Production Example 9

Production of Toner Matrix Particles J

Toner matrix particles J were obtained in the same manner as in "PRODUCTION OF TONER MATRIX PARTICLES H" in Toner Production Example 7 except that in the aggregation step (core material-aggregating step and shell-covering step), rounding step, washing step and drying step in "PRODUCTION OF TONER MATRIX PARTICLES H", "core material-aggregating step", "shell-covering step" and "rounding step" were changed as follows.

○ Core Material-Aggregating Step

Into a mixer (capacity: 12 L, inner diameter: 208 mm, height: 355 mm) equipped with an agitation device (double helical vanes), a heating/cooling device, a concentrating device and the respective material/agent feeding devices, the polymer primary particle dispersion H1 and the 20% DBS aqueous solution were charged and uniformly mixed for 10 minutes at an internal temperature of 10° C. Then, with stirring at 280 rpm at an internal temperature of 10° C., 0.12 part of a 5 mass % aqueous solution of potassium sulfate was continuously added over a period of one minute, and then the colorant dispersion H was continuously added over a period of 5 minutes, followed by mixing uniformly at an internal temperature of 10° C. Then, 0.5 part of deionized water was continuously added over a period of 26 minutes, and then, while maintaining the rotational speed at 280 rpm, the internal temperature was raised to 52.0° C. over a period of 64 minutes (0.5° C./min). Then, the temperature was raised by 1° C. over a period of 30 minutes (0.03° C./min) and maintained for 130 minutes, and the volume median diameter (Dv50) was measured by using Multisizer, and the particles were grown to 6.60 μm. The stirring conditions at that time were the same as in Toner Production Example 7.

○ Shell-Covering Step

Then, while maintaining the internal temperature at 53.0° C. and the rotational speed at 280 rpm, the polymer primary particle dispersion H2 was continuously added over a period of 6 minutes, followed by stirring under the same condition for 60 minutes. At that time, Dv50 of the particles was 6.93 μm.

○ Rounding Step

Then, the temperature was raised to 90° C. while adding a mixed aqueous solution of the 20% DBS aqueous solution (6 parts as solid content) and 0.04 part of water over a period of 30 minutes. And then, the temperature was raised to 97° C. over a period of 60 minutes, and heating and stirring were continued under this condition until the average circularity became 0.945. Then, the temperature was lowered to 20° C. over a period of 10 minutes to obtain a slurry. At that time, Dv50 of particles was 6.93 μm, and the average circularity was 0.945. The washing/drying step was carried out in the same manner as in Toner Production Example 7.

○ Auxiliary Agent-Adding Step

To 500 g of the obtained toner matrix particles J, 6.25 g of silica H30TD manufactured by Clariant K.K. was mixed as an auxiliary agent, followed by stirring for 30 minutes at 3,000 rpm by a 9 L Henschel mixer (manufactured by Mitsui Mining Co., Ltd.). Then, 1.0 g of calcium phosphate HAP-05NP manufactured by Maruo Calcium Co., Ltd. was mixed, followed by stirring for 10 minutes at 3,000 rpm and further by sieving with 200 mesh to obtain toner J.

○ Analysis Step

The "volume median diameter (Dv50)" of the toner J thereby obtained, as measured by means of Multisizer, was 6.97 μm, "the percentage in number (Dns) of toner particles having a particle diameter of from 2.00 μm to 3.56 μm" was 1.85%, and the average circularity was 0.946.

Toner Comparative Production Example 2

Production of Toner Matrix Particles O

Toner matrix particles 0 were obtained in the same manner as in "PRODUCTION OF TONER MATRIX PARTICLES H" in Toner Production Example 7 except that in the aggregation step (core material-aggregating step and shell-covering step), rounding step, washing step and drying step in "PRODUCTION OF TONER MATRIX PARTICLES H", "core material-aggregating step", "shell-covering step" and "rounding step" were changed as follows.

○ Core Material-Aggregating Step

Into a mixer (capacity: 12 L, inner diameter: 208 mm, height: 355 mm) equipped with an agitation device (double helical vanes), a heating/cooling device, a concentrating device and the respective material/agent feeding devices, the polymer primary particle dispersion H1 and the 20% DBS aqueous solution were charged and uniformly mixed for 10 minutes at an internal temperature of 10° C. Then, with stirring at 280 rpm at an internal temperature of 10° C., 0.12 part of a 5 mass % aqueous solution of potassium sulfate was continuously added over a period of one minute, and then the colorant dispersion H was continuously added over a period of 5 minutes, followed by mixing uniformly at an internal temperature of 10° C. Then, 100 parts of deionized water was continuously added over a period of 30 minutes, and then, while maintaining the rotational speed at 280 rpm, the internal temperature was raised to 34.0° C. over a period of 40 minutes (0.6° C./min). Then, the temperature was maintained for 20 minutes, and the volume median diameter (Dv50) was measured by using Multisizer, and the particles were grown to 3.81 μm.

○ Shell-Covering Step

Then, while maintaining the internal temperature at 34.0° C. and the rotational speed at 280 rpm, the polymer primary particle dispersion H2 was continuously added over a period of 6 minutes, followed by stirring under the same condition for 90 minutes.

○ Rounding Step

Then, while maintaining the rotational speed at 280 rpm (the same stirring speed as the rotational speed in the aggregation step), the 20% DBS aqueous solution (6 parts as solid content) was added over a period of 10 minutes. Then, the temperature was raised to 76° C. over a period of 30 minutes, and heating and stirring were continued until the average circularity became 0.962. Then, the temperature was lowered to 20° C. over a period of 10 minutes to obtain a slurry.

Production of Toner K

Then, to 100 parts of toner matrix particles H in Toner Production Example 7, 1 part of the above toner matrix particles O were mixed, and to 500 g of this toner matrix particle mixture K, 8.75 g of silica H30TD manufactured by Clariant K.K. was mixed as an auxiliary agent, followed by stirring for 30 minutes at 3,000 rpm by a 9 L Henschel mixer (manufactured by Mitsui Mining Co., Ltd.), and then, 1.4 g of calcium phosphate HAP-05NP manufactured by Maruo Calcium Co., Ltd. was mixed, followed by stirring for 10 minutes at 3,000 rpm and then by sieving with 200 mesh to obtain toner K.

○ Analysis Step

The "volume median diameter (Dv50)" of the toner K thereby obtained, as measured by means of Multisizer, was 5.31 μm, "the percentage in number (Dns) of toner particles having a particle diameter of from 2.00 μm to 3.56 μm" was 7.22%, and the average circularity was 0.949.

Toner Comparative Production Example 3

Production of Toner Matrix Particles L

Toner matrix particles L were obtained in the same manner as in "PRODUCTION OF TONER MATRIX PARTICLES H" in Toner Production Example 7 except that in the aggregation step (core material-aggregating step and shell-covering step), rounding step, washing step and drying step in "PRODUCTION OF TONER MATRIX PARTICLES H", "core material-aggregating step", "shell-covering step" and "rounding step" were changed as follows.

○ Core Material-Aggregating Step

Into a mixer (capacity: 12 L, inner diameter: 208 mm, height: 355 mm) equipped with an agitation device (double helical vanes), a heating/cooling device, a concentrating device and the respective material/agent feeding devices, the polymer primary particle dispersion H1 and the 20% DBS aqueous solution were charged and uniformly mixed for 10 minutes at an internal temperature of 10° C. Then, with stirring at 310 rpm at an internal temperature of 10° C., 0.12 part of a 5 mass % aqueous solution of potassium sulfate was continuously added in an amount of 0.12 part as $K_2SO_4$ over a period of one minute, and then the colorant dispersion H was continuously added over a period of 5 minutes, followed by mixing uniformly at an internal temperature of 10° C.

Then, 100 parts of deionized water was continuously added over a period of 30 minutes, and then, while maintaining the rotational speed at 310 rpm, the internal temperature was raised to 48.0° C. over a period of 67 minutes (0.5° C./min). Then, the temperature was raised by 1° C. every 30 minutes (0.03° C./min) and maintained at 53.0° C., and the volume median diameter (Dv50) was measured by using Multisizer, and particles were grown to 5.08 μm.

The stirring conditions at that time were the same as in Toner Production Example 7 except for the following (3).

(3) Circumferential speed of the forward ends of stirring vanes: 310 rpm, i.e. 3.08 m/sec.

○ Shell-Covering Step

Then, while maintaining the internal temperature at 54.0° C. and the rotational speed at 310 rpm, the polymer primary particle dispersion H2 was continuously added over a period of 6 minutes, followed by stirring under the same condition for 60 minutes. At that time, Dv50 of particles was 5.19 μm.

○ Rounding Step

Then, the temperature was raised to 83° C. while adding a mixed aqueous solution of the 20% DBS aqueous solution (6 parts as solid content) and 0.04 part of water over a period of 30 minutes. Then, the temperature was raised by 1° C. every 30 minutes up to 90° C., and heating and stirring were continued under this condition until the average circularity became 0.939 over a period of 2.5 hours. Then, the temperature was lowered to 20° C. over a period of 10 minutes to obtain a slurry. At that time, Dv50 of particles was 5.18 μm, and the average circularity was 0.940. The washing and drying steps were carried out in the same manner as in Toner Production Example 7.

○ Auxiliary Agent-Adding Step

To 500 g of the obtained toner matrix particles L, 8.75 g of silica H30TD manufactured by Clariant K.K. was mixed as an auxiliary agent, followed by stirring for 30 minutes at 3,000 rpm by a 9 L Henschel mixer (manufactured by Mitsui Mining Co., Ltd.). And then, 1.4 g of calcium phosphate HAP-05NP manufactured by Maruo Calcium Co., Ltd. was mixed, followed by stirring for 10 minutes at 3,000 rpm and then by sieving with 200 mesh to obtain toner L.

○ Analysis Step

The "volume median diameter (Dv50)" of the toner L thereby obtained, as measured by means of Multisizer, was 5.18 μm, "the percentage in number (Dns) of toner particles having a particle diameter of from 2.00 μm to 3.56 μm" was 9.94%, and the average circularity was 0.940.

Toner Comparative Production Example 4

Production of Toner Matrix Particles M

Toner matrix particles M were obtained in the same manner as in "PRODUCTION OF TONER MATRIX PARTICLES H" in Toner Production Example 7 except that in the aggregation step (core material-aggregating step and shell-covering step), rounding step, washing step and drying step in "PRODUCTION OF TONER MATRIX PARTICLES H", "core material-aggregating step", "shell-covering step" and "rounding step" were changed as follows.

○ Core Material-Aggregating Step

Into a mixer (capacity: 12 L, inner diameter: 208 mm, height: 355 mm) equipped with an agitation device (double helical vanes), a heating/cooling device, a concentrating device and the respective material/agent feeding devices, the polymer primary particle dispersion H1 and the 20% DBS aqueous solution were charged and uniformly mixed for 10 minutes at an internal temperature of 10° C. Then, with stirring at 310 rpm at an internal temperature of 10° C., a 5 mass % aqueous solution of potassium sulfate was continuously added in an amount of 0.12 part as $K_2SO_4$ over a period of one minute, and then, the colorant dispersion H was continuously added over a period of 5 minutes, followed by mixing uniformly at an internal temperature of 10° C.

Then, 100 parts of deionized water was continuously added over a period of 30 minutes, and then, while maintaining the rotational speed at 310 rpm, the internal temperature was raised to 52.0° C. over a period of 56 minutes (0.8° C./min). Then, the temperature was raised by 1° C. every 30 minutes (0.03° C./min) and maintained at 54.0° C., whereby the volume median diameter (Dv50) was measured by using Multisizer, and particles were grown to 5.96 μm.

The stirring conditions at that time were the same as in Toner Production Example 7 except for the following (3).

(3) Circumferential speed of the forward ends of stirring vanes: 310 rpm, i.e. 3.08 m/sec.

○ Shell-Covering Step

Then, while maintaining the internal temperature at 54.0° C. and the rotational speed at 310 rpm, the polymer primary particle dispersion H2 was continuously added over a period of 6 minutes, followed by stirring under the same condition for 60 minutes. At that time, Dv50 of particles was 5.94 μm.

○ Rounding Step

Then, the temperature was raised to 88° C. while adding a mixed aqueous solution of the 20% DBS aqueous solution (6 parts as solid content) and 0.04 part of water over a period of 30 minutes. Then, the temperature was raised by 1° C. every 30 minutes up to 90° C., and heating and stirring were continued under this condition until the average circularity became 0.940 over a period of 2 hours. Then, the temperature was lowered to 20° C. over a period of 10 minutes to obtain a slurry. At that time, Dv50 of particles was 5.88 μm, and the average circularity was 0.943. The washing and drying steps were carried out in the same manner as in Toner Production Example 7.

○ Auxiliary Agent-Adding Step

To 500 g of the obtained toner matrix particles M, 7.5 g of silica H30TD manufactured by Clariant K.K. was mixed as an auxiliary agent, followed by stirring for 30 minutes at 3,000 rpm by a 9 L Henschel mixer (manufactured by Mitsui Mining Co., Ltd.). And then, 1.2 g of calcium phosphate HAP-05NP manufactured by Maruo Calcium Co., Ltd. was mixed, followed by stirring for 10 minutes at 3,000 rpm and then by sieving with 200 mesh to obtain toner M.

○ Analysis Step

The "volume median diameter (Dv50)" of the toner M thereby obtained, as measured by means of Multisizer, was 5.92 μm, "the percentage in number (Dns) of toner particles having a particle diameter of from 2.00 μm to 3.56 μm" was 5.22%, and the average circularity was 0.945.

Toner Comparative Production Example 5

To 100 parts of the toner matrix particles J in Toner Production Example 9, 3 part of toner matrix particles 0 were mixed. To 500 g of such a mixture of toner matrix particles, 6.25 g of silica H30TD manufactured by Clariant K.K. was mixed as an auxiliary agent, followed by stirring for 30 minutes at 3,000 rpm by a 9 L Henschel mixer (manufactured by Mitsui Mining Co., Ltd.). And then, 1.0 g of calcium phosphate HAP-05NP manufactured by Maruo Calcium Co., Ltd. was mixed, followed by stirring for 10 minutes at 3,000 rpm and then by sieving with 200 mesh to obtain toner N.

○ Analysis Step

The "volume median diameter (Dv50)" of the toner N thereby obtained, as measured by means of Multisizer, was 6.88 μm, "the percentage in number (Dns) of toner particles having a particle diameter of from 2.00 μm to 3.56 μm" was 9.08%, and the average circularity was 0.952.

With respect to toners H to N, actual print evaluation was carried out by the above described actual print evaluation 2 using the after-mentioned photoreceptor E14. The results are shown in the following Table 3.

TABLE 3

| | Toner — | Dv50 (Volume median diameter) μm | Dns % | Residual images (Ghosts) <8 kp> — | Blurring (Blotted image-follow-up properties) <8 kp> — | Cleaning properties <8 kp> — |
|---|---|---|---|---|---|---|
| Ex. 7 | H | 5.26 | 5.87 | ○ | ○ | ○ |
| Ex. 8 | I | 6.16 | 2.79 | ○ | ○ | ○ |
| Ex. 9 | J | 6.97 | 1.85 | ◎ | ◎ | ○ |
| Comp. Ex. 2 | K | 5.31 | 7.22 | X | X | X |
| Comp. Ex. 3 | L | 5.18 | 9.94 | Toner jetted from developer tank (impossible to carry out actual print) | | |
| Comp. Ex. 4 | M | 5.92 | 5.22 | X | ○ | X |
| Comp. Ex. 5 | N | 6.88 | 9.08 | Toner jetted from developer tank (impossible to carry out actual print) | | |

Examples 7 to 9 were all good with respect to the residual images (ghosts), blurring (blotted image follow-up properties) and cleaning properties. On the other hand, none of Comparative Examples 2 to 5 was excellent in all of the residual images (ghosts), blurring (blotted image follow-up properties) and cleaning properties. Toners H, I and J were found to exhibit excellent actual print performance when used in combination with the after-mentioned photoreceptor E12, but toners K, L, M and N were found to be inferior in the actual print performance even when used in combination with the after-mentioned photoreceptor E12.

Figure 3:
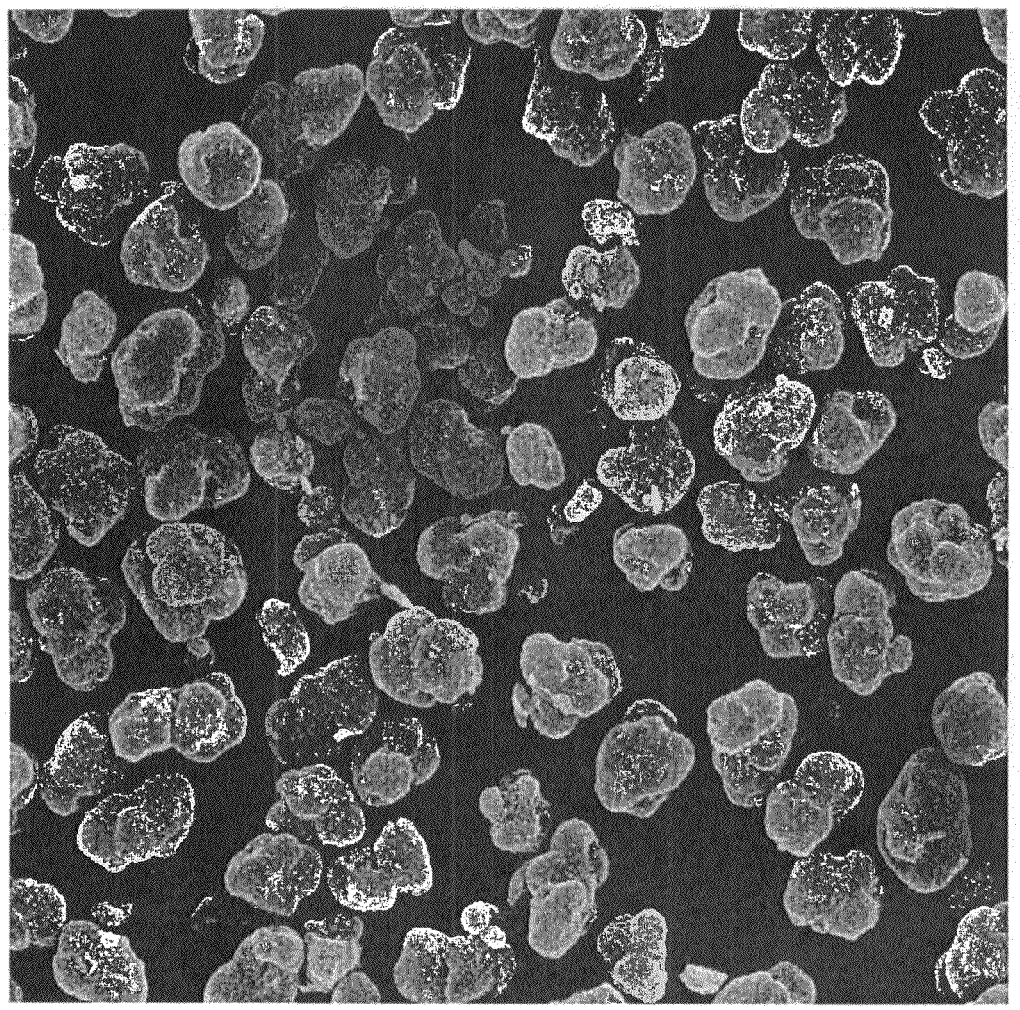
FIG. 3 is a SEM photograph with 1,000 magnifications, of the toner (toner K) in Toner Comparative Production Example 2.
Figure 4:
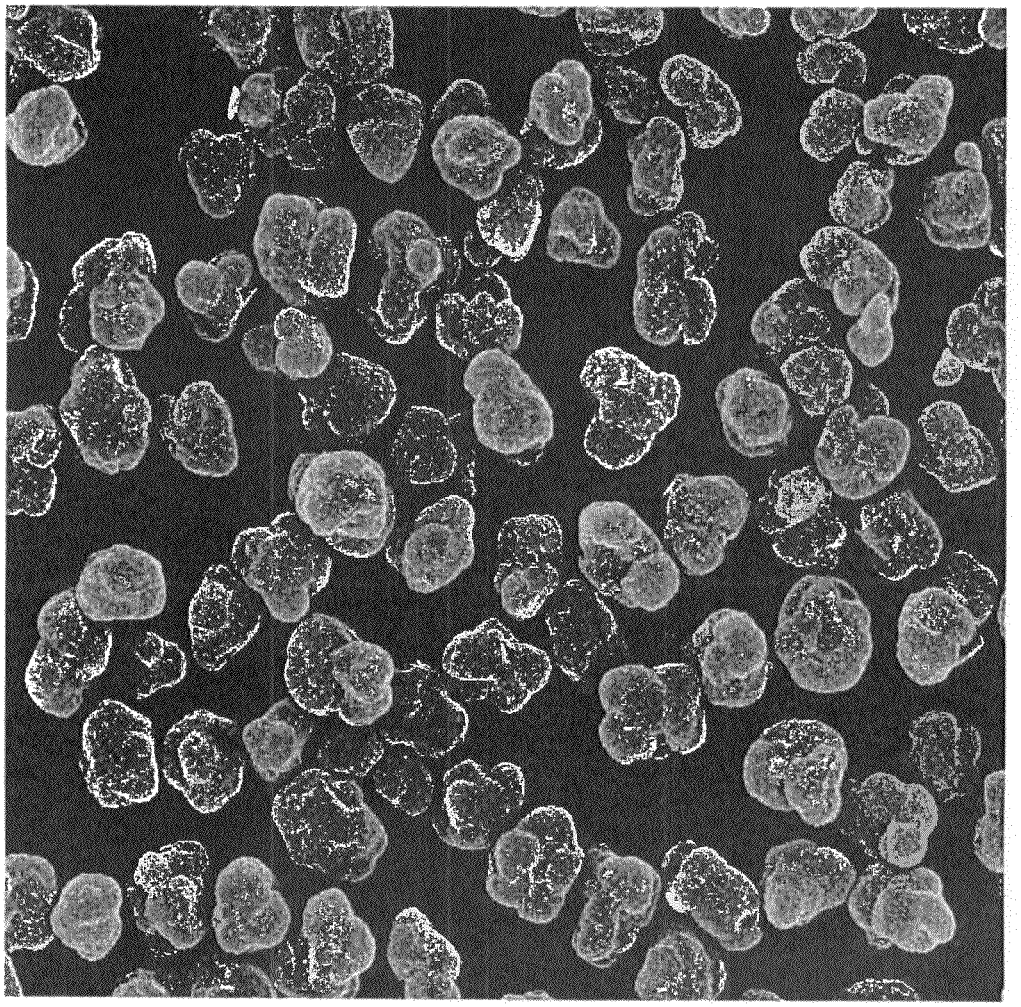
FIG. 4 is a SEM photograph with 1,000 magnifications, of the toner (toner H) in Toner Production Example 7.

FIGS. 3 and 4 are scanning electron microscopic photographs (SEM photographs) of toners in Toner Comparative Production Example 2 (toner K) and Toner Production Example 7 (toner H), respectively. When both are compared, it was found that in FIG. 3 (Toner Comparative Production Example 2), fine powder of at most 3.56 μm was substantially present as compared with FIG. 4 (Toner Production Example 7).

Figure 5:
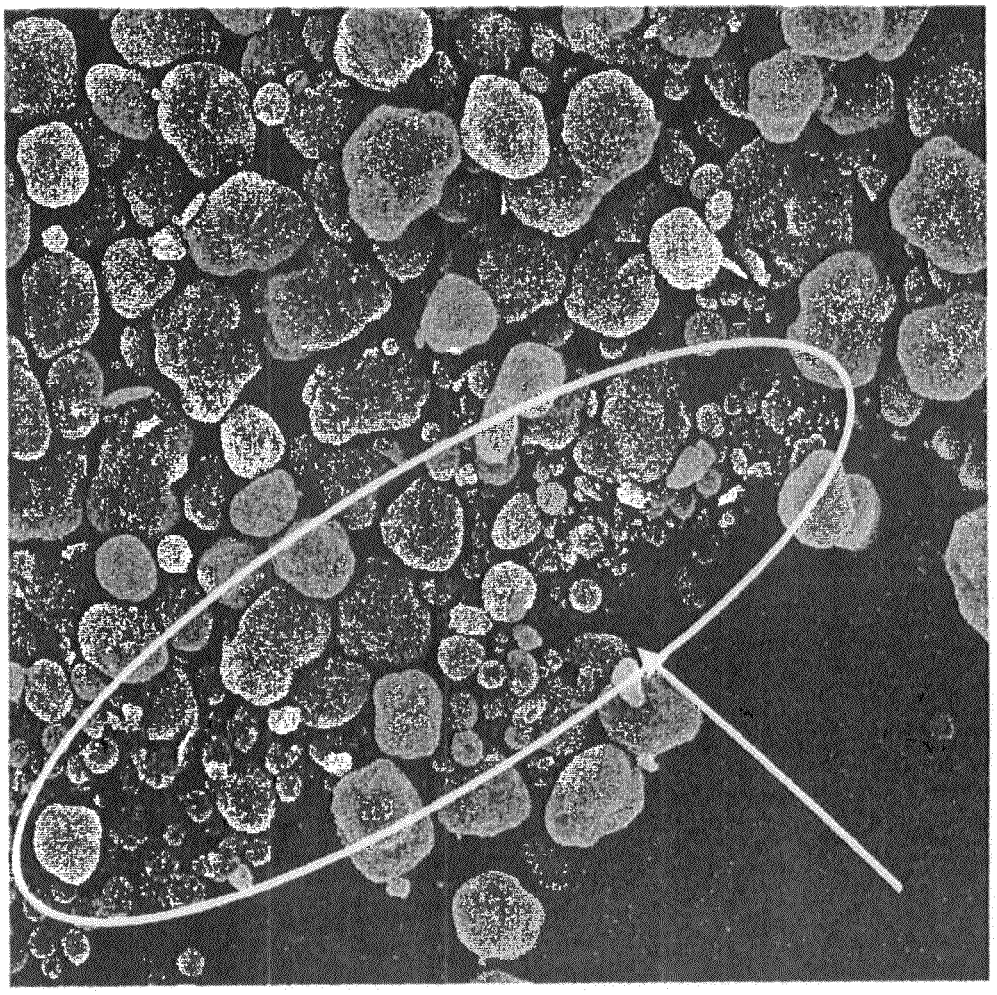
FIG. 5 is a SEM photograph with 1,000 magnifications showing a state of the toner deposited on a cleaning blade after an actual print evaluation of the toner (toner K) in Toner Comparative Production Example 2.

FIG. 5 is a SEM photograph showing the state of deposition of a toner on a cleaning blade after the actual print evaluation of the toner (toner K) in Toner Comparative Production Example 2. It has been found that if a toner having such a large amount of fine powder is used for printing for a long time, as shown in FIG. 5, the fine powder of at most 3.56 μm having a high attaching force is positively accumulated to form a highly bulky bank to hinder transportation of the toner. The portion defined by an ellipse in FIG. 5 is the bank having the fine powder of at most 3.56 μm accumulated.

Photoreceptor Production Examples

Photoreceptor Production Example 1

Coating Fluid for Undercoat Layer

Titanium oxide dispersion T1 was prepared by treating 1 kg of a raw material slurry obtained by mixing 120 parts of methanol and 50 parts of surface-treated titanium oxide obtained by mixing rutile-type titanium oxide having an average primary particle diameter of 40 nm ("TTO55N" manufactured by Ishihara Sangyo Kaisha, Ltd.) with methyldimethoxysilane ("TSL8117" manufactured by Toshiba Silicone Co., Ltd.) in an amount of 3 mass % to the titanium oxide by a Henschel mixer, by dispersion treatment for one hour in a liquid circulation state at a liquid flow rate of 10 kg/hr at a rotor circumferential speed of 10 m/sec by means of ULTRA APEX MILL (UAM-015 model) manufactured by KOTOBUKI INDUSTRIES CO., LTD. having a mill capacity of about 0.15 L using zirconia beads (YTZ manufactured by NIKKATO CORPORATION) having a diameter of about 100 μm as dispersing media.

The above titanium oxide dispersion T1, a solvent mixture of methanol/1-propanol/toluene and pellets of a copolymer polyamide comprising ϵ-caprolactam [compound of the following formula (A)]/bis(4-amino-3-methylcyclohexyl methane [compound of the following formula (B)]/hexamethylenediamine [compound of the following formula (C)]/decamethylene dicarboxylic acid [compound of the following formula (D)]/octadecamethylene dicarboxylic acid [compound of the following formula (E)] in a compositional molar ratio of 60%/15%/5%/15%/5%, were stirred and mixed under heating to dissolve the polyamide pellets, followed by ultrasonic dispersion treatment for one hour by an ultrasonic oscillator with an output of 1,200 W and further by filtration by means of a membrane filter made of PTFE having an aperture diameter of 5 μm (Mytex LC, manufactured by Advantec Co., Ltd.) to obtain dispersion A1 for forming undercoat layer having a weight ratio of surface-treated titanium oxide/copolymer polyamide being 3/1, a weight ratio of the solvent mixture of methanol/1-propanol/toluene being 7/1/2 and a concentration of contained solid content being 18.0 wt %.

A

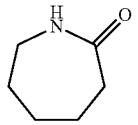

B

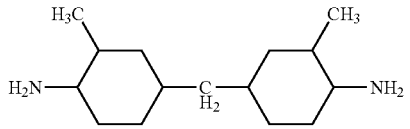

CT-1

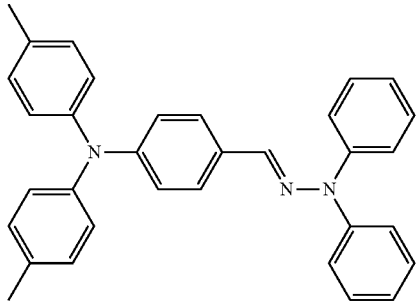

-continued

C

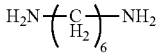

D

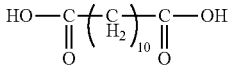

E

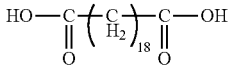

This dispersion A1 for forming undercoat layer was applied to an aluminum cylinder not anodized (outer diameter: 30 mm, thickness: 1.0 mm, surface roughness Ra=0.02 μm) by dip coating and dried under heating so that the film thickness after drying would be 1.5 μm, thereby to form an undercoat layer.

Then, as a charge generation material, 20 parts of D-type oxytitanium phthalocyanine (chlorine content: at most 0.1% as an elemental analytical value) and 280 parts of 1,2-dimethoxyethane were mixed and pulverized by a sand grind mill for two hours to carry out microsizing/dispersion treatment. Then, to such a micronizing-treated liquid, a binder liquid obtained by dissolving 10 parts of polyvinyl butyral (tradename "DENKA BUTYRAL" #6000C, manufactured by Denki Kagaku Kogyo Kabushiki Kaisha), into a liquid mixture of 253 parts of 1,2-dimethoxyethane and 85 parts of 4-methoxy-4-methyl-2-pentanone, and 230 parts of 1,2-dimethoxyethane, were mixed to prepare a dispersion (charge generation material).

This dispersion (the charge generation material) was applied to the above aluminum cylinder provided with the undercoat layer, by dip coating and dried so that the film thickness after drying would be 0.3 μm (0.3 g/m$^2$), thereby to form a charge generation layer.

Then, a coating fluid for a charge transport layer prepared by dissolving in 640 parts of a solvent mixture of tetrahydrofuran/toluene (8/2), 60 parts of the following compound CT-1 (ionization potential=5.24 eV) as a charge transport material, 0.5 part of the electron accepting compound AC-1 (LUMO energy level=−1.52 eV), 100 parts of a polycarbonate having the following structure B-1 as a repeating unit (viscosity average molecular weight: about 30,000, m:n=1:1) as a binder resin:

AC-1

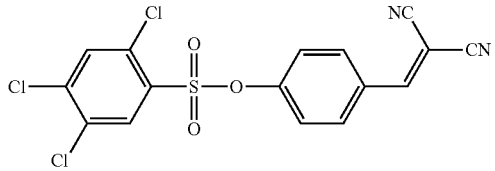

-continued

B-1

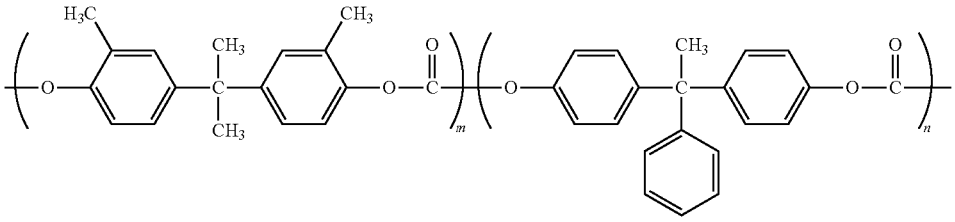

8 parts of an antioxidant having the following structure:

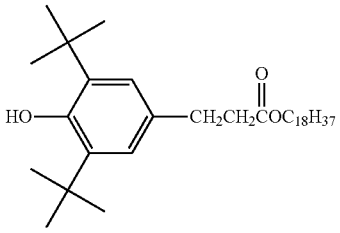

0.05 part of silicone oil (tradename: KF96, manufactured by Shin-Etsu Chemical Co., Ltd.) as a leveling agent, was applied on the above charge generation layer by dip coating so that the film thickness after drying would be 18 μm, to obtain a photoreceptor drum E1 having a laminated type photosensitive layer. The surface property (surface free energy) of the obtained drum was obtained by the above-described method. The result is shown in Table 4.

Photoreceptor Production Example 2

Photoreceptor E2 was prepared in the same manner as in Photoreceptor Production Example 1 except that in Photoreceptor Production Example 1, instead of using CT-1, 35 parts of the following compound CT-2 (ionization potential: 5.19 eV) was used.

CT-2

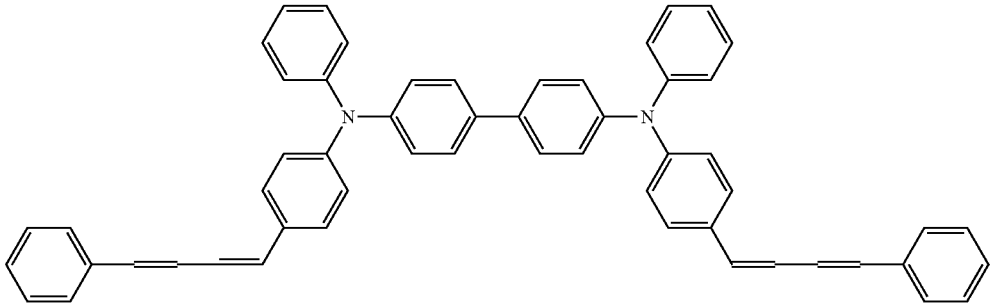

Photoreceptor Production Example 3

Photoreceptor E3 was prepared in the same manner as in Photoreceptor Production Example 2 except that in the Photoreceptor Production Example 2, instead of using 35 parts of CT-2, 55 parts were used, and instead of using B-1 as the binder resin, a polyallylate having a repeating unit of the following structure B-2 (viscosity average molecular weight: about 40,000) was used.

B-2

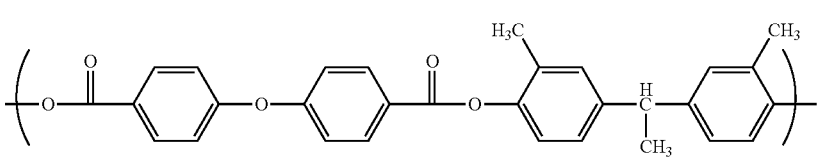

Photoreceptor Production Example 4

Photoreceptor E4 was prepared in the same manner as in Photoreceptor Production Example 1 except that in Photoreceptor Production Example 1, instead of using CT-1, 40 parts of the following compound CT-3 (ionization potential: 5.37 eV) and 10 parts of the following compound CT-4 (ionization potential: 5.09 eV) were used, and instead of B-1 as the binder resin, 100 parts of a polycarbonate having a repeating unit of the following structure B-3 (viscosity average molecular weight: about 40,000, polymerized in accordance with a method described in Example 5 in Japanese Patent Application No. 2002-3828) was used.

CT-3

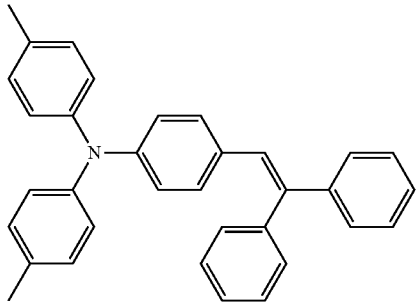

CT-4

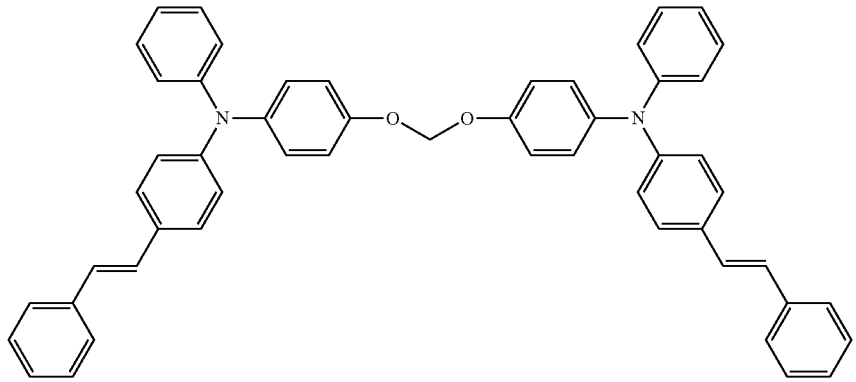

B-3

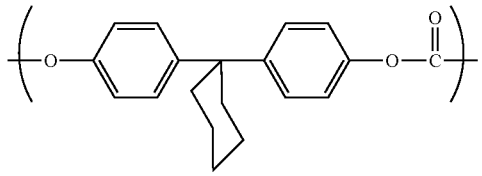

Photoreceptor Production Example 5

Photoreceptor E5 was prepared in the same manner as in Photoreceptor Production Example 1 except that in Photoreceptor Production Example 1, 0.03 part of Megafac (F-482: containing a perfluoroalkyl group) manufactured by Dainippon Ink and Chemicals, Incorporated was added to the coating fluid for a charge transport layer used in Photoreceptor Production Example 1.

Photoreceptor Production Example 6

Photoreceptor E6 was prepared in the same manner as in Photoreceptor Production Example 2 except that in Photoreceptor Production Example 2, 0.3 part of Megafac (F-482: containing a perfluoroalkyl group) manufactured by Dainippon Ink and Chemicals, Incorporated was added to the coating fluid for a charge transport layer used in Photoreceptor Production Example 2.

Photoreceptor Production Example 7

Photoreceptor E7 was prepared in such a manner that 180 g of methyltrimethoxysilane and 30 g of a 3% acetic acid aqueous solution were stirred for 24 hours at room temperature to prepare an oligomer solution of the silane compound. To such a solution, 60 g of N,N-bis(4-hydroxymethyl-phenyl)-p-toluidine, 1 g of a hindered phenol having the following structure and 3 g of aluminum tris-acetylacetonate were added, followed by stirring for 2 hours, and it was filtered by a glass filter to prepare a coating fluid for a protective layer. Such a fluid was spray-coated on the photoreceptor E2 to form a layer having a film thickness of 1 μm, followed by heat drying.

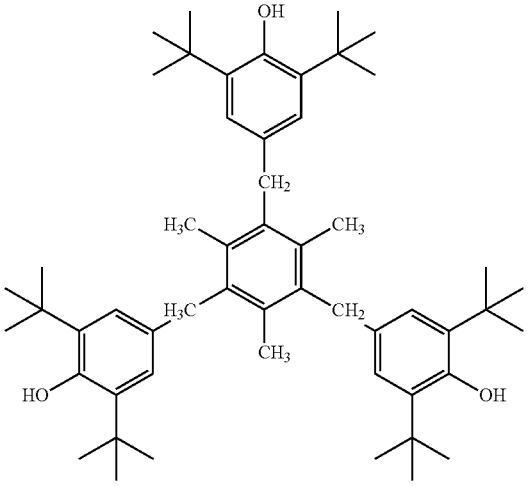

Photoreceptor Production Example 8

Photoreceptor E8 was prepared in the same manner as in Photoreceptor Production Example 1 except that in Photoreceptor Example 1, instead of using CT-1, 40 parts of the following compound CT-5 (ionization potential: 5.19 eV) was used, instead of using AC-1, AC-2 (LUMO energy level=−1.36 eV) was used, and instead of using B-1, B-4 (viscosity average molecular weight: about 50,000, m:n=9:1) was used.

CT-5

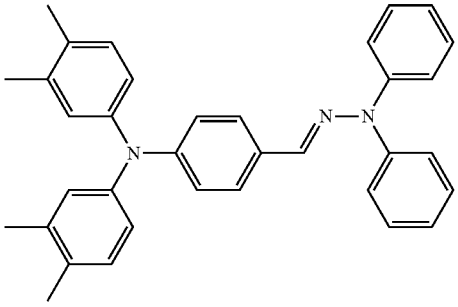

Photoreceptor Production Example 9

Photoreceptor E9 was prepared in the same manner as in Photoreceptor Production Example 1 except that in Photoreceptor Example 1, instead of using CT-1, the following compound CT-6 (ionization potential: 5.27 eV) was used, and instead of using AC-1, AC-3 (LUMO energy level=−2.41 eV) was used.

CT-6

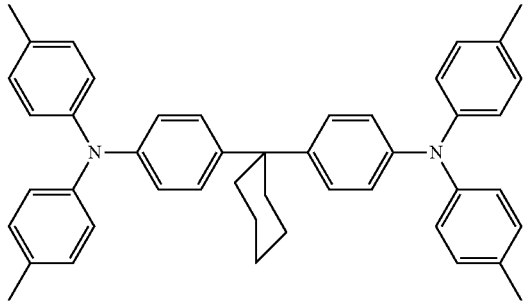

AC-3

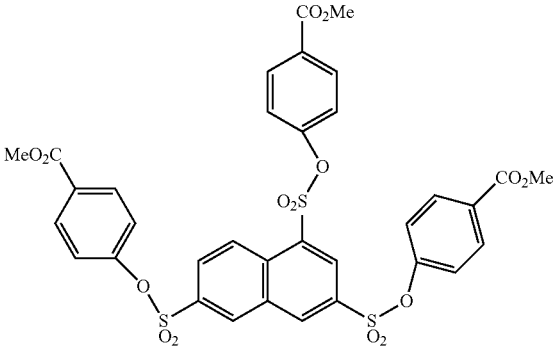

AC-2

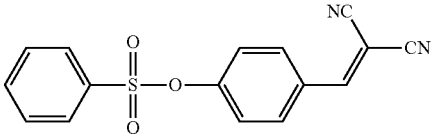

B-4

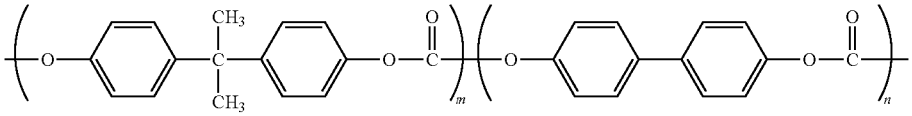

Photoreceptor Production Example 10

Photoreceptor E10 was prepared in the same manner as in Photoreceptor Production Example 1 except that in Photoreceptor Example 1, instead of using CT-1, 45 parts of the following compound CT-7 was used, instead of using AC-1, AC-4 (LUMO energy level=−1.80 eV) was used, and instead of using B-1, 80 parts of B-4 and 20 parts of B-5 (terephthalic acid:isophthalic acid=1:1) were used.

CT-7

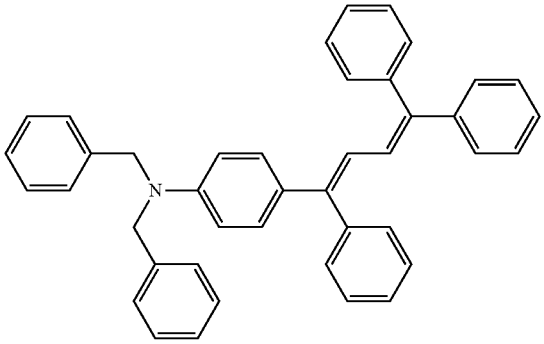

AC-4

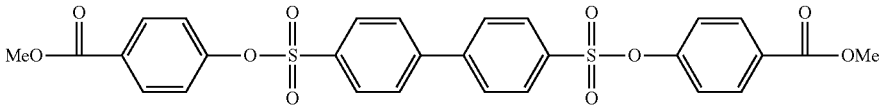

B-5

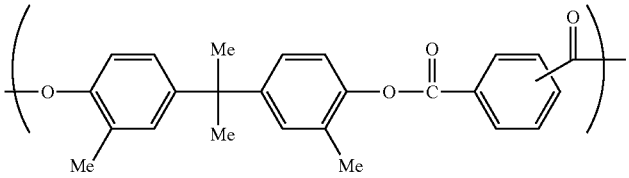

Photoreceptor Production Example 11

Photoreceptor E11 was prepared in the same manner as in Photoreceptor Production Example 1 except that in Photoreceptor Example 1, instead of using CT-1, 40 parts of the following compound CT-8 and 20 parts of CT-9 (IP=5.18 eV) were used, instead of using AC-1, 0.5 part of AC-5 (LUMO energy level=−2.06 eV) was used, and instead of using B-1, 50 parts of B-4 and 50 parts of the following compound B-6 (Mv=40,000) were used.

CT-8

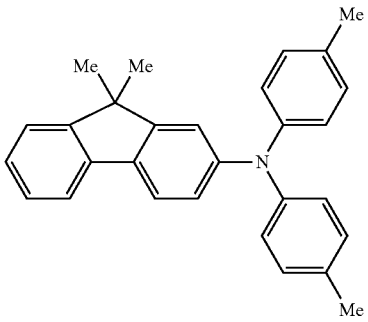

CT-9

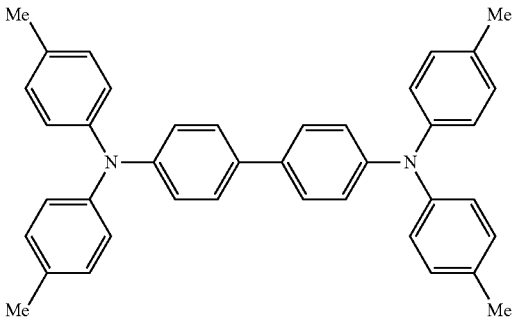

-continued

B-6

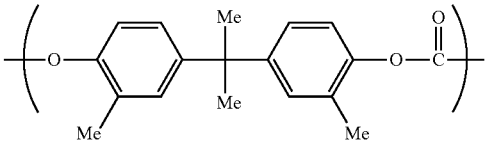

AC-5

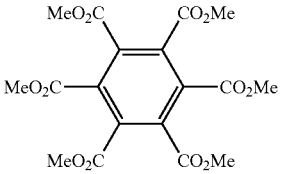

Photoreceptor Production Example 12

50 Parts of titanium oxide powder coated with tin oxide containing 10% of antimony oxide, 25 parts of a resole type phenol resin, 20 parts of methyl cellosolve, parts of methanol and 0.002 part of silicone oil (polydimethylsiloxane/polyoxyalkylene copolymer, average molecular weight: 3,000) were dispersed for two hours by a sand mill employing glass beads having a diameter of 1 mm, to prepare a coating material for electroconductive layer. The coating material for electroconductive layer was applied on an aluminum cylinder having a diameter of 30 mm, a length of 260.5 mm and a wall thickness of 0.75 mm by dip coating and dried at 150° C. for 30 minutes to form an electroconductive layer having a thickness of 12.5 μm. On the electroconductive layer, a solution having 40.0 parts of the same copolymer polyamide as one used in Photoreceptor Production Example 1, dissolved in a solvent mixture comprising 412 parts of methyl alcohol and 206 parts of n-butyl alcohol was applied by dip coating and dried at 100° C. for 10 minutes to form an interlayer having a thickness of 0.65 μm.

Then, 3.5 parts of hydroxygallium phthalocyanine crystals having strong peaks at Bragg angles 2θ±0.2° of 7.4° and 28.2° in CuKα characteristic X-ray diffraction, were mixed with a resin solution having 1 part of polyvinyl butyral (tradename: "DENKA BUTYRAL" #6000C manufactured by Denki Kagaku Kogyo Kabushiki Kaisha) dissolved in 19 parts of cyclohexanone, followed by dispersion for three hours by a sand mill employing glass beads having a diameter of 1 mm to obtain a dispersion, to which 69 parts of cyclohexanone and 132 parts of ethyl acetate were added for dilution to prepare a coating material. By using the coating material, a charge generation layer having a thickness of 0.3 μm was formed.

Then, 9 parts of 2-(di-4-tolyl)-amino-9,9-dimethylfluorene, 1 part of 5-(aminobenzylidene)-5H-dibenzo[a,d]cyclopentene and 10 parts of polyallylate B-5 (viscosity average molecular weight: 96,000) were dissolved in a solvent mixture comprising 50 parts of monochlorobenzene and 50 parts of dichloromethane, to prepare a coating material. This coating material was applied on the charge generation layer by dip coating and dried at 120° C. for two hours to form a charge transport layer having a thickness of 15 μm thereby to prepare photoreceptor E12.

Photoreceptor Comparative Production Example 1

Photoreceptor P1 was prepared in the same manner as in Photoreceptor Production Example 1 except that instead of using a polymer P1, a polyester resin VYLON 245 (registered trademark) manufactured by TOYOBO CO., LTD. was used.

The surface free energies of the photoreceptors E1 and P1 are shown in the following Table 4.

TABLE 4

| Photoreceptor | Surface free energy (mN/m) |
|---|---|
| E1 | 48 |
| E2 | 49 |
| E3 | 46 |
| E4 | 45 |
| E5 | 41 |
| E6 | 35 |
| E7 | 37 |
| P1 | 51 |

Actual Print Evaluation 3

A black drum cartridge and a black toner cartridge for a commercially available tandem type LED color printer MICROLINE Pro 9800PS-E (manufactured by Oki Data Corporation) suitable for A3 printing, were loaded with a photoreceptor produced in each of the above Photoreceptor Production Examples and Photoreceptor Comparative Production Examples, and a toner produced in each of the above Toner Production Examples above and Toner Comparative Production Examples, respectively, and such cartridges were mounted on the printer.

Specifications of MICROLINE Pro 9800PS-E:

Four straight tandem color: 36 ppm, monochro: 40 ppm
600 dpi to 1,200 dpi
Contact roller charging (DC current applied)
LED exposure
Erase light Image Evaluation In the Actual Print Evaluation 3 by using this image forming apparatus, a gradation image (a text chart of Image Society of Japan) was printed out 1,000 copies, and then a white background image and a gradation image (a test chart of Image Society of Japan) were printed out, whereupon the fog value of the white background image and the dot missing in the gradation image were evaluated. The results are shown in Table 5.

Method for Evaluating Fog Degree

The fog degree was obtained in such a manner that a whiteness degree meter was adjusted so that the whiteness degree of a standard sample became 94.4, and the whiteness degree of paper before printing was measured by using this whiteness degree meter. On the same paper, printing was carried out by inputting a signal to make the entire surface white into the above mentioned laser printer, and then the whiteness degree of this paper was measured again, whereupon the difference in whiteness between before and after the printing was measured to obtain the fog degree. This value being large means that the paper after the printing looks dark with many fine black dots, i.e. the image quality is poor.

Method for Evaluating Feasible Density (Dot Missing)

With respect to dot missing, the gradation image was evaluated on such a basis that to what level of density standards, printing is carried out without dot missing, and the lowest density standard where printing is carried out without dot missing, is referred to as "feasible density". The feasible density being smaller means that the print is clear and satisfactory even at a smaller print density portion.

The results are shown in the following Table 5.

TABLE 5

| Ex. No. | Toner | Photoreceptor | Fog degree | Feasible density |
|---|---|---|---|---|
| Ex. 11 | A | E1 | 1.2 | 0.08 |
| Ex. 12 | B | E1 | 1.3 | 0.08 |
| Ex. 13 | C | E1 | 1.2 | 0.08 |
| Ex. 14 | D | E1 | 1.3 | 0.09 |
| Ex. 15 | E | E1 | 1.3 | 0.08 |
| Ex. 16 | F | E1 | 1.3 | 0.09 |
| Comp. Ex. 11 | G | E1 | 1.7 | 0.13 |
| Ex. 17 | A | E2 | 1.1 | 0.09 |
| Ex. 18 | A | E3 | 1.2 | 0.10 |
| Ex. 19 | A | E4 | 1.4 | 0.13 |
| Ex. 20 | A | E5 | 1.3 | 0.09 |
| Ex. 21 | A | E6 | 1.3 | 0.12 |
| Ex. 22 | A | E7 | 1.4 | 0.13 |
| Ex. 23 | A | E8 | 1.2 | 0.08 |
| Ex. 24 | A | E9 | 1.2 | 0.08 |
| Ex. 25 | A | E10 | 1.3 | 0.12 |
| Ex. 26 | A | E11 | 1.1 | 0.09 |
| Ref. Ex. 1 | A | P1 | 1.6 | 0.15 |

Actual Print Evaluation 4

A black drum cartridge and a black toner cartridge for a commercially available tandem type LED color printer MICROLINE Pro 9800PS-E (manufactured by Oki Data Corporation) suitable for A3 printing, were loaded with photoreceptor E1 and toner A or G produced in the above Toner Production Example 1 or Toner Comparative Production Example 1, respectively, and such cartridges were mounted on the above printer. And, after removing a cleaning blade of this apparatus, evaluation of an image was carried out in the same manner as in Actual Print Evaluation 3.

The results of Actual Print Evaluation 4 are shown in the following Table 6. In a case where toner A was used, no substantial change from Actual Print Evaluation 3 was observed, but in a case where toner G was used, substantial image deterioration was observed.

TABLE 6

| Ex. No. | Toner | Photoreceptor | Fog degree | Feasible density |
|---|---|---|---|---|
| Ex. 27 | A | E1 | 1.3 | 0.08 |
| Comp. Ex. 12 | G | E1 | 1.9 | 0.16 |

Actual Print Evaluation 5

The toner A obtained in the above Toner Production Example 1 was charged into a cartridge of a 600 dpi machine of a rubber developing roller-contact development system of non-magnetic one component (using photoreceptor E1) at a developing speed of 164 mm/s and a belt transfer system with a guaranteed lifetime number of copies at a 5% print ratio being 30,000 copies, and a chart of a 1% print ratio was continuously printed 50 copies, whereby soiling of the image was visually observed, but no distinct soiling was visually observed.

As is apparent from the above results, toners A to F satisfying the formula (1) all showed a sufficiently small standard deviation of the electrostatic charge and a sharp electrostatic charge distribution. Further, also in the actual print evaluation using the electrophotostatic photoreceptor having an interlayer, no soiling was observed, or very slight soiling was observed, but such was at an acceptable level.

On the other hand, with the image forming apparatus using toner G which does not satisfy the formula (1), the standard deviation of the electrostatic charge was large, and the electrostatic charge distribution was not sharp. Further, also in the actual print evaluation, a synergistic effect was confirmed by the use of the electrophotographic photoreceptor of the present invention.

In Actual Print Evaluation 1 to Actual Print Evaluation 5, carried out under various actual print conditions by using various machines, any combination of the toner having a specific particle size distribution and the photoreceptor having a specific photosensitive layer, in the present invention, exhibited synergistic effects and showed suitable actual print characteristics. On the other hand, a combination wherein either one of the toner or the photoreceptor did not satisfy the requirements of the present invention, did not show suitable actual print characteristics.

Industrial Applicability

The image forming apparatus of the present invention has little formation of e.g. soiling of image white parts, residual images (ghosts) or blurring (blotted image follow-up properties) and has a good cleaning property. Further, it has a sharp electrostatic charge distribution, whereby the image stability is excellent. Its particle size distribution is narrow, whereby even if the particle size of the toner is decreased, little fine powder remains, and thus the bulk density is improved. Therefore, the fixing property is good and the image forming apparatus is excellent in image stability during the use for a long period of time. As a result, it is not only useful for usual printers, copying machines, etc., but also widely useful for e.g. an image-forming method by high speed printing with a high resolution and long useful life, which has been developed in recent years.

The entire disclosure of Japanese Patent Application No. 2006-092751 filed on Mar. 30, 2006 including specification, claims, drawings and summary is incorporated herein by reference in its entirety.

The invention claimed is:

1. A method, comprising forming an image on a substrate with an electrophotographic photoreceptor and a toner for developing an electrostatic charge image, wherein a photosensitive layer of the electrophotographic photoreceptor contains a resin having a structural unit represented by the following formula (A):

(A)

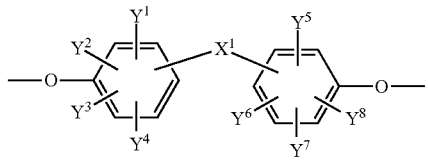

where $X^1$ is a single bond or a connecting group having no cyclic structure, and each of $Y_1$ to $Y^8$ which are independent of one another, is a hydrogen atom or a substituent having at most 20 carbon atoms;

the toner for developing an electrostatic charge image is a toner for developing an electrostatic charge image containing toner matrix particles formed in an aqueous medium; the toner has a volume median diameter (Dv50) of from 5 μm to 7.0 μm; and the relationship between the volume median diameter (Dv50) and the percentage in number (Dns) of toner particles having a particle diameter of from 2.00 μm to 3.56 μm satisfies:

$$0.0517\mathrm{EXP}(22.4/Dv50) \leq Dns \leq 0.233\mathrm{EXP}(17.3/Dv50)$$

where Dv50 is the volume median diameter (μm) of the toner, and Dns is the percentage in number of toner particles having a particle diameter of from 2.00 μm to 3.56 μm.

2. The method according to claim 1, wherein the volume median diameter (Dv50) of the toner for developing an electrostatic charge image, is at least 5.4 μm.

3. The method according to claim 1, wherein in the toner for developing an electrostatic charge image, the percentage in number (Dns) of toner particles having a particle diameter of from 2.00 μm to 3.56 μm is at most 6% in number.

4. The method according to claim 1, wherein the toner for developing an electrostatic charge image is one having toner matrix particles produced by polymerization in an aqueous medium.

5. The method according to claim 4, wherein in the toner for developing an electrostatic charge image, toner matrix particles are ones produced by an emulsion polymerization aggregation method.

6. The-method according to claim 1, wherein in the toner for developing an electrostatic charge image, the toner matrix particles are ones having fine resin particles fixed or deposited on core particles.

7. The method according to claim 6, wherein the fine resin particles contain wax.

8. The method according to claim 1, wherein the developing process speed of a latent image support is at least 100 mm/sec.

9. The method according to claim 1, wherein the resin is a polycarbonate resin comprising at least one bisphenol selected from the group consisting of

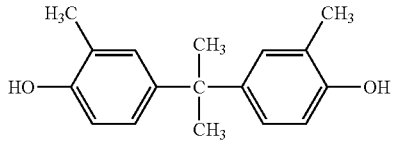

and

-continued

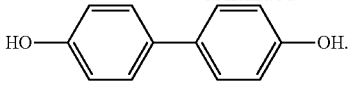

10. A method, comprising forming an image on a substrate with an electrophotographic photoreceptor and a toner for developing an electrostatic charge image, wherein a photosensitive layer of the electrophotographic photoreceptor contains a polyarylate resin; the toner for developing an electrostatic charge image is a toner for developing an electrostatic charge image containing toner matrix particles formed in an aqueous medium; the toner has a volume median diameter (Dv50) of from 5 μm to 7.0 μm; and the relationship between the volume median diameter (Dv50) and the percentage in number (Dns) of toner particles having a particle diameter of from 2.00 μm to 3.56 μm satisfies:

$$0.0517\mathrm{EXP}(22.4/Dv50) \leq Dns \leq 0.233\mathrm{EXP}(17.3/Dv50)$$

where Dv50 is the volume median diameter (μm ) of the toner, and Dns is the percentage in number of toner particles having a particle diameter of from 2.00 μm to 3.56 μm.

11. The method according to claim 10, wherein the polyallylate resin comprises at least one bisphenol selected from the group consisting of

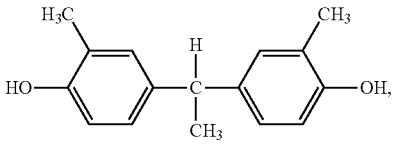

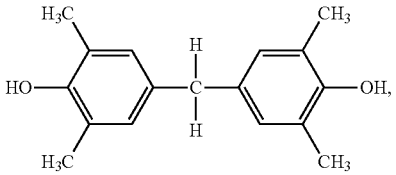

and

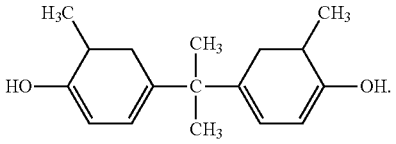

12. A method, comprising forming an image on a substrate with an electrophotographic photoreceptor and a toner for developing an electrostatic charge image, wherein a photosensitive layer of the electrophotographic photoreceptor contains a charge transport agent having an ionization potential of from 5.0 to 5.3; the toner for developing an electrostatic charge image is a toner for developing an electrostatic charge image containing toner matrix particles formed in an aqueous medium; the toner has a volume median diameter (Dv50) of from 5 μm to 7.0 μm; and the relationship between the volume median diameter (Dv50) and the percentage in number (Dns) of toner particles having a particle diameter of from 2.00 μm to 3.56 μm satisfies:

$$0.0517\mathrm{EXP}(22.4/Dv50) \leq Dns \leq 0.233\mathrm{EXP}(17.3/Dv50)$$

where Dv50 is the volume median diameter (μm ) of the toner, and Dns is the percentage in number of toner particles having a particle diameter of from 2.00 μm to 3.56 μm.

13. A method, comprising forming an image on a substrate with an electrophotographic photoreceptor and a toner for developing an electrostatic charge image, wherein a photosensitive layer of the electrophotographic photoreceptor contains a hindered phenol compound as an antioxidant; the toner for developing an electrostatic charge image is a toner for developing an electrostatic charge image containing toner matrix particles formed in an aqueous medium; the toner has a volume median diameter (Dv50) of from 5 μm to 7.0 μm; and the relationship between the volume median diameter (Dv50) and the percentage in number (Dns) of toner particles having a particle diameter of from 2.00 μm to 3.56 μm satisfies:

$$0.0517\mathrm{EXP}(22.4/Dv50) \leq Dns \leq 0.233\mathrm{EXP}(17.3/Dv50)$$

where Dv50 is the volume median diameter (μm ) of the toner, and Dns is the percentage in number of toner particles having a particle diameter of from 2.00 μm to 3.56 μm.

14. A method, comprising forming an image on a substrate with an electrophotographic photoreceptor and a toner for developing an electrostatic charge image, wherein a photosensitive layer of the electrophotographic photoreceptor contains a compound having a LUMO energy level value of from −1.0 eV to −3.0 eV by structural optimization by means of semiempirical molecular orbital calculation using PM3 parameters; the toner for developing an electrostatic charge image is a toner for developing an electrostatic charge image containing toner matrix particles formed in an aqueous medium; the toner has a volume median diameter (Dv50) of from 5 μm to 7.0 μm; and the relationship between the volume median diameter (Dv50) and the percentage in number (Dns) of toner particles having a particle diameter of from 2.00 μm to 3.56 μm satisfies:

$$0.0517\mathrm{EXP}(22.4/Dv50) \leq Dns \leq 0.233\mathrm{EXP}(17.3/Dv50)$$

where Dv50 is the volume median diameter (μm ) of the toner, and Dns is the percentage in number of toner particles having a particle diameter of from 2.00 μm to 3.56 μm.

15. A method, comprising forming an image on a substrate with an electrophotographic photoreceptor and a toner for developing an electrostatic charge image, wherein a photosensitive layer of the electrophotographic photoreceptor contains a compound represented by the following formula (B):

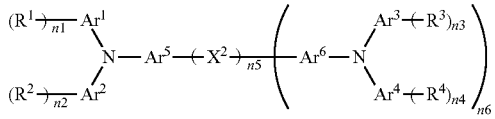

(B)

where each of $Ar_1$ and $Ar^6$ which are independent of one another, is an aromatic group which may have a substituent, or an aliphatic group which may have a substituent, $X^2$ is an organic group, each of $R_1$ to $R^4$ which are independent of one another, is an unsaturated group, and each of n1 to n6 which are independent of one another, is an integer of 0, 1 or 2, provided that when n1 is 1, n2 is also 1;

the toner for developing an electrostatic charge image is a toner for developing an electrostatic charge image containing toner matrix particles formed in an aqueous medium; the toner has a volume median diameter (Dv50) of from 5 μm to 7.0 μm; and the relationship between the volume median diameter (Dv50) and the percentage in number (Dns) of toner particles having a particle diameter of from 2.00 μm to 3.56 μm satisfies:

$$0.0517\mathrm{EXP}(22.4/Dv50) \leq Dns \leq 0.233\mathrm{EXP}(17.3/Dv50)$$

where Dv50 is the volume median diameter (μm) of the toner, and Dns is the percentage in number of toner particles having a particle diameter of from 2.00 μm to 3.56 μm.

16. The method according to claim 15, wherein the compound represented by formula (B) is

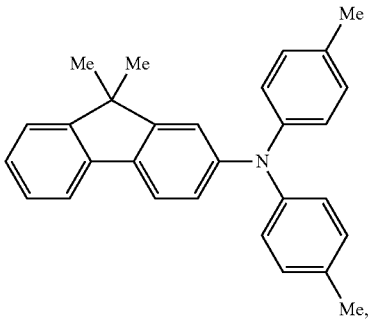

or

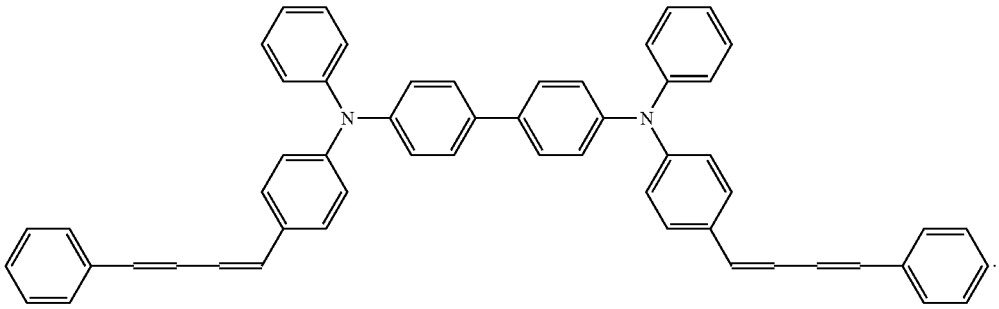

17. A method, comprising forming an image on a substrate with an electrophotographic photoreceptor and a toner for developing an electrostatic charge image, wherein the electrophotographic photoreceptor is a lamination type photoreceptor comprising a charge generation layer and a charge transport layer; the weight ratio of a charge transport agent to a binder (i.e. charge transport agent/binder) contained in the charge transport layer is from 0.3 to 0.6; the toner for developing an electrostatic charge image is a toner for developing an electrostatic charge image containing toner matrix particles formed in an aqueous medium; the toner has a volume median diameter (Dv50) of from 5 μm to 7.0 μm; and the relationship between the volume median diameter (Dv50) and the percentage in number (Dns) of toner particles having a particle diameter of from 2.00 μm to 3.56 μm satisfies:

$$0.0517\mathrm{EXP}(22.4/Dv50) \leq Dns \leq 0.233\mathrm{EXP}(17.3/Dv50)$$

where Dv50 is the volume median diameter (μm) of the toner, and Dns is the percentage in number of toner particles having a particle diameter of from 2.00 μm to 3.56 μm.

18. A method, comprising forming an image on a substrate with an electrophotographic photoreceptor and a toner for developing an electrostatic charge image, wherein the outermost layer of the electrophotographic photoreceptor has a surface free energy γvalue of from 35 mN/m to 65 mN/m; the toner for developing an electrostatic charge image is a toner for developing an electrostatic charge image containing toner matrix particles formed in an aqueous medium; the toner has a volume median diameter (Dv50) of from 5 μm to 7.0 μm; and the relationship between the volume median diameter (Dv50) and the percentage in number (Dns) of toner particles having a particle diameter of from 2.00 μm to 3.56 μm satisfies:

$$0.0517\mathrm{EXP}(22.4/Dv50) \leq Dns \leq 0.233\mathrm{EXP}(17.3/Dv50)$$

where Dv50 is the volume median diameter (μm) of the toner, and Dns is the percentage in number of toner particles having a particle diameter of from 2.00 μm to 3.56 μm.

* * * * *